US005746423A

United States Patent [19]

Arov

[11] Patent Number: 5,746,423

[45] Date of Patent: May 5, 1998

[54] PRECISION MACHINE TOOL VISE WITH SELF ADJUSTING CLAMP

[75] Inventor: Gennady Arov, 8969 N. Iroquois Rd., Bayside, Wis. 53217

[73] Assignees: Gennady Arov, Bayside; James L. Zaske, Greendale, both of Wis.

[21] Appl. No.: 593,943

[22] Filed: Jan. 30, 1996

[51] Int. Cl.[6] ..... B25B 1/24; B25B 5/16

[52] U.S. Cl. ..... 269/266; 269/265; 269/267; 269/257

[58] Field of Search ..... 269/266, 267, 269/270, 265, 257, 244, 240

[56] References Cited

U.S. PATENT DOCUMENTS

| | | | |
|---|---|---|---|
| 1,256,217 | 2/1918 | Fieldhouse | 269/267 |
| 2,754,708 | 7/1956 | Peterson | 269/266 |
| 2,882,771 | 4/1959 | Blazek | 269/266 |
| 3,604,700 | 9/1971 | Gault | 269/288 |
| 3,868,102 | 2/1975 | Pevar | 269/26 |
| 4,006,525 | 2/1977 | Hennenfent et al. | 29/558 |
| 4,047,709 | 9/1977 | Thyberg | 269/22 |
| 4,090,422 | 5/1978 | Berbalk | 82/1 C |
| 4,211,393 | 7/1980 | Olivant | 269/111 |
| 4,276,794 | 7/1981 | Berbalk | 82/1 C |
| 4,353,537 | 10/1982 | Koufos | 269/266 |
| 4,459,913 | 7/1984 | Kowalik | 101/415.1 |
| 4,528,727 | 7/1985 | Adomeit | 24/132 |
| 4,529,183 | 7/1985 | Krason | 269/43 |
| 4,572,564 | 2/1986 | Cipolla | 294/88 |
| 4,752,063 | 6/1988 | Nagy | 269/266 |
| 4,794,824 | 1/1989 | Chapman | 81/165 |

(List continued on next page.)

OTHER PUBLICATIONS

"Quick Change Jaw Fixturing System," *Precision Toolmaker*, Jan. 1995, p. 35.

News Release of Niki Swiss Corporation, "Modular, Multi-part Work-holding System Boosts CNC Productivity," Mar. 9, 1994.

"Cutting Tools," *Modern Machine Shop*, Aug. 1990, v63, n3, p. 402(11).

Carr Lane Roemheld Mfg. Co. Catalog, p. 66, Swiftsure, HILMA Precision Machine Vises, Aug. 1992.

Carr Lane Roemheld Mfg. Co., Switsure, Hilma Precision Machine Vises, Aug. 1990.

Snap Jaw Manufacturing, The Original Snap Jaws Quick-Change Vise Jaws, Jan. 1995.

*Primary Examiner*—Timothy V. Eley
*Assistant Examiner*—Lee Wilson
*Attorney, Agent, or Firm*—Nilles & Nilles, S.C.

[57] ABSTRACT

A vise with a clamp having a housing with clamp fingers and load transfer elements enabling the fingers to move relative to each other to compensate for tolerance variations between workpieces simultaneously clamped or contour variations in a workpiece. Each finger is elongate and reciprocable relative to the housing. Preferably, each element is disc-shaped and can be constructed and arranged to interlock with other elements to promote clamp stability. The elements are constructed and arranged within the housing in a first row of elements behind the clamp fingers and a second row of elements behind the first row and can move relative to each other. Preferably, there are the same number of elements in the first row as there are clamp fingers and one less element in the second row. To encourage stability, the housing preferably has inwardly extending dividers between fingers and inwardly extending sidewall portions that can be inwardly inclined to form an element guide surface. In a second embodiment, the clamp consists of inner and a pair of outer modular clamp units that are connected to form an assembly. Each modular unit has a finger, load transfer elements, and at least one load communicating element that extends from one unit to an adjacent unit for enabling units to be joined to form a clamp having a desired number of fingers. In a method of this invention, fingers and elements of the clamp move relative to each other to clamp an unevenly contoured workpiece.

66 Claims, 22 Drawing Sheets

U.S. PATENT DOCUMENTS

| | | | |
|---|---|---|---|
| 4,875,667 | 10/1989 | Schafer | 269/91 |
| 4,915,367 | 4/1990 | Carossino | 269/101 |
| 4,969,637 | 11/1990 | Nishimura | 269/110 |
| 4,995,435 | 2/1991 | Godfrey | 144/363 |
| 5,145,157 | 9/1992 | Polk | 269/266 |
| 5,163,664 | 11/1992 | Calaio | 269/265 |
| 5,246,216 | 9/1993 | Oberst | 269/266 |
| 5,284,331 | 2/1994 | Lee et al. | 269/16 |
| 5,367,753 | 11/1994 | Mueller | 26/73 |
| 5,497,980 | 3/1996 | Chick | 269/43 |
| 5,524,872 | 6/1996 | Lewin et al. | 269/210 |

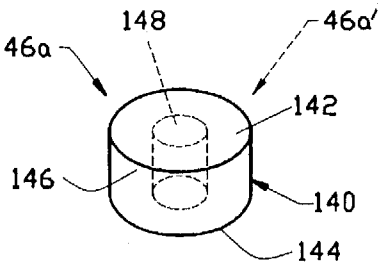
FIG. 11
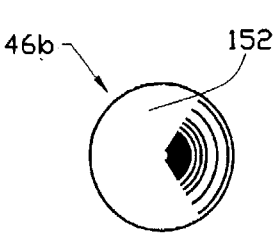
FIG. 12
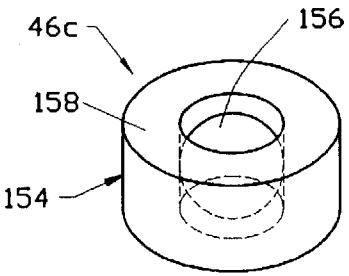
FIG. 13
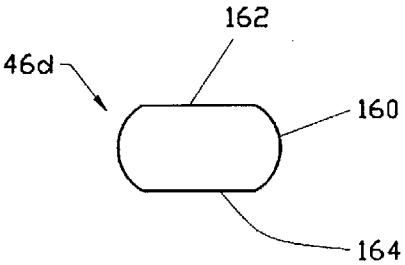
FIG. 14
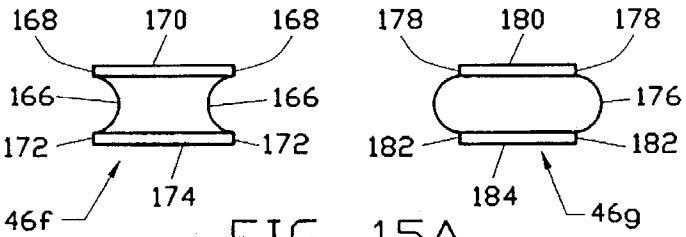
FIG. 15A
FIG. 15B
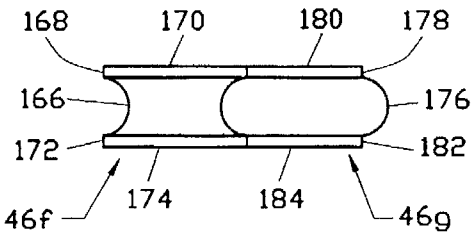

PRECISION MACHINE TOOL VISE WITH SELF ADJUSTING CLAMP

FIELD OF THE INVENTION

This invention relates generally to a method and vise that has a clamp for securely holding in place one or more workpieces, and more particularly to a vise with a clamp capable of compensating for tolerance differences between workpieces when simultaneously holding more than one workpiece and which is versatile in also being able to securely hold in place a single unevenly contoured workpiece.

BACKGROUND OF THE INVENTION

In the clamping of workpieces, many widely varying types of vises and clamps for vises have been developed. For the machining of workpieces by precision machine tools such as CNC machines and other precision machine tools, many of these vises and clamps are unsuitable because they cannot ensure accurate workpiece location while also securely holding workpieces that are to be precision machined. One known challenge in the field of precision machining of workpieces is maintaining the accurate location of each workpiece when clamped such that each machining operation is located accurately on the workpiece when machining is completed. A known difficulty in maintaining accurate location of each workpiece is that each workpiece can vary slightly in size, shape, and, hence, tolerance from every other workpiece, making it very challenging to precisely and accurately machine each workpiece so that each finished workpiece has a machined surface that is virtually identical to and accurately located relative to every other workpiece. This problem can be particularly acute when simultaneously precision machining more than one workpiece clamped together in a precision machine tool vise.

Conventional vises are poorly suited for precision machine tool applications because they typically can only apply a clamping force against an out of tolerance workpiece at only one point along the workpiece. Therefore, even a slight contour variation in a workpiece, such as one producing a tolerance difference of only a few thousandths of an inch, can result in a conventional vise not clamping the workpiece securely enough, which can result in a clamped workpiece undesirably moving during machining. Moreover, in the clamping of an out-of-tolerance workpiece, a vise of conventional construction will apply most, if not virtually all, of its clamping force to a relatively small area of the workpiece, quite possibly damaging the workpiece.

In another type of clamp for a machine tool vise, the clamp has a block that can pivot about a point that is generally centrally located on the jaw to enable the clamp to simultaneously hold two workpieces. Unfortunately, a clamp of this design can be rather bulky, particularly if more than one of these clamps are connected together to clamp more than two workpieces in multiples of two workpieces, making it undesirable to use in machining applications that require limited space. Additionally, the distance between a clamping point, where the clamp engages a workpiece, and its pivot cannot be too great or rather large bending moments will result, possibly causing premature failure. One final disadvantage is that this type of clamp can only hold a maximum of two workpieces at a time, no more, no less. Although it can hold multiples of two workpieces, if several of these clamps are connected together, the resulting clamping mechanism becomes so bulky as to become unwieldy.

Another problem with this type of clamp is that it also cannot securely apply clamping pressure along the entire clamping surface of a single workpiece that is unevenly contoured, dramatically limiting its versatility. Since this type of clamp is limited in the number of workpieces that it can hold at the same time, it also is not cost effective for many machining applications and automated assembly lines that require large numbers of workpieces to be machined in a very short period of time or simultaneously at one time.

Another type of clamp that has been developed in an attempt to overcome these problems has a plurality of "pistons" that extend outwardly from a housing. During clamping, an end of each of these pistons bears against a resilient rubber or plastic backing that is rigidly supported by the clamp housing. When clamping workpieces, each piston is urged against the backing, causing the backing to deform. The backing is constructed and arranged so that its deformation can vary somewhat from piston to piston thereby enabling it to "absorb" some tolerance differences between simultaneously clamped workpieces, allowing this type of clamp to compensate for some tolerance differences between simultaneously clamped workpieces. Unfortunately, the amount of tolerance compensation is limited, in part, by the thickness and deformability of the backing which can limit the effectiveness and usefulness of the clamp. Additionally, cyclic deformation of the backing can create permanent grooves in the backing, thereby reducing the effectiveness of the clamp at compensating for tolerance variations and requiring the costly replacement of backing material on a periodic and, quite possibly, relatively frequent basis. Furthermore, wear and permanent grooves in the backing can cause the clamping force to vary between workpieces simultaneously clamped possibly resulting in some workpieces being insufficiently clamped or, on the other hand, undesirably damaged.

If not securely clamped, a workpiece can undesirably move during machining resulting in defectively machined workpieces. Moreover, when machining more than one workpiece having tolerance differences between them and held by the clamp in a precision machine tool vise, one or more of the workpieces can be pulled out of the vise, damaging the tooling and possibly injuring the operator.

Another known type of precision machine tool clamp has compensating jaws that consist of fingers that each have a T-shaped flange at one end, each of which is received in a complementarily grooved housing. There is a cylindrical spacer between each pair of adjacent fingers that cooperates with the adjacent fingers to enable the clamp to hold a single unevenly contoured workpiece. Unfortunately, all of the fingers of the clamp must be in contact with the workpiece to ensure that the clamping pressure of each finger is relatively balanced, significantly limiting the versatility of this type of clamp because it is only particularly well suited for clamping only a single workpiece that is large enough to be simultaneously engaged by all of the fingers of the clamp. As such, this clamp is particularly poorly suited to hold several workpieces at one time because its clamp fingers can slide laterally within the housing requiring considerable dexterity and time to properly position and orient the workpieces and fingers before and during clamping.

Koufos, U.S. Pat. No. 4,353,537, discloses a clamping device which is versatile in that it can also be used, with slight modification, to support the flat contact surface of a clutch. This clamping device utilizes a casing having openings for allowing relatively large balls, each biased outwardly by a spring, to protrude outwardly through the casing for bearing against an object being clamped. Within the casing, the large balls are in contact with a layer of smaller balls that are spaced from each biasing spring. The layer of smaller balls contact a layer of intermediately sized balls. Both the small and intermediate balls are received in complementary recesses in a rubber mat or sheet.

Unfortunately, the large balls that protrude from the casing provide a small clamping surface area, making the clamp poorly suited for clamping several workpieces at once. Even assuming that this clamp can be suitably used for clamping a single workpiece, because of the rather small area of contact between each large ball and workpiece, the rounded shape of each large ball can result in poor or insufficient clamping pressure being applied to the workpiece which can, in turn, undesirably allow a clamped workpiece to move during machining. On the other hand, the extremely small surface area of contact between each large ball of the clamping device and workpiece is typically only a single point of contact that can, in some instances, cause too much force to be applied to the workpiece, possibly damaging or permanently marring the workpiece. Moreover, due to the inward retraction of each large ball into the casing being resisted largely only by its biasing spring, any tolerance or contour compensating capability as well as the maximum clamping pressure of this clamp are, at best, extremely limited, making it poorly suited for precision machining applications.

As such, this clamp design is poorly suited to handle the large clamping forces that must be applied to a workpiece being precision machined to securely hold the workpiece during machining. Moreover, should any of the balls be pushed too far into the casing during clamping, the casing itself could undesirably directly contact the workpiece. Additionally, as a result of the construction and arrangement of the layers of balls and the mat of this clamp, deflection of the mat can occur during clamping which, in turn, can result in clamp instability by undesirably causing one or more small balls to shift so far laterally during clamping that the balls will not return to their original positions after clamping force is released. Finally, the round shape of its clamping surface is unwieldy and also does not lend itself well to simultaneously clamping more than one workpiece at the same time.

Another known disadvantage that precision machine tool vises have is that they typically require two accurately machined surfaces on the workpiece being clamped to accurately locate the workpiece upon clamping. More specifically, precision machine tool vises typically require a machined locator surface of the workpiece to be in contact with each jaw or clamp of the vise, thereby requiring each opposing jaw or clamp to also have a locator. By requiring a workpiece to already have two locator surfaces before performing additional machining operations on the workpiece, the cost to make the finished workpiece is undesirably increased. Additionally, by requiring each jaw or clamp of a vise to have a locator, the cost to construct each such vise is also undesirably increased. Moreover, by requiring a vise to be constructed with this kind of precision, the normal wear and tear associated with routine use can possibly cause the vise to lose its ability to accurately locate a workpiece to be machined when it is clamped in the vise.

SUMMARY OF THE INVENTION

A vise with a clamp having a housing, at least two reciprocable clamp fingers that can move relative to each other, and at least two load transfer elements received in the housing, all constructed and arranged for securely holding more than one workpiece at the same time while compensating for tolerance differences between workpieces or for securely holding a single workpiece that has an unevenly contoured clamping surface.

The vise has a base with a pair of jaws carried by the base for securely holding one or more workpieces between its jaws. To clamp a workpiece between the jaws, one of the jaws can be moved relative to the other of the jaws preferably in a direction toward the one jaw. To enable the clamp to securely hold more than one workpiece or a single contoured workpiece, the clamp is carried by one of the jaws. So that one of the jaws can be moved relative to the other of the jaws, the jaw that is movable is preferably supported on a guideway or guideways carried by the base of the vise. If desired, the vise can have a clamp of this invention carried by both jaws of the vise.

To enable movement of the movable jaw, the vise has a support carried by the vise with a bore for receiving a vise screw that is in operable communication with the movable jaw. During operation of the vise, rotation of the vise screw in one direction preferably moves one of the jaws toward the other of the jaws to cause the clamp to engage a workpiece to securely hold the workpiece. Rotation of the screw in the other direction preferably moves one of the jaws away from the other of the jaws to release any workpiece from the vise.

To ensure accurate location of a workpiece while it is clamped, one of the jaws preferably has a locator or locator surface that engages a locator or locator surface of a workpiece during clamping. To accurately locate the vise relative to another object, such as a machine tool, the vise is preferably accurately located relative to the machine tool.

Advantageously, a clamp of this invention does not require a locator on each jaw to engage with locators of the workpiece being clamped to ensure accurate location of the workpiece. Rather, to ensure accurate workpiece location, a vise and clamp of this invention only requires one of the jaws to have a locator that engages with a locator on the workpiece when the clamp urges the workpiece against the locating jaw during clamping of the workpiece.

In one preferred embodiment of a clamp of this invention, the clamp has a housing with a front wall, a rear wall, a pair of spaced apart sidewalls, and a bottom, all for defining a cavity within the housing for receiving a pair of clamp fingers and at least two load transfer elements while providing suitable room within the cavity for the fingers and elements to move a limited amount relative to each other. To enable reciprocating movement of each clamp finger, the front wall of the housing has a through bore extending from exterior of the housing into the cavity, with each bore for receiving a clamp finger. To minimize friction while facilitating reciprocating movement of each finger during use and operation of the clamp, each bore can have a replaceable sleeve or liner in the bore that can be sacrificial, if desired.

Each clamp finger is elongate and has a workpiece engaging surface at one end and a load transfer element engaging surface at its opposite end. To prevent withdrawal of each finger from the clamp housing, each finger can be constructed with a head larger than the bore in the housing front wall to create an interference fit, with the head preferably being an outwardly extending flange. To urge each finger against an adjacent load transfer element, each finger preferably operably communicates with a biasing element. Preferably, each biasing element is a spring disposed between an interior surface of the front wall and a portion of the flange of a clamp finger. In a preferred embodiment, the spring is a coil spring generally coaxially telescoped over the finger, with one end of the spring bearing against the flange and its other end bearing against the interior surface of the front wall of the housing.

To enable a clamp of this invention to securely hold a wide variety of workpieces of different shapes, sizes, and contours, each clamp finger can carry an extension on the free end of the finger that extends outwardly from the clamp housing. Each extension preferably has a workpiece engaging surface at its free end and a bore at its opposite end for receiving the free end of a clamp finger. To mount an extension to a clamp finger, each extension can be constructed with a threaded hole generally perpendicular to its clamp finger mounting bore that receives a set screw which engages against a clamp finger received in the bore to prevent its withdrawal.

If it is desirable to direct a portion of the clamping force in a direction other than generally parallel to a longitudinal axis of each clamp finger, the workpiece engaging surface of either one or more clamp fingers or one or more clamp finger extensions can be canted. If the workpiece engaging surface of a clamp finger or workpiece engaging surface is canted, it preferably is canted at an angle that is acute to a plane perpendicular to the longitudinal clamp finger axis.

Each load transfer element preferably has a circular cross section along at least one direction of the element. In one preferred embodiment, the element is disc-shaped, having a flat top and bottom surface with a cylindrical sidewall for providing surface area maximizing line contact between adjacent elements. If desired, each element can have a bore completely therethrough and can be a drill bushing or a cylindrical roller bearing that is preferably hardened, if constructed of steel. Alternatively, each element can be of round construction, such as a ball bearing; generally spherical construction; generally spherical construction with truncated flat top and bottom walls; or a puck that is a disc-shaped washer having a ball bearing in its hollow center.

In another preferred load transfer element embodiment, pairs of adjacent elements can be of interlocking construction for enhancing stability of the clamp assembly during use and operation. Preferably, one of the interlocking elements has a concave sidewall that is truncated to form flat bottom and top walls, and the other of the interlocking elements has a complementary concave sidewall with truncated top and bottom walls. To encourage interlocking, one of the elements has recessed channels and the other of the elements has outwardly extending ridges that mate with the channels when adjacent elements are interlocked with each other. Preferably, each concave sidewalled element has ridges and each convex sidewalled element has channels. If interlocking elements are used, the clamp fingers, housing sidewalls and rear wall can also be of complementary interlocking construction to enhance interlocking and clamp stability.

When received inside the clamp housing, the load transfer elements are constructed and arranged such that there is a first row of elements behind the clamp fingers and a second row of elements behind the first row of elements. Preferably, the second row of elements are located between the rear wall of the clamp housing and the first row of load transfer elements. Preferably, the elements are constructed and arranged within the clamp housing such that there are as many elements in the first row as the number of clamp fingers and one less element in the second row than the number of clamp fingers.

In the first row, each load transfer element is preferably behind the load transfer element engaging surface of a clamp finger and can move relative to the load transfer element engaging surface during clamping. Preferably, each element of the first row is arranged such that a central longitudinal axis of its clamp finger cuts through a portion of the element. During clamping, each load transfer element engaging surface of each clamp finger bears against its adjacent element in the first row.

In the second row, each load transfer element preferably is always in contact with at least two elements of the first row during clamping of a workpiece forming a triangle between the center of each element of the second row and the centers of adjacent contacting elements of the first row. Preferably, the angle between the legs of the triangle that extend from the center of the element of the second row to each center of the elements of the first row is acute and is preferably at least about 45°. During clamping, each element of the second row preferably bears against the rear wall of the housing to provide support to the assembly and transfer clamping forces to the housing and vise.

During clamping, each pair of adjacent clamp fingers is in contact with a pair of load transfer elements of the first row and those same elements in the first row are in contact with an element in the second row that has a center point that lies between both central longitudinal axes of the clamp finger pair. These contact points preferably form a four sided polygon having a first leg extending from the contact point between one of the fingers and elements of the first row and the other of the fingers and elements of the second row. A pair of legs extend from the contact point between each clamp finger and first row element to the contact point between each first row element and the second row element. A fourth leg extends between the contact points of each first row element with the second row element.

For a clamp having more than two clamp fingers, the center point of each first row element of each interior clamp finger forms a triangle with the center points of each pair of second row elements in contact with that first row element. Preferably, the angle between legs of the triangle extending from the center point of the first row element to the center points of each contacting second row element is preferably acute and preferably does not approach or exceed 120° during clamp operation to ensure clamp stability.

To encourage stability of the load transfer elements during clamp operation, within the clamp housing cavity and adjacent the front wall of the housing preferably is an inwardly extending divider or dividing wall between each pair of clamp fingers. To further encourage stability, each sidewall preferably has an inwardly extending sidewall portion to limit load transfer element movement and more particularly to preferably limit extreme outward movement of the outer second row element that is adjacent the sidewall.

Also to encourage clamp stability and to help to more equally distribute clamping forces between clamp fingers, one or preferably both sidewalls have an inwardly inclined guide surface that engages the outer first row element that is adjacent the sidewall. Preferably, each guide surface is acutely inwardly inclined at an angle of at least 5° relative to a longitudinal reference axis of an adjacent clamp finger that is parallel to the direction of movement of the finger. Preferably, each clamp housing sidewall can be constructed with a first sidewall portion that is generally parallel to the clamp finger reference axis and a second sidewall portion that is inwardly inclined to form both (a) a guide surface for the outer element of the first row, and (b) a constraining stability encouraging barrier for the outer element of the second row.

Preferably, a clamp of this construction can securely hold as many workpieces as there are clamp fingers and can also hold a number of workpieces less than the number of clamp fingers. If the clamp is holding a lesser number of workpieces than the number of clamp fingers and one or more clamp fingers are not engaging a workpiece, those clamp fingers not engaging a workpiece preferably can be locked in place so they do not move further outwardly during clamp operation to encourage clamp stability.

In a method of this invention, a clamp of this invention can be used to securely hold a workpiece having an unevenly contoured clamping surface. To clamp the workpiece, the workpiece is received by the vise in operable communication with a jaw of the vise with the unevenly contoured clamping surface oriented so it faces the clamp fingers. Before clamping, finger extensions of the appropriate length are selected and attached to the appropriate clamp finger to ensure points of contact between each finger and the workpiece during clamping so that the workpiece will be securely clamped when clamping is completed.

During clamping, the clamp fingers are moved towards the workpiece until at least one of its fingers engage the clamping surface of the workpiece. To accomplish clamping against the contoured surface while also compensating for workpiece tolerance variations, the fingers of the clamp move relative to other fingers of the clamp causing all of the fingers to engage the clamping surface of the workpiece to securely hold the workpiece.

During clamping and after the fingers (or extensions) have engaged the workpiece, relative movement of the fingers occurs by urging the clamp further against the workpiece. To enable the fingers to move relative to each other, load transfer elements within the clamp move relative to other load transfer elements thereby also enabling the fingers to conform to the uneven contour of the workpiece to engage the workpiece to securely hold the workpiece. To prevent pivoting of each clamp finger extension and to provide support for each extension during clamping, each extension is preferably guided along its longitudinal axis, such as by a clamp finger extension guide assembly carried by the clamp housing and having guide bores through which the extensions are received.

In a second preferred embodiment of a clamp of this invention, the clamp is an assembly that comprises at least one modular inner clamp unit bracketed by a right hand and left hand outer modular clamp unit and elongate load communicating elements to transmit clamp finger displacement between connected clamp units. In use, one or more inner and a pair of outer clamp units can be connected together to construct a clamp assembly having the desired number of clamp fingers or a desired space between clamp fingers.

Each inner clamp unit has a housing with a rear wall, a pair of sidewalls each with a bore for receiving a load communicating element, and a front wall that has a single bore for receiving a clamp finger therethrough. Preferably, each inner clamp unit has three load transfer elements constructed and arranged such that a single element in a first element row bears against the clamp finger and a pair of elements in a second row each bear against the element in the first row. Each element in the second row also engages with a load communicating element that, in turn, is in engagement with a load transfer element of an adjacent clamp unit.

To encourage clamp stability, each sidewall has an inwardly extending portion for constraining movement of the first row element so that it always stays substantially behind the clamp finger. The inwardly extending portion of each sidewall also prevents extreme movement of each second row element toward the front wall so that the desired construction and arrangement of the load transfer elements within the housing cavity is maintained during clamp operation.

Each outer clamp unit has a rear wall, a pair of sidewalls with one of the sidewalls having a bore in it for receiving a load communicating element, and a front wall with a bore for receiving a clamp finger therethrough. Preferably, there is a single element in the first row that bears against the clamp finger, a single element in the second row that bears against the first row element, and a load communicating element that is, in turn, in engagement with a load transfer element of an adjacent clamp unit. Preferably, the elements are constructed and arranged within the clamp housing such that a line between their center points forms an acute angle with a longitudinal reference axis of the clamp finger that can be its central longitudinal axis.

The clamp housing preferably has sidewalls with inwardly extending portions for constraining side-to-side movement of the load transfer elements for encouraging clamp stability. Preferably, one of the sidewalls has an inwardly extending portion that has an inclined guide surface for guiding movement of one of the load transfer elements during use and operation of the clamp unit. Preferably, the guide surface is acutely inwardly inclined relative to a reference axis of the clamp finger for guiding movement of the first row load transfer element to encourage clamp stability during clamp operation.

In another preferred embodiment of a clamp of this invention, the clamp has one pair of adjacent clamp fingers spaced further apart from each other than another pair of adjacent clamp fingers. Preferably, each spaced apart adjacent pair of fingers can be spaced apart by at least one additional load transfer element in the first row and at least one additional element in the second row. In a second preferred construction, the fingers can be spaced apart by an elongate load communicating element in one of the rows that enables all of the elements within the clamp housing to operably communicate cooperate with each other while permitting at least one pair of adjacent fingers to be spaced further apart than another pair of adjacent fingers.

During operation of a clamp of this invention, as each finger comes into contact with a workpiece, it displaces that finger slightly inwardly into the clamp housing setting off a chain reaction of load transfer element motion within the clamp housing for compensating for tolerance differences between workpieces or contour variations along a clamp surface of a single workpiece. As the clamp finger is displaced into the housing, it in turn urges its contacting first row element toward the rear of the housing causing elements in the second row also to move within the clamp housing. Advantageously, in this manner, the construction and arrangement of the clamp fingers and load transfer elements permits clamp fingers to move relative to other clamp fingers during clamping to compensate for tolerance differences between workpieces or contour variations in a single workpiece.

During clamping, all of these fingers and elements cooperate with each other by moving at least slightly relative to each other until an equilibrium is reached in that they can no longer move any further. When equilibrium is reached, clamping force is transferred through the fingers, elements and directly to the housing where, in turn, it is transferred to the vise resulting in a clamp having fingers that are rigid and unmoving.

For a clamp of modular construction, movement of a clamp finger displaces load transfer elements within its associated clamp unit housing which, in turn, can displace one or more load communicating elements that operably cooperate with that clamp unit. As a load communicating element moves in one direction, it also preferably moves a load transfer element in the same direction. Clamp equilibrium is reached when tolerances or contour variations have been successfully compensated and the elements of the clamp units stop their movement.

Objects, features and advantages of this invention are to provide a method and vise that has a clamp with clamp fingers that can move relative to each other for compensating for tolerance differences between workpieces or contour variations along a clamping surface of a single workpiece while still being able to securely hold the workpiece or workpieces; can be constructed with load transfer elements of different sizes to suitably increase or decrease the amount of tolerance compensation that a clamp of this construction can perform; is of compact and modular construction; is readily adaptable for use with assembly lines which use pallets to transfer workpieces between manufacturing stations; can increase production when used in precision machining applications because it can simultaneously and securely hold several accurately located workpieces despite tolerance differences between them; does not require hydraulic fluid and therefore will not leak; can be used to securely hold workpieces for a variety of manufacturing applications where a clamped workpiece is drilled, milled or broached, for example, resulting in machining forces attempting to push or pull a clamped workpiece free of the vise; is of low wear construction and can be cycled repeatedly without adversely affecting clamp operation; relatively evenly distributes clamping force amongst its clamp fingers for preventing damage to a workpiece and preventing damage and wear to the clamp; is quickly and easily adaptable for use in clamping workpieces having unevenly contoured clamping surfaces; is economical because a vise equipped with a clamp of this invention only requires one jaw to have a locator and only a single complimentary locator on the workpiece to be machined whereby location is easily and simply achieved by the clamp urging the workpiece against the locating jaw; is versatile in that it can be used to clamp workpieces of square, rectangular, oval, round or another shape; can be constructed having as few as two clamp fingers and as many fingers as are needed to clamp three or more workpieces or for providing more than one point of contact with a single workpiece or multiple workpieces; is versatile because it can be used for a variety of clamping applications without modification; and is a clamp that is rugged, simple, flexible, reliable, and durable, and which is of economical manufacture and is easy to assemble and use.

BRIEF DESCRIPTION OF THE DRAWINGS

These and other objects, features, and advantages of this invention will become apparent from the following detailed description of the best mode, appended claims, and accompanying drawings in which:

FIG. 11 is a perspective view of a preferred embodiment of a load transfer element having a generally disc-shaped construction;

FIG. 12 is a perspective view of a second preferred embodiment of a load transfer element having a generally round or spherical construction;

FIG. 13 is a perspective view of a third preferred embodiment of a load transfer element generally constructed like a puck;

FIG. 14 is a side view of a fourth preferred embodiment of a load transfer element having generally spherical sidewalls truncated to form a top and bottom;

FIG. 15A is a side view of a pair of interlocking load transfer elements;

FIG. 15B is a side view of a pair of interlocking load transfer elements shown interlocked with each other;

DETAILED DESCRIPTION OF THE INVENTION

I. Introduction

Figure 1:
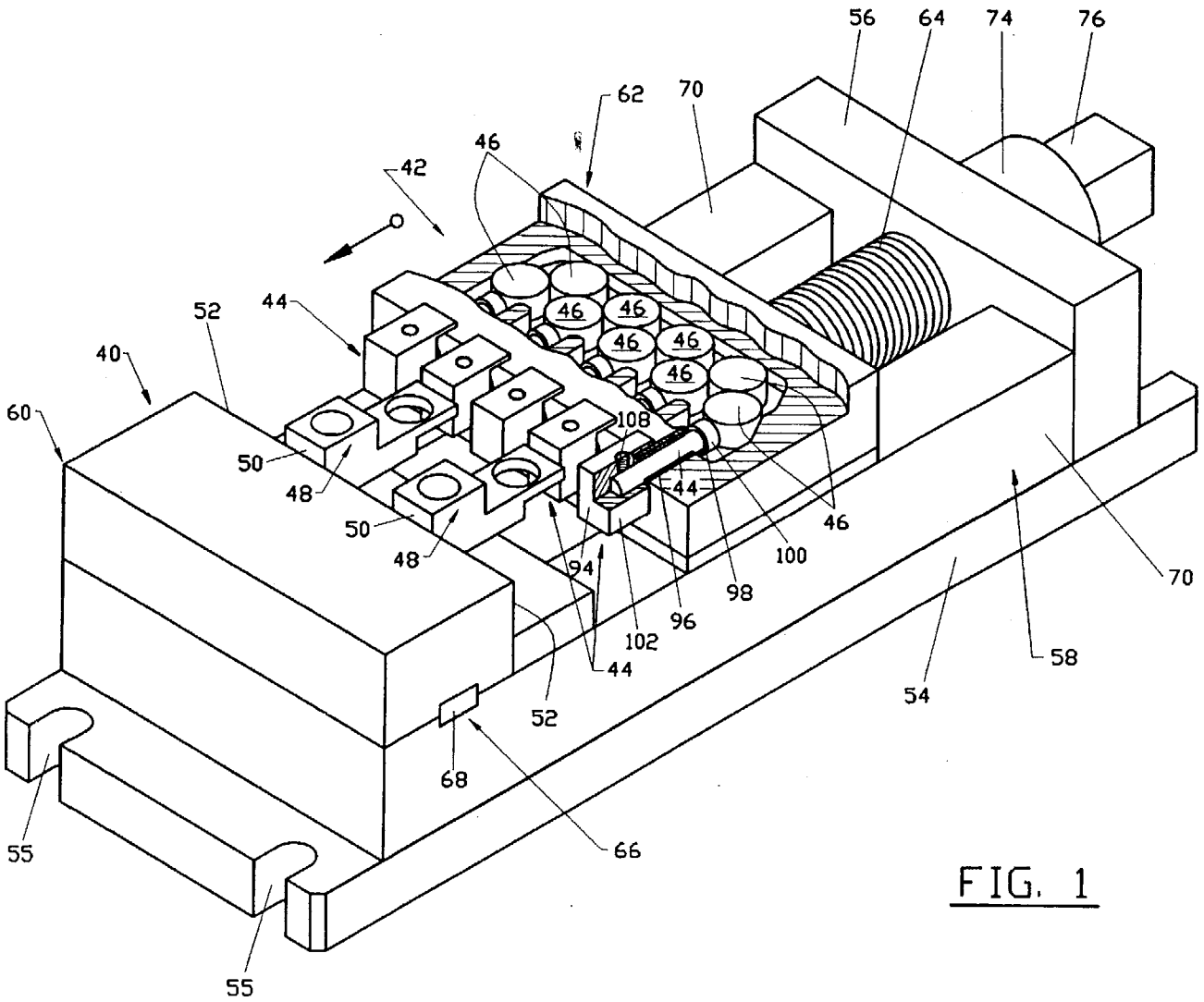
FIG. 1 is a perspective view of a vise having a clamp of this invention with a portion of its housing cutaway to show clamp fingers extending from the clamp in operable communication with a plurality of load transfer elements within the clamp.
Figure 2:
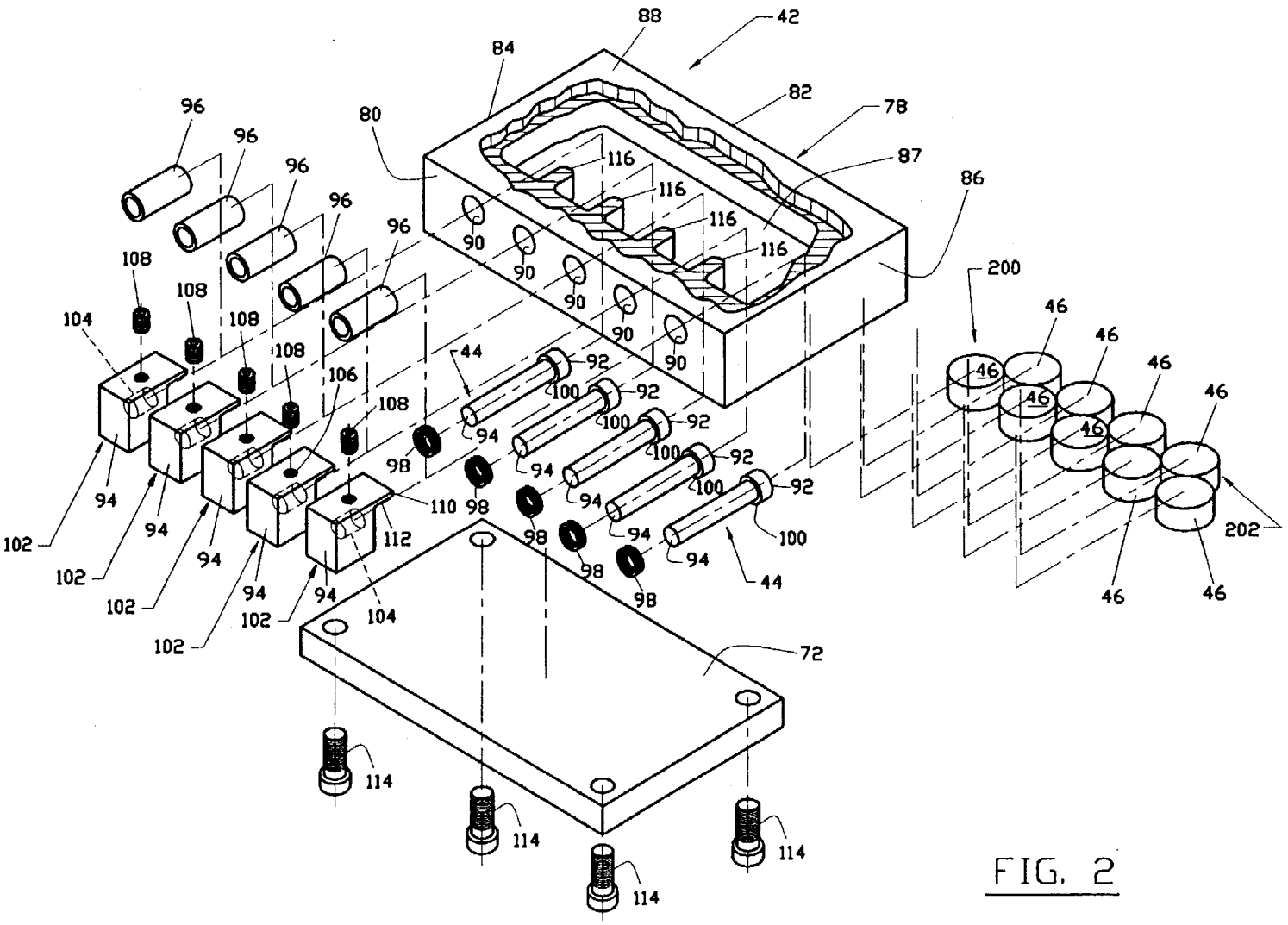
FIG. 2 is an exploded view of the clamp shown in FIG. 1.

FIGS. 1 & 2 illustrate a vise 40 having a clamp 42 with reciprocable pistons or fingers 44 that cooperate with a series of load transfer elements 46 in the clamp 42 constructed and arranged for securely holding one or more workpieces 48 during machining, even though one or more of the workpieces 48 may differ slightly in size from each other such that there are tolerance variations or differences between workpieces 48. By advantageously being able to securely hold workpieces 48 having tolerance variations between them, the vise 40 and clamp 42 of this invention are well adapted for use in precision machine tool applications that require each workpiece 48 to be securely held by the vise 40 while being accurately located relative to the vise 40 to ensure accurate location and precise placement of the machining operation, even though the workpiece 48 may be slightly out of tolerance before machining. To ensure accurate location and precise placement of any machining operation performed on a workpiece 48 while it is held by the vise 40, a locator or locator surface 50 of each workpiece 48 is securely held against a locator or locator surface 52 of the vise 40 when clamped in the vise 40.

For the purpose of describing location and movement of individual load transfer elements 46 of the clamp 42, each load transfer element 46 of a first row 200 of elements of the clamp 42 will be designated with a capital letter, more specifically "A, B, C, . . . ," indicating its position from left to right within the clamp housing 78 and a subscript "1" for indicating it is in the first row 200. Each load transfer element 46 of a second row 202 of elements 46 will bear the same letter designation with the exception that each element label will be designated with a subscript "2" for indicating it is in the second row 202. Likewise, for the purpose of indicating the location of a particular clamp finger 44, each clamp finger 44 is labeled using the letters in the same manner and will be designated with a subscript "0" for indicating it is a clamp finger 44.

II. Vise Construction

As is shown in FIG. 1, the vise 40 has a base 54, a support 56, a slide assembly 58 carried by the base 54, a fixed jaw 60 at one end of the slide 58, a movable jaw 62 at the other end of the slide 58, and a vise screw 64 that extends through the support 56 into the movable jaw 62 of the vise 40. To enable the vise 40 to be used for precision machining applications, its base 54 can be accurately located relative to a machine tool (not shown) for accurately locating the vise 40 relative to a cutting, drilling, abrading, reaming, grinding, broaching, threading, counterboring, chamfering or another tool of a machine tool, so that workpieces 48 held by the vise 40 will also be accurately located relative to the machine tool.

The base 54 of the vise 40 has notches 55 for mounting the vise 40 relative to a machine tool (not shown), such as by mounting the vise 40 on a platform or in a fixture (not shown) of the tool. Preferably, the vise 40 has at least one locator for accurately locating the vise 40 relative to the machine tool. For example, the base 54 of the vise 40 can have a locator notch or channel that mates or engages with a complementary locator when the vise 40 is mounted for accurately locating the vise 40 relative to the tool. Other types of locators and locating devices can also be used for locating the vise 40 relative to a machine tool, another tool, another object, or another device (such as a measurement device, for example).

The slide assembly 58 is preferably accurately located relative to the base 54 of the vise 40 and can be immovably affixed to the base 54 of the vise 40. To help ensure accurate location of the fixed jaw 60 and its locator surface 52, the fixed jaw 60 is preferably accurately located on the slide assembly 58 by preferably being rigidly affixed to the slide assembly 58. The fixed jaw 60 shown in FIG. 1 is depicted as being rigidly affixed to the slide assembly 58 by a connector 66, that can be an elongate key 68, for example, which extends substantially from one side of the jaw 60 to the other side of the jaw 60 and is tightly received in complementary grooves in the slide 58 and jaw 60. Although one method and apparatus for accurately locating and affixing a rigid jaw 60 is depicted in FIG. 1 and described herein, another method and/or apparatus could be used to accurately locate and/or affix a jaw of the vise 40 to the slide assembly 58 or directly to the base of the vise 40.

The slide assembly 58 shown in FIG. 1 has a pair of guideways 70 for guiding the movable jaw 62 into engagement with a single workpiece or more than one workpiece that are to be held by the vise 40 while also enabling the jaw 62 to be retracted free of engagement when it is desired to release each workpiece after machining has been completed. The movable jaw 62 has a base plate 72 that preferably is movably carried by the guideways 70 of the slide assembly 58 for enabling the movable jaw 62 to be reciprocated along the slide 58.

To advance and retract the movable jaw 62, the vise screw 64 extends through a collar 74 and the support 56, and an end of the screw 64 is preferably operably connected to the movable jaw 62. At its other end, the screw 64 preferably has a head or another type of coupling 76 for attachment to a handle, for manual operation of the vise, or for connection to a drive, for more automated operation of the vise 40. In operation, rotation of the coupling 76 rotates the screw 64 and advances or retracts the movable jaw 62 and clamp 42 toward or away from the fixed jaw 60 depending upon the direction of screw rotation.

Figure 3:
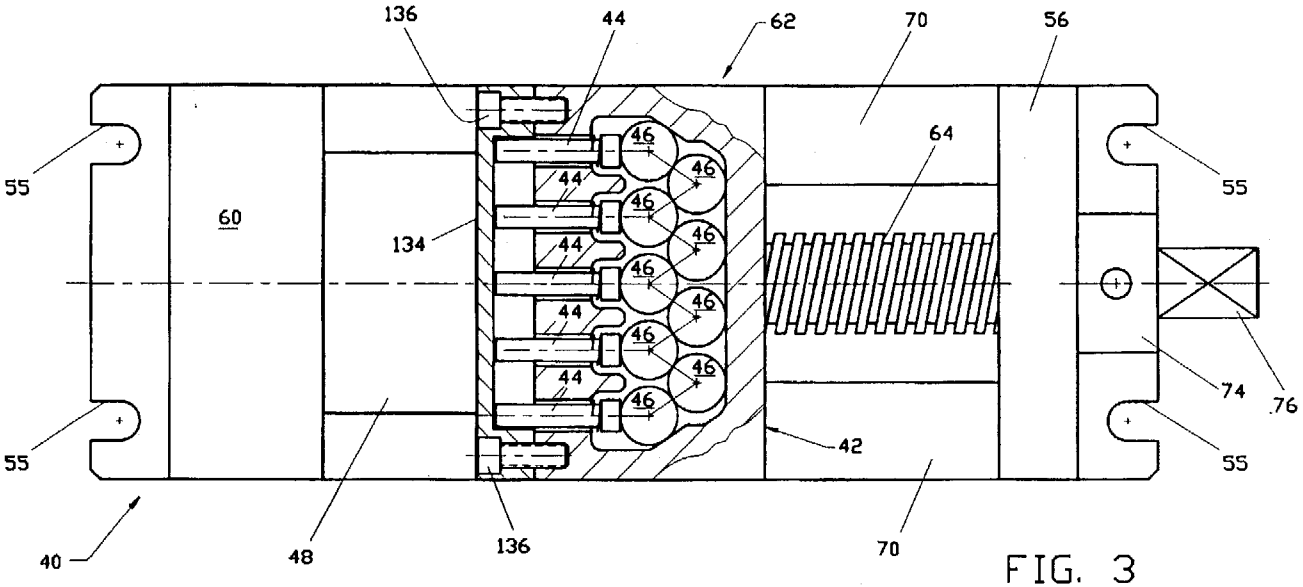
FIG. 3 is a top view of the vise of FIG. 1 modified by a plate covering the fingers of the clamp for enabling the vise to function as a vise of conventional construction.
Figure 4:
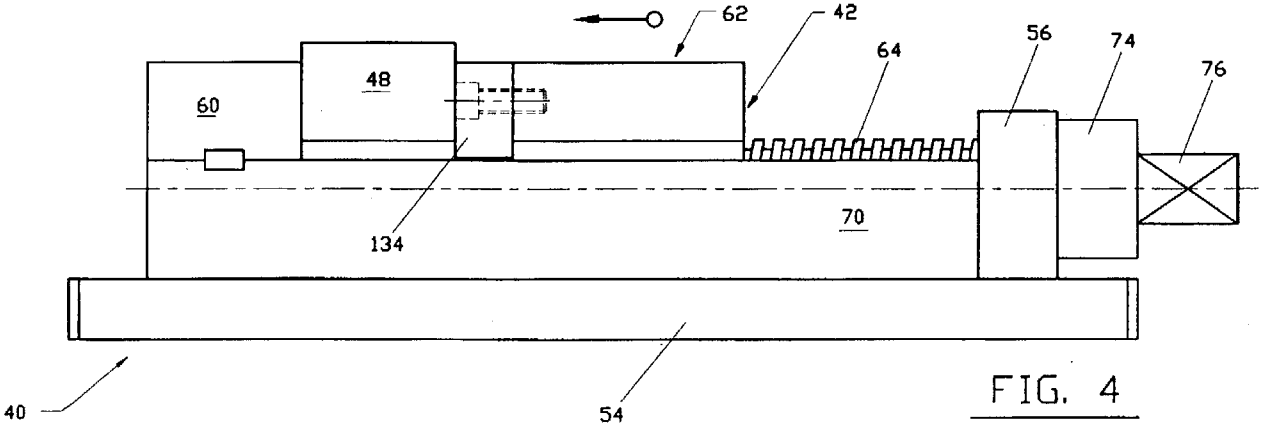
FIG. 4 is a side view of the modified vise of FIG. 3.

Referring additionally to FIGS. 3 & 4, if it is desired to use the vise 40 as a conventional vise, the clamp 42 can be modified by attaching a clamp plate 134 with fasteners 136, such as screws, to the front of the clamp 42.

Although the clamp 42 of this invention is shown in FIG. 1 in combination with the vise 40 of the aforementioned construction, it can be used with other types and configurations of vises, if desired. For example, a clamp 42 of this invention also preferably can be used with a vise that has a different slide assembly, such as a slide assembly that uses one or more cylindrical rods to guide the movable jaw. Additionally, the clamp 42 of this invention can also be used with a vise that has a fixed jaw adjacent the support and a movable jaw disposed from the support. Moreover, a clamp 42 of this invention preferably can also be adapted for use with the type of vise shown and disclosed in Chick, et al., U.S. Pat. No. 4,529,183, the disclosure of which is hereby incorporated by reference. If desired, the clamp 42 of this invention is also well suited for use with vises having a pair of movable, opposed jaws. As such, it is therefore intended that the clamp 42 of this invention can be used in vises and fixtures of many diverse types, configurations, and constructions for securely holding one or more workpieces, preferably for enabling them to be machined.

III. Clamp Construction

Referring to FIGS. 1 & 2, the clamp 42 of this invention has a housing 78 for receiving load transfer elements 46 therein. As is shown more clearly in FIG. 2, the clamp housing 78 has a front wall 80, a rear wall 82, a pair of spaced apart sidewalls 84 & 86, a top 88, and a bottom 72. To retain the load transfer elements 46 within the housing 78, such as when the clamp 42 or vise 40 are being transported or during use, the bottom 72 (also depicted in FIG. 1 as the clamp base 72) of the housing 78 also functions as a cover 72 that can preferably be removably secured to the housing 78. Each clamp finger 44 is received through a bore 90 in the front wall 80 of the clamp housing 78. The load transfer elements 46 are received within the housing 78 and are located within the housing 78 behind the clamp fingers 44.

The interior surfaces of the clamp walls 80, 82, 84, 86 & 88 preferably function to help limit or restrain movement of the load transfer elements 46 within the housing 78 by allowing sufficient movement of each element 46 to compensate for tolerance variations or to conform to an unevenly contoured workpiece while limiting load transfer element movement so as to encourage and preferably maintain stability of the clamp 42 during its use and operation. Preferably, the interior surface of the clamp housing rear wall 82 is constructed and arranged to provide a guide surface for the load transfer elements 46 while also relatively rigidly supporting the load transfer elements 46 during clamping and transmitting clamping forces through the clamp housing 78 to the vise carrying the clamp 42.

A. Clamp Finger and Extension

As is shown in FIG. 2, each clamp finger 44 has a load transfer element engaging surface 92 at one end and a workpiece engaging surface 94 at its other end.

To minimize clamp finger friction and wear during operation of the clamp 42, each finger 44 preferably is received in a liner 96 that is, in turn, received in each bore 90 in the front wall 80 of the clamp housing 78.

Figure 6:
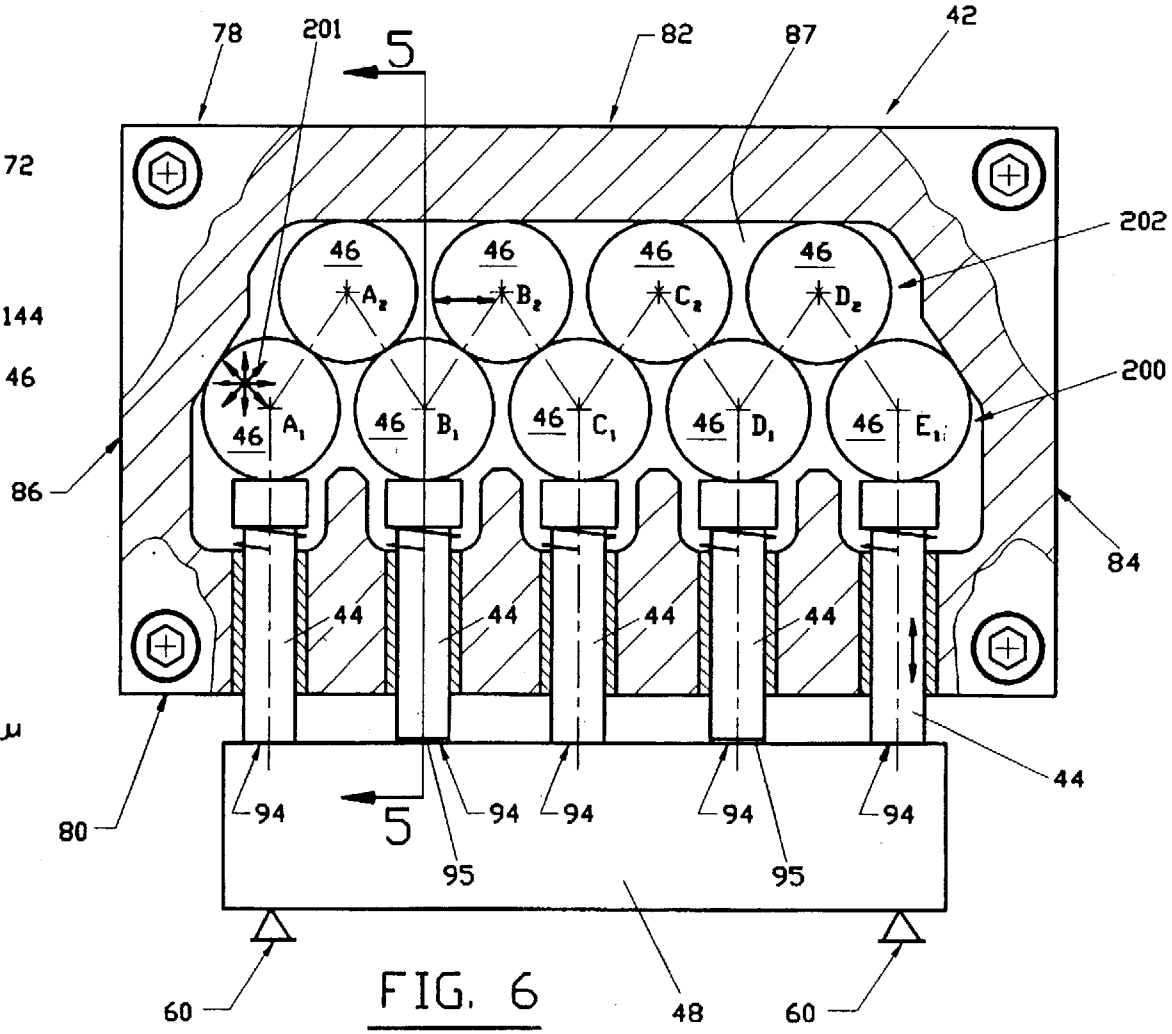
FIG. 6 is a top view of the clamp of FIG. 5 depicting the clamp with some clamp fingers having canted workpiece engaging surfaces at their free end bearing against a workpiece to help securely hold the workpiece.
Figure 5:
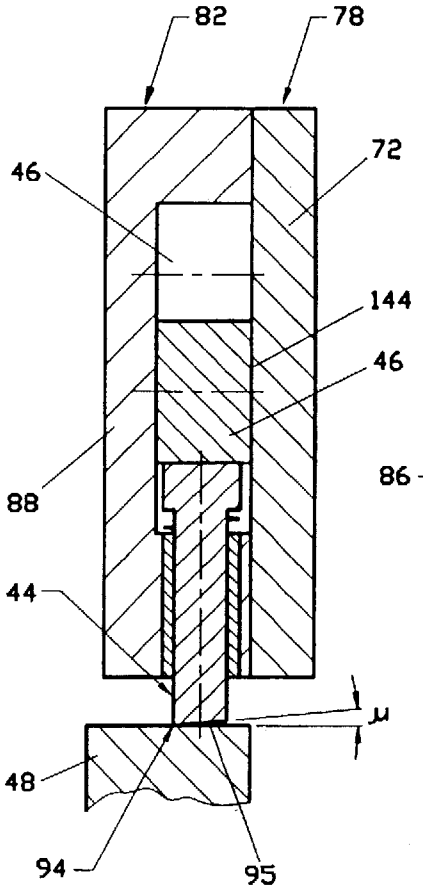
FIG. 5 is a side view of a clamp of this invention having a clamp finger with a canted workpiece engaging surface at its free end for directing a portion of the clamping force exerted by the finger against a workpiece in a direction other than along a longitudinal axis of the clamp finger.

To more securely retain a workpiece 48 during machining operations which tend to pull the workpiece 48 upwardly and/or out of the vise 40, such as while milling a workpiece, one or more of the clamp fingers 44 (or an extension 102) can have, carry, or support a workpiece engaging surface 94 that has a downwardly angled or canted face 95, such as is depicted in FIGS. 5 & 6. With the canted face 95 being angled downwardly, such as at angle, $\mu$, a portion or component of the clamping force will preferably be directed downwardly against the workpiece 48 to prevent the workpiece 48 from being pulled out of the vise 40.

More specifically, a portion or component of the clamping force exerted by a finger 44 with a canted face 95 will be directed against the workpiece 48 at an angle that is not parallel to the longitudinal axis of the finger 44 having the canted face 95. For example, the canted face 95 can be downwardly angled at an angle, $\mu$, of about 5° to help hold securely the workpiece 48 during machining or while another operation is performed on the workpiece 48.

When the clamp 42 is assembled, the opposite end of each finger 44 that is inside the clamp housing 78 preferably bears against a load transfer element 46. To urge each clamp finger 44 against a load transfer element 46, there preferably is a biasing element that is a spring 98 that is located between the interior surface of the clamp housing front wall 80 and the load transfer element engaging surface 92 of each finger 44. Preferably, each spring 98 is a coil spring telescopingly received over each finger 44 having one end of the spring 98 that bears against an outwardly extending flange 100 at the end of each finger 44 adjacent the load transfer element engaging surface 92 and the other end which bears against the interior surface of the housing front wall 80 to urge each finger 44 against a load transfer element 46. If desired, for example, the spring 98 can be disposed between the outer edge of the clamp finger flange 100 (without being telescopingly received around the finger 44) and the interior surface of the clamp housing front wall 80. If desired, the spring 98 can also be disposed between the interior surface of the front wall 80 and a projection (not shown) extending outwardly, such as at a right angle, from an L-shaped clamp finger.

Each clamp finger 44 can be of generally cylindrical construction and can be constructed having a generally circular cross section. If desired, each clamp finger 44 can be an elongate clamp finger of square, generally rectangular, triangular, or another cross section. For example, each clamp finger 44 can be L-shaped and of generally square cross section with an outwardly extending, right-angled flange adjacent its load transfer element engaging surface 92 which also acts as a stop for limiting outward movement of the finger 44 to prevent its complete withdrawal from the clamp housing 78. A portion of such a flange can also function as a spring seat for the biasing spring 98.

Each clamp finger 44 is preferably constructed of a strong and resilient material capable of applying a force against a workpiece being clamped, preferably while not permanently deforming. Preferably, each clamp finger 44 is constructed of a metal such as a steel, a steel alloy, an aluminum, an aluminum alloy, a titanium alloy, a tool steel such as a chrome vanadium steel alloy, or another type of suitable metal. When using a clamp 42 of this invention to hold metal workpieces that are to be machined, the clamp fingers 44 are preferably constructed of steel. If constructed of steel, at least the workpiece engaging surface 94 and load transfer element engaging surface 92 of each finger 44 is preferably hardened, such as by surface hardening, shot peening, cold working, heat treating, solution hardening, or another method of hardening. If desired, particularly for applications requiring the clamp 42 to be able to apply a smaller maximum clamping force, each clamp finger 44 can be constructed of a composite material, a polymeric material, a nylon such as a glass filled nylon, Kevlar, a urethane, an epoxy, a plastic, a rubber, wood, a ceramic material, a carbon fiber composite, or another suitable non-metal.

Figure 7A:
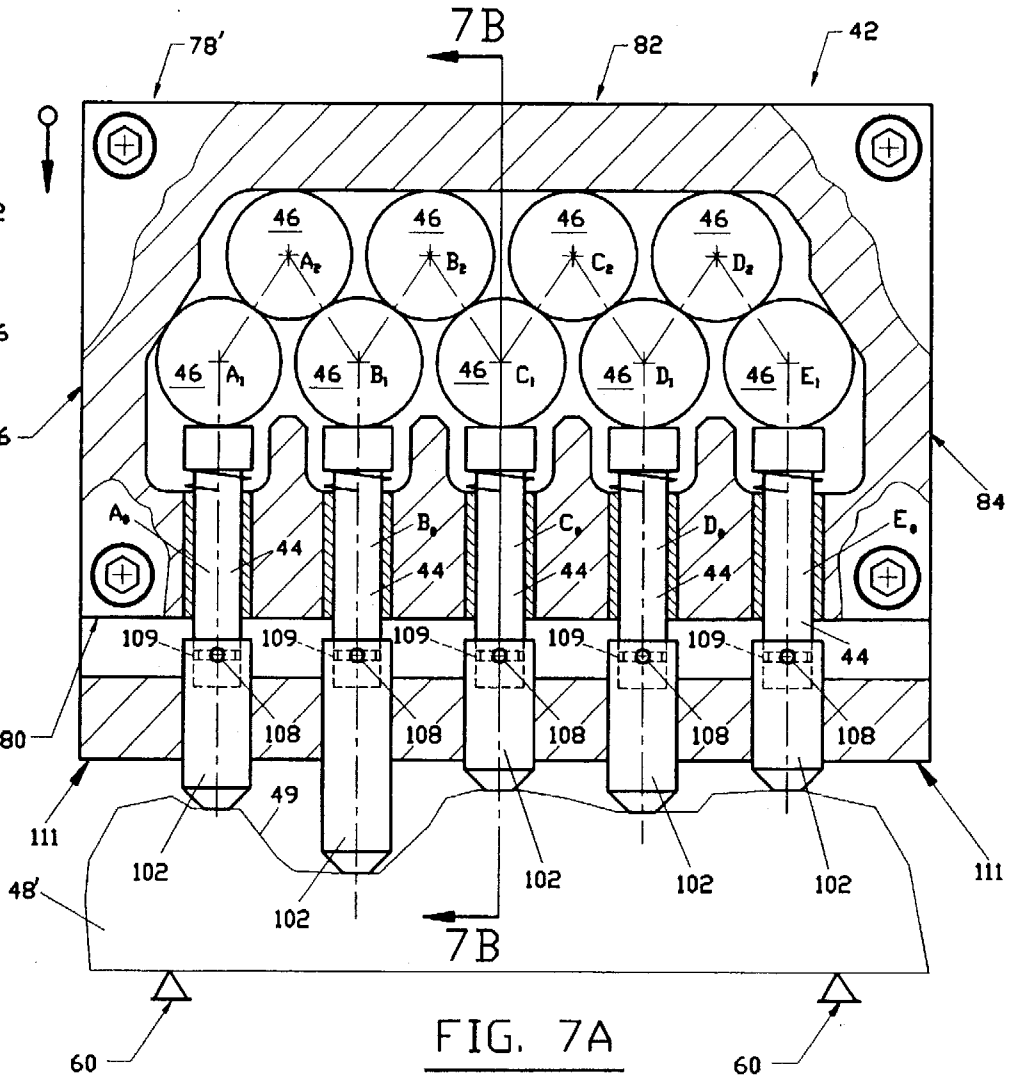
FIG. 7A illustrates a clamp and method of this invention for securely holding a workpiece having an unevenly contoured surface.

As is depicted in FIGS. 1 & 2, an extension 102 can be attached to each clamp finger 44 to vary and extend the useful length of each clamp finger 44 to enable the clamp 42 to hold securely a variety of workpieces of different shapes and configurations while also providing a sacrificial and wear resistant workpiece engaging surface 94. Although the clamp finger extensions 102 shown in FIG. 2 all have the same length, each clamp finger extension 102 can be of a different length, such as is depicted in FIG. 7A, for enabling a clamp 42 of this invention to be used to hold securely a single workpiece 48 that has an unevenly contoured clamping surface 49. Alternatively, each clamp finger 44 can be used without an extension 102 to directly engage a workpiece to securely hold the workpiece in a vise 40, such as is depicted in FIG. 6.

As is shown in FIG. 2, each extension 102 preferably has a bore or a hollow 104 (in phantom) of a cross section that is complementary with the cross section of a clamp finger 44 for enabling each extension 102 to fit over the end of a clamp finger 44. To secure each extension 102 to the finger 44 so that it does not move during clamping of a workpiece and while the workpiece is clamped, the top of each extension 102 has a threaded bore 106 in communication with the hollow 104 to receive a screw 108 that preferably is a set screw. To secure an extension 102 to a clamp finger 44, the set screw 108 is threaded into the bore 106 in the extension 102 until one end of the screw 108 firmly engages the clamp finger 44. As is depicted more clearly in FIGS. 7A & 7B, to more securely attach the extension 102 to the finger 44, the dog end of each screw 108 can preferably be received in a groove 109 in the clamp finger 44.

To prevent pivoting or other undesirable movement of each extension 102 during the clamping of a workpiece and while the workpiece is clamped, the extension 102 can be constructed with an outwardly extending flange 110 that can bear or ride against the top or bottom wall of the clamp housing 78. If desired, the flange 110 can be guided by a wall of the housing 78 to help ensure accurate location of the extension 102 relative to the housing 78 when clamping a workpiece. Additionally, the flange 110 can be constructed and arranged so it bears against the wall of the housing 78 to prevent pivoting or other undesirable movement of the extension 102 during clamping and during machining of a clamped workpiece.

If desired, a resilient damping pad 112 can be disposed between the flange 110 and the wall of the clamp housing 78 to minimize and preferably prevent vibration of a clamped workpiece during machining. Preferably, such a damping pad 112 is carried by or attached to the flange 110. Alternatively, the pad 112 can be directly attached to the clamp finger extension 102 or to the clamp housing wall.

Figure 7B:
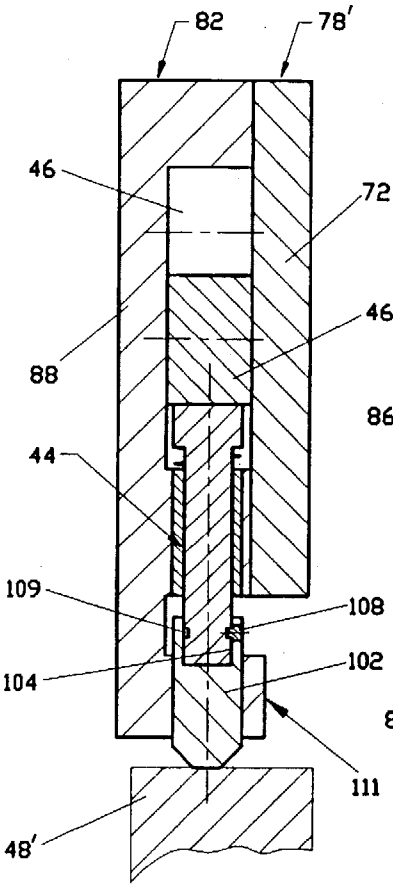
FIG. 7B is a cross sectional view of the clamp taken along line 7B—7B of FIG. 7A depicting an extension attached to a clamp finger being axially supported by a guide carried by the clamp housing.

Preferably, as is shown in FIGS. 7A & 7B, each clamp finger extension 102 can also be axially supported and guided by an extension guide 111 carried by the clamp housing 78' to prevent each extension 102 from pivoting during clamping of a workpiece 48. The extension guide 111 has a bore for each extension 102, with each bore having a cross section that is preferably complementary to the cross section of the extension 102 to better support and guide the extension 102. Although the extension guide 111 is shown integral with the clamp housing 78', it preferably also can be of modular construction so it can be removed from the housing 78' or 78 when extensions 102 are not required. During clamping, the guide 111 preferably allows each extension 102 to reciprocate along a longitudinal axis of the extension 102 while preventing pivoting of each extension 102 relative to the clamp finger 44 that the extension 102 is attached thereto.

When a workpiece 48' to be clamped has an unevenly contoured surface 49 such as the workpiece shown in FIG. 7A, an extension 102, of an appropriate length to ensure engagement with the workpiece 48', is preferably selected and attached to the appropriate finger 44 such that it will bear against the clamping surface 49 when clamping is performed. For example, as is shown in FIG. 7A, the finger 44 located at $B_O$ requires a longer extension than the adjacent fingers 44 at positions $A_O$ & $C_O$ to ensure that there is engagement with the contoured surface of the workpiece to securely hold the workpiece when clamping is completed.

To ensure that extensions 102 can be used to hold a variety of workpieces each having an uneven clamping surface, preferably a "kit" that consists of a plurality of extensions 102 can be used by an operator of the machine tool to select extensions 102 of the appropriate length that match the contour of the clamping surface of a particular workpiece or a number of similar unevenly contoured workpieces that are to be machined. To select the appropriate length extensions 102 for a particular workpiece, the operator must measure or determine the distance from the end of each clamp finger 44 to a particular point on the clamping surface 49 of the workpiece 48'.

To measure or determine this distance, a working drawing of the workpiece specifying the nominal dimensions can be used. Alternatively, the workpiece can be received in the clamp and the actual distance between the clamp fingers 44 and clamping surface 49 of the workpiece 48' measured. Preferably, there are extensions in such a "kit" that each vary from other extensions by a nominal length that preferably is related to or proportional to the maximum tolerance compensating capability of the clamp 42 the extensions are being attached to.

Preferably, such a "kit" of extensions 102 is a plurality of extensions of various assorted lengths. Preferably, there can be several sets of extensions, with each set of extensions having a length that differs from another set of extensions by a predetermined value or a multiple of a predetermined value. For example, a "kit" of extensions can have sets of extensions, each set of which differs in length by 1/32 of an inch or in multiples of 1/32 of an inch, such as 1/32, 1/16, 3/32, etc., to enable an operator of a machine tool to select the appropriate extensions 102 from the "kit" to enable the clamp 42 to clamp workpieces of a wide variety of shapes and contours.

Preferably, each set of extensions 102 can be constructed so that the difference in length, l, of each set of extensions 102 is related to or proportional to the maximum amount of tolerance compensation, m, that the clamp 42 can provide. For example, if a clamp 42 has a maximum tolerance compensation capability, m, of seventy-five thousandths of an inch, the extension sets preferably can be constructed such that they increase in length, l, from other sets of extensions by increments of seventy-five thousandths of an inch. As such, for example, the extension sets can be constructed so that each set increases in increments of length, l, of m/2, m/3, m/4 or another divisor or formula related to the maximum tolerance compensating capability, m, of a clamp 42 of this invention when used with extensions 102.

Preferably extensions 102 and/or a "kit" of extensions 102 can also be used with a clamp 42 of this invention to simultaneously clamp two or more workpieces, with each workpiece being of a different size, to enable multiple workpieces of different sizes to be clamped at the same time.

B. Clamp Housing

Figure 8:
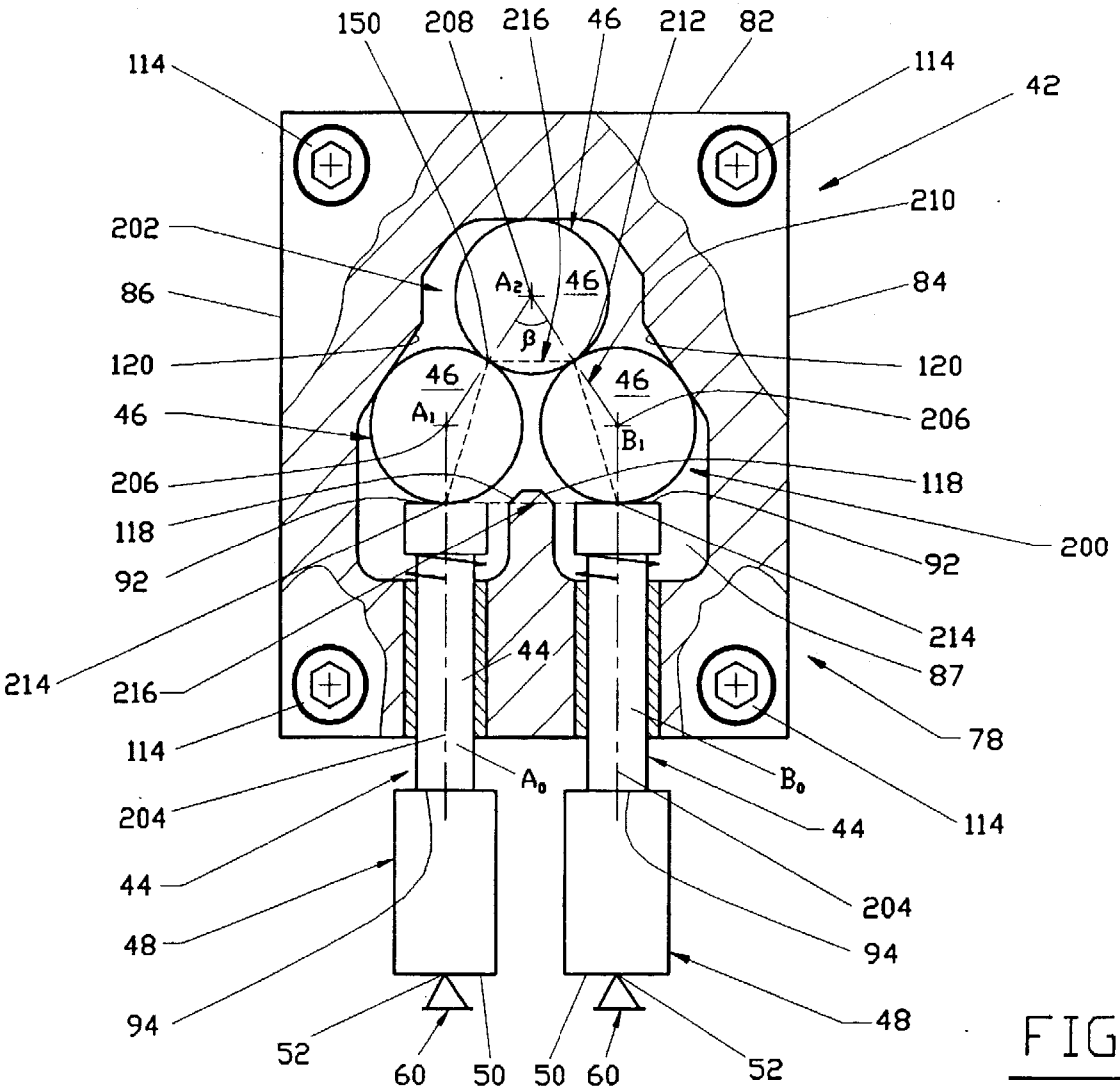
FIG. 8 is a top view of a clamp having a pair of clamp fingers with a portion of its housing cutaway to show the internal construction and arrangement of load transferring elements within the clamp housing and the cooperation of the elements with the clamp fingers.
Figure 9:
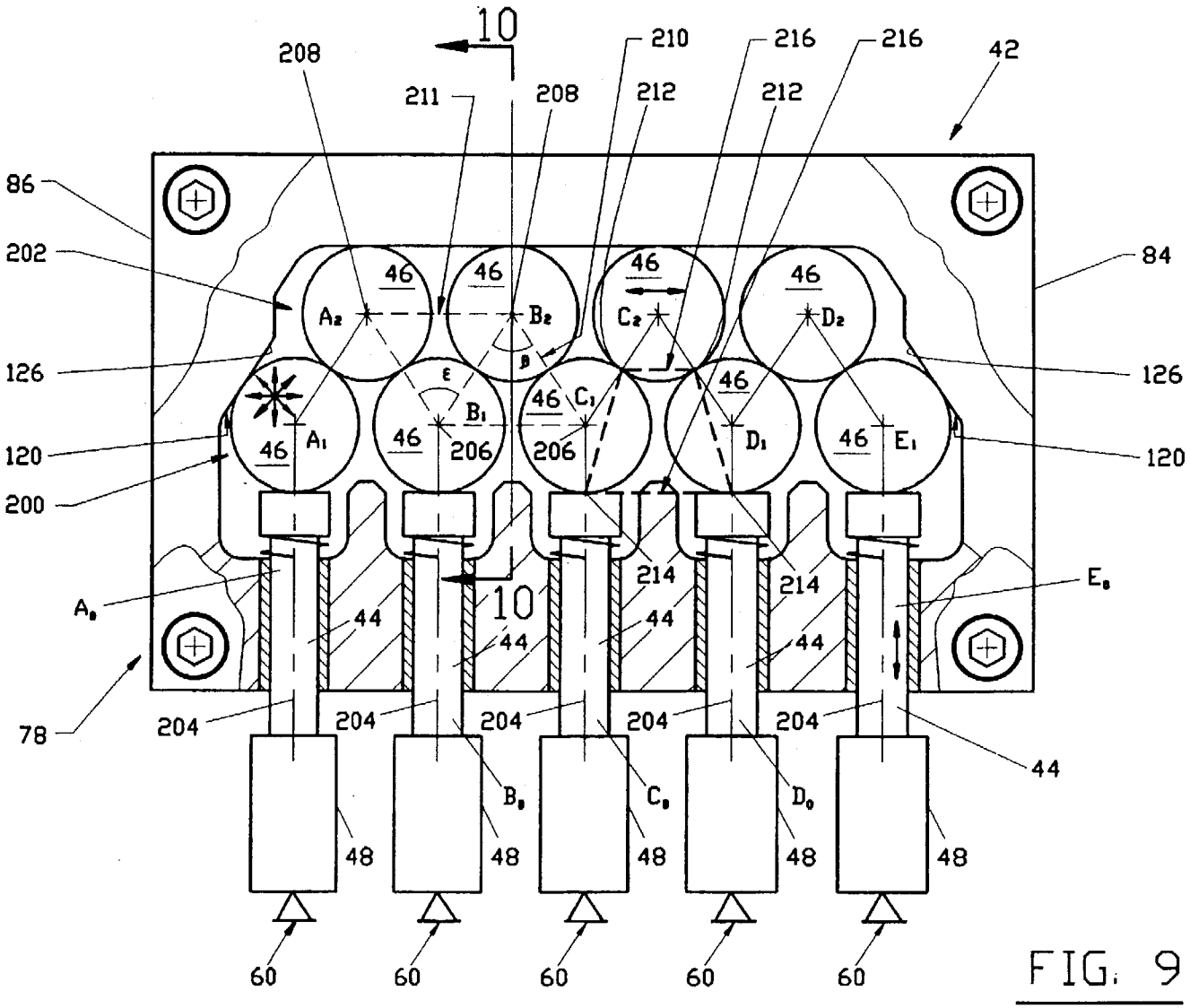
FIG. 9 is a top view of a clamp having more than two clamp fingers simultaneously clamping more than two workpieces with a portion of its clamp housing cutaway to show the construction and arrangement of load transfer elements within the housing and the cooperation of the elements with the clamp fingers during simultaneous clamping of multiple workpieces.

Referring additionally to FIGS. 8 & 9, the clamp housing 78 has a front wall 80, a rear wall 82, and a pair of spaced apart sidewalls 84 & 86 defining a housing cavity 87 for receiving the load transfer elements 46 inside the cavity 87. The bottom 72 of the housing 78 depicted in FIG. 2 has a removable cover 72 attached by four screws 114, such as cap screws, to the clamp housing 78. The distance between the interior surfaces of the top 88 and bottom 72 of the housing 78, defining the depth of the housing cavity 87, is greater than the height of a load transfer element 46. Preferably, the distance between the interior surfaces of the top 88 and bottom 72 of the housing 78 is only slightly greater than the height of the load transfer elements 46 within the cavity 87 for constraining the load transfer elements 46 during clamping of a workpiece and while the workpiece is clamped to help maintain stability of the load transfer elements 46.

If desired, the bottom 72 can have a downwardly extending bracket (not shown) with a bore that can be threaded to receive the vise screw 64 to enable the clamp 42 to be moved back and forth along the guideways 70 of the vise 40 during clamping and releasing of one or more workpieces. Alternatively, the clamp 42 may be carried by or received in a fixture (not shown) that cooperates with the vise screw 64 to enable the clamp 42 to be reciprocated toward and away from the fixed jaw 60 during vise operation.

To prevent each load transfer element 46 inside the cavity 87 from being displaced between a pair of clamp fingers 44, the front wall 80 of the clamp housing 78 has an inwardly projecting dividing wall 116 between each pair clamp finger bores 90. Preferably, each divider 116 extends far enough inwardly into the housing cavity 87 to help maintain the location of each load transfer element 46, at least in the first row 200, relative to every other load transfer element 46 during clamp operation by preventing any load transfer element 46 adjacent a divider 116 from being displaced into any region adjacent the clamp housing front wall 80 between clamp fingers 44. As is shown more clearly in FIG. 10, each inwardly projecting divider 116 can preferably be constructed with an angled face 118 that generally faces an adjacent load transfer element 46 for bearing against that adjacent load transfer element 46, should it become slightly displaced toward the divider 116 during clamp operation.

1. Housing With Load Transfer Element Engaging Surface

Figure 10:
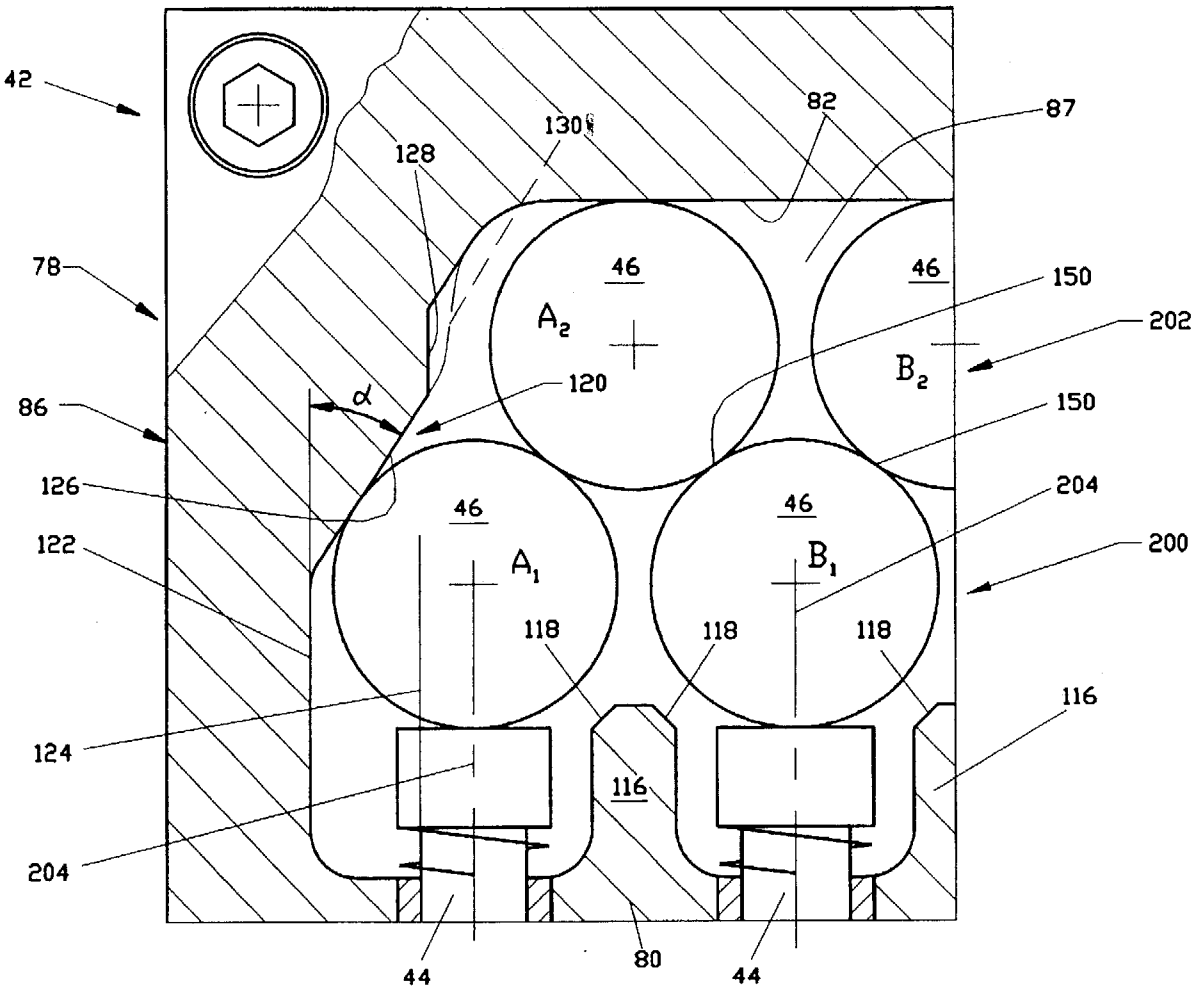
FIG. 10 is an enlarged fragmentary top view of the clamp taken along line 10—10 of FIG. 9 with a portion of the clamp housing cutaway illustrating one preferred clamp housing sidewall construction for encouraging stability of clamp operation.

In a preferred embodiment of the clamp housing 78 shown in FIGS. 8–10, to guide a load transfer element 46 during clamping while helping to maintain the stability of load transfer elements 46 during clamping and while a workpiece is clamped, one and preferably both clamp housing sidewalls 84 & 86 have an interior load transfer element engaging surface 120 that extends inwardly into the housing cavity 87 and which is preferably in contact with a load transfer element 46 adjacent the clamp housing sidewall. Preferably, the load transfer element engaging surface 120 is an inwardly inclined surface 126, such as is depicted more clearly in FIGS. 8–10, but also can be an abutment or a projection that extends inwardly into the clamp housing cavity 87 for engaging an adjacent (outer) load transfer element 46 of the first row 200 (i.e. load transfer element $A_1$) during clamping of a workpiece to help guide and restrain that load transfer element 46.

Although only one clamp housing sidewall 86 is depicted in FIG. 10, one sidewall 84 or 86, or both sidewalls 84 & 86 (FIG. 9), of this preferred clamp housing construction preferably can be constructed with (a) a first sidewall portion 122 that is generally parallel to an axis 124 of one of the clamp fingers 44 substantially parallel to the direction of motion that the clamp finger 44 follows during the clamping and releasing of a workpiece, and (b) a second sidewall portion 126 that is acutely inclined relative to the first sidewall portion 122 and clamp finger axis 124 for providing a guide surface 120 against which a load transfer element 46 bears (outer load transfer element $A_1$ or $E_1$ of the clamp shown in FIGS. 9 & 10) to help guide or restrain the movement of one or more of the load transfer elements 46 during clamping of a workpiece and while the workpiece is clamped.

Preferably, each load transfer element engaging surface 120 is capable of guiding the movement of an adjacent load transfer element 46 during clamping while also supporting and restraining one or more of the load transfer elements 46 during and after a workpiece has been clamped to help maintain stability of preferably all of the load transfer elements 46. Preferably, the inwardly inclined guide surface 120 helps maintain stability of the clamp assembly 42 by preventing the load transfer elements 46 adjacent each outer clamp finger 44 from moving too far outwardly towards the clamp housing sidewall 84 and/or 86, binding or locking, and becoming immovable, thereby locking an exterior clamp finger 44 in place and preventing it from being able to adequately move in a manner necessary for it to enable the clamp fingers 44 to adjust to tolerance differences between workpieces being clamped. The inclined sidewall portion 120 also preferably helps maintain stability of the load transfer elements 46 by constraining outward movement of both the outer element 46 (element $A_1$) in the row of elements immediately behind the clamp fingers 44 (first element row 200) and the outer element 46 ($A_2$) in the row of elements that bear against the rear wall 82 of the clamp housing 78 (second element row 202). Although the second sidewall portion 126 can have a stepped transition 128 with the rear wall 82, such as is more clearly depicted in FIG. 10, it can also be constructed having a smooth transition portion 130 (in phantom) with the rear wall 82.

The second sidewall portion 126 preferably forms an acute included angle, α, with the first sidewall portion 122 for guiding an outer load transfer element 46 while helping to maintain stability of the rest of the load transfer elements 46. Preferably, the second sidewall portion 126 is constructed and arranged to be angled relative to the clamp finger axis 124 at an angle of at least about 5°. Preferably, in one preferred construction of a clamp 42 of this invention, the second sidewall portion 126 can be angled relative to the clamp finger axis 124 at an angle falling within the range of between about 20° and 60°. Since the first sidewall portion 122 preferably is also parallel with axis 124, the second sidewall portion 126 forms an acute included angle, α, with the first sidewall portion 122 such that α can fall within the range between about 20° and 60°. Preferably, the second sidewall portion 126 of this clamp construction can be constructed and arranged so it forms an acute included angle, α, with the first sidewall portion 122 that can be between about 30° and 40°, and, for example, α can preferably be between about 33° to about 36° for the clamp construction shown in FIGS. 9 & 10.

Some routine testing and experimentation may be done to determine an optimal guide sidewall angle, α, for a given clamp construction. For example, routine testing and experimentation may be done to determine an optimal guide sidewall angle, α, for load transfer elements 46 of different shapes, sizes, and configurations, as well as for clamps of this invention having a varying number of clamp fingers 44 and different distances between fingers 44. Additionally, a may be dependent upon clamping forces or other clamp design criteria and may, therefore, vary from clamp construction to clamp construction.

2. Second Preferred Housing Embodiment

Figure 18:
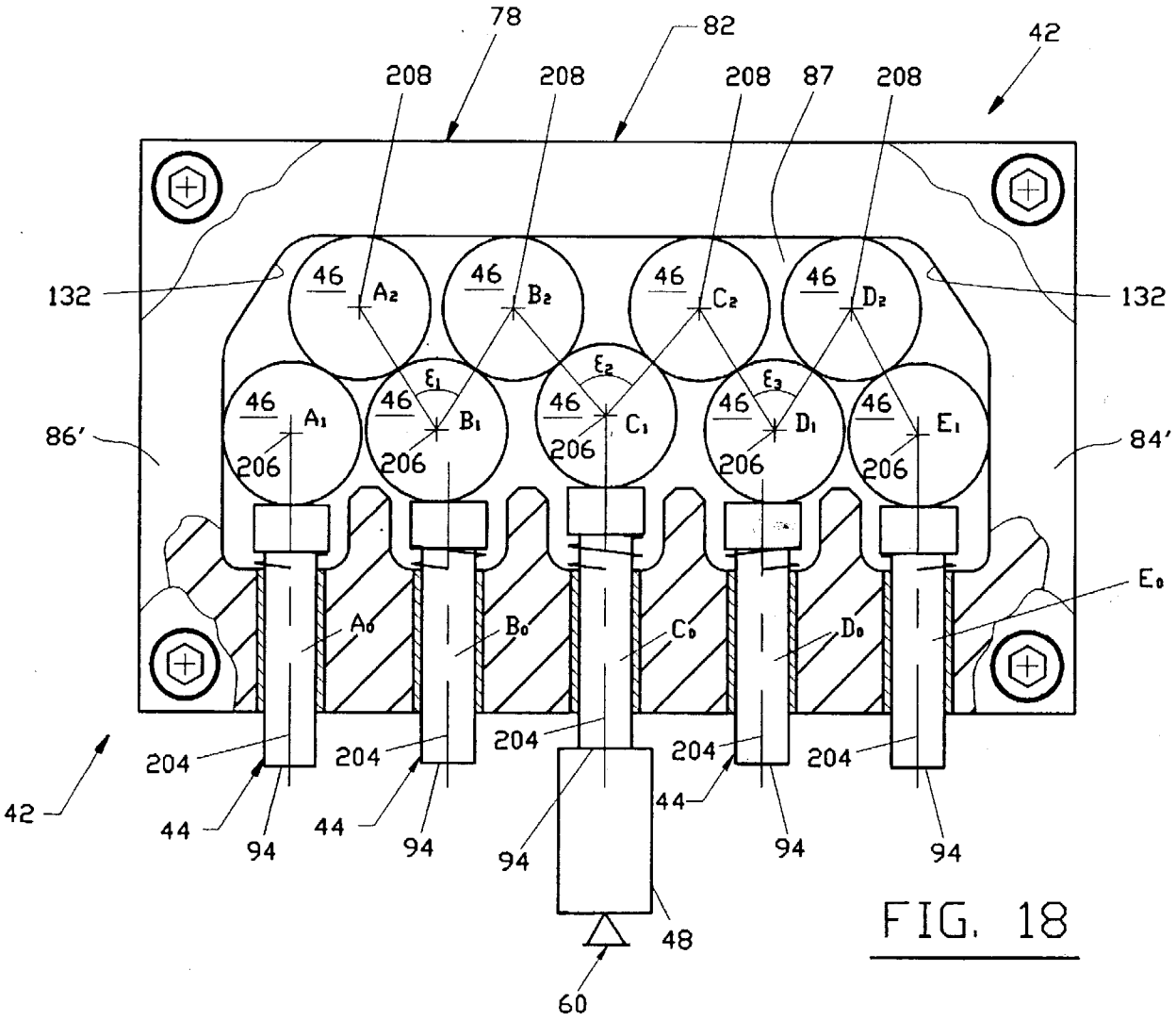
FIG. 18 is a top view of a clamp having more than two clamp fingers with only one finger securely holding a single workpiece with the clamp also having a portion of its housing cutaway illustrating a second preferred clamp housing sidewall construction.

In a second preferred clamp housing embodiment shown in FIG. 18, the clamp housing 78 has a sidewall 84' or 86' without an inwardly inclined portion in contact with a load transfer element 46. If desired, a clamp housing 78 of this construction can be made with an inclined sidewall portion 132 that is not in contact with a load transfer element 46, such as is depicted in FIG. 18. The clamp housing 78 can also be constructed with sidewalls that are not inwardly inclined whatsoever, thereby lacking any inclined sidewall portion in contact with a load transfer element 46.

3. Clamp Housing Construction

The clamp housing 78 is preferably constructed of a strong and resilient material such as steel, aluminum, an aluminum alloy, titanium, a titanium alloy, magnesium, a magnesium alloy, or another suitable metal or metal alloy. Preferably, the housing 78 is constructed of steel, such as a high strength low alloy steel or another suitable type of steel. Alternatively, for some clamp applications, the clamp housing 78 could be constructed of a composite material, such as a reinforced carbon or glass fiber composite, a nylon, an aramid or aramid fibrous composite, a suitable plastic or polymeric material, a urethane, a type of plastic, or another type of suitable synthetic material. If constructed of a metal, the housing 78 can preferably be cast and thereafter machined to produce any surfaces within the housing 78 which must be machined and/or held to relatively strict tolerances. If constructed of steel or another metal, interior surfaces of the housing 78 that come into contact with load transfer elements 46 are also preferably hardened.

To minimize wear and facilitate smooth movement of load transfer elements 46 within the housing cavity 87, the interior surfaces of one, several, or all of the walls of the housing 78 can be lubricated. For example, a petroleum lubricant, such as a light oil, can be deposited within the housing cavity 87 so that each load transfer element 46 rides upon a thin film of oil during use and operation of the clamp 42. If desired, some or all of the interior surfaces can be impregnated with a lubricant, such as molybdenum or TEFLON, to minimize friction and wear of the load transfer elements 46 and the clamp housing 78. Alternatively, surfaces within the housing cavity 87 could also be coated with a coating or layer of a friction reducing material, such as a coating or tape containing TEFLON or another lubricant.

C. Load Transfer Elements

As is shown in FIG. 1, there are at least three and, where a clamp 42 of this invention has more than two clamp fingers 44, a plurality of load transfer elements 46 received inside the clamp housing cavity 87. The load transfer elements 46 are constructed and arranged within the housing cavity 87 to receive the force from each clamp finger 44 that a finger 44 receives during the clamping of one or more workpieces while allowing each element 46 to move as is needed within the cavity during clamping to compensate for tolerance variations between workpieces or to conform to the contour of a single workpiece. When clamping is completed, the load transfer elements 46 are in engagement with each other and preferably cannot move any further for transmitting clamping force from the workpiece through the clamp housing 78 to the jaw 62 carrying the clamp 42, and to the vise 40.

1. Construction

As is shown more clearly in FIGS. 11–15B, each load transfer element 46 preferably has a circular cross section along at least one direction of the element 46. Preferably, each load transfer element 46 is constructed of a durable and strong material that is preferably also wear resistant, such as preferably a steel, aluminum, an aluminum alloy, titanium, a titanium alloy, magnesium, a magnesium alloy, a tool steel, a high strength low alloy steel, or another suitable metal or metal alloy. For other applications not requiring the strength of a metal, each element can be constructed of plastic, rubber, or a composite, such as a thermoplastic, a thermoset plastic, a nylon, an epoxy, a urethane, an aramid, a glass filled nylon, a carbon fiber composite or another suitable non-metallic material. If constructed of steel or another metal, the outer surface of each element 46 is preferably hardened or is constructed of a material having good toughness. For example, a suitable load transfer element 46 can be a steel drill bushing having a hardness of sixty-two $R_c$ along its exterior surface. Since each load transfer element 46 is in contact with at least one other element 46 during use and operation of the clamp 42 and relative movement between elements 46 can occur during clamping, each load transfer element 46 can be lubricated or impregnated with a lubricant, such as a petroleum lubricant, graphite, molybdenum, teflon, or another lubricant for minimizing friction.

In FIG. 11, the load transfer element **46*a* is a circular disk 140 having a truncated generally cylindrical construction and a generally circular cross section. The element 46*a* has a top wall 142, a bottom wall 144, and an endless sidewall 146 that is generally perpendicular to either the top wall 142 or the bottom wall 144 for forming a contact line 150 (FIG. 8) with another element 46*a* when it bears against the element 46*a*** during clamping thereby maximizing the surface area of contact between adjacent load transfer elements 46*a* which maximizes the amount of clamping force that can be applied against a workpiece being clamped.

When received in the cavity 87 of a clamp housing 78, the bottom 144 of each load transfer element **46*a* bears against the interior surface of the bottom wall 72 of the housing 78 such that each element 46*a* can move or slide along the bottom 72 of the housing 78 (see, for example, FIGS. 5 & 6). Therefore, during clamping, the elements 46*a* are capable of moving or sliding within the housing 78 relative to each other as is necessary until they achieve a condition of equilibrium within the housing 78 such that when the workpieces are clamped, the elements 46** cannot further move and tolerance differences between workpieces are suitably compensated.

In another embodiment of the disc-shaped load transfer element **46*a* shown in FIG. 11, the load transfer element 46*a*' can have an opening 148 (in phantom) if it is not necessary to have a load transfer element of completely solid construction. An example of a suitable load transfer element 46*a*' having a hollow or bore 148** therethrough is a washer, a roller bearing, or a drill bushing of generally cylindrical construction.

In FIG. 12, the load transfer element **46*b* is a round ball 152 of spherical construction and which has a generally circular cross section. An example of a suitable load transfer element 46*b* of this construction is a ball bearing. When received in the clamp housing cavity 87, each element 46*b* forms a contact point with the clamp housing bottom and each adjacent element 46*b*** thereby minimizing friction between contacting surfaces.

In FIG. 13, the load transfer element **46*c* is a puck 154 having a round ball 156 received in a disc-shaped washer 158. When received in the clamp housing cavity 87, the ball 156 preferably makes point contact with the clamp housing bottom 72 while the washer 158 makes line contact with another load transfer element 46*c* when it contacts an adjacent element 46*c***.

In FIG. 14, the load transfer element **46*d* is generally disc-shaped having a generally spherical sidewall 160 that is truncated on its top and bottom to form a flat top wall 162 and a flat bottom wall 164. When received in the clamp housing cavity 87, the load transfer element 46*d* preferably makes point contact with another load transfer element 46*d* when it contacts an adjacent element 46*d***.

In FIGS. 15A & 15B, the load transfer elements depicted comprise a pair of complementary load transfer elements **46*f* & 46*g* that are interlocked with each other to provide enhanced stability during the clamping of a workpiece and while the workpiece is clamped. As is shown in FIGS. 15A & 15B, one of the load transfer elements 46*f* has a concave sidewall 166, an interlock ridge 168 along its top 170, and an interlock ridge 172 along its bottom 174. The other of the elements 46*g* has a convex sidewall 176 that is preferably in shape with the concave sidewall 166 of element 46*f* so that the two elements 46*f* & 46*g* fit together, at least somewhat loosely. To provide an interlock between the load transfer elements 46*f* & 46*g* that permits some relative movement between the elements 46*f* & 46*g* while promoting clamp stability, element 46*g* has (1) a recessed interlock channel 178 along its top that is complementary with the interlock ridge 168 along the top 170 of element 46*f*, and (2) a recessed interlock channel 182 along its bottom 184 that is complementary with the interlock ridge 172 along the bottom 174 of element 46*f***.

Figure 16:
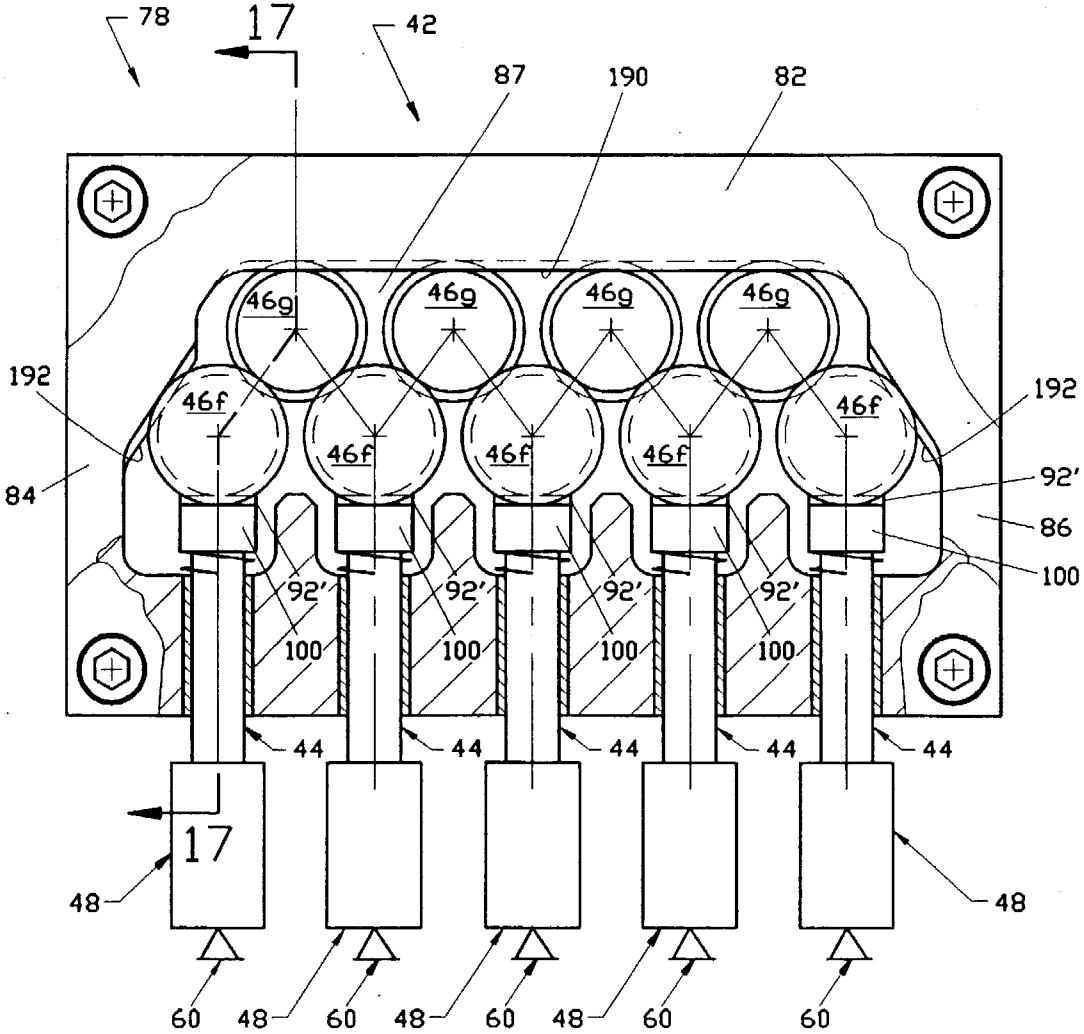
FIG. 16 is a top view of a clamp with a portion of its housing cutaway to show interlocking load transfer elements received in a housing of complementary interlocking construction and cooperating with clamp fingers of complementary interlocking construction for helping to encourage load transfer element stability during clamp operation.
Figure 17:
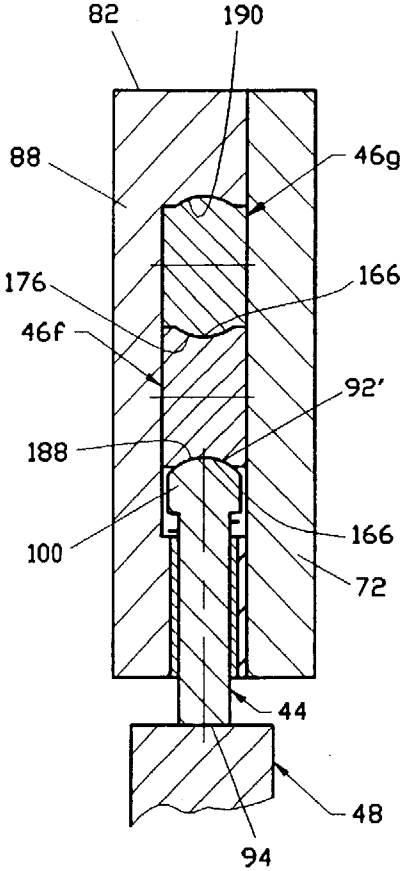
FIG. 17 is a side sectional view of the clamp shown in FIG. 16 taken along line 17—17 of FIG. 16.

Referring additionally to FIGS. 16 & 17, if interlocking pairs of elements **46*f* & 46*g* are used, the load transfer element engaging surface 92' of each clamp finger 44 can be of a configuration that is preferably complementary to the sidewall shape of the load transfer element it contacts during use and operation of the clamp 42. As is shown in FIG. 17, the load transfer element engaging surface 92' of each clamp finger 44 preferably has a convex surface 188 for engaging with the concave sidewall 166 of the adjacent load transfer element 46*f* to interlock with that element 46*f* while allowing some relative movement therebetween. Additionally, the rear wall 82 and sidewalls 84 & 86 of the clamp housing 78 can be constructed with an interior load transfer element engaging surface 190 & 192** that is complementary in shape with the adjacent load transfer element sidewall to further enhance the interlocking and stability of the entire assembly of load transfer elements.

Alternatively, the order of the load transfer elements **46*f* & 46*g* can be switched so that load transfer elements 46*g* make up the first row of load transfer elements immediately behind the clamp fingers 44 and load transfer elements 46*f* make up the row of elements immediately adjacent the rear wall 82 of the clamp housing 78. If the order of the load transfer elements 46*f* & 46*g* are reversed, the contour of the load transfer element engaging surfaces 92', 190 & 192 of the clamp fingers 44 and housing walls 82, 84 & 86 is preferably of a shape that is complementary to the sidewalls of the load transfer elements 46*f* & 46*g***.

When all of the load transfer elements **46*f* & 46*g* are assembled within the clamp housing 78, such as in the manner depicted in FIG. 16, adjacent contacting elements preferably interlock with each other to increase the stability of the entire assembly during use and operation while allowing each pair of contacting elements 46*f* & 46*g* to move relative to each other to compensate for contour variations or tolerance differences between workpieces. Preferably, stability of the assembly is increased by preventing any of the load transfer elements 46*a*** from deviating from the plane they are in and/or becoming completely disengaged from each other during clamping of a workpiece and while the workpiece is clamped.

2. Arrangement a. Two Clamp Fingers

Referring to FIG. 8, the clamp 42 has a pair of spaced apart clamp fingers 44 carried by the clamp housing 78 with a load transfer element 46 behind each finger 44 forming a first row 200 of load transfer elements and a single load transfer element 46 behind the first row of elements 200 forming a second row 202 of load transfer elements. Although a clamp 42 of this invention can be constructed such that each element 46 in both rows 200 & 202 are of substantially the same size, the load transfer elements 46 of the first row 200 can be larger or smaller in diameter than the load transfer elements 46 of the second row 202.

As is depicted in FIG. 8, a clamp 42 of this invention preferably has a load transfer element 46 in the first row 200 directly behind each clamp finger 44. Preferably, there is one less load transfer element 46 in the second row 202 than the number of load transfer elements 46 in the first row 200.

For the clamp construction 42 shown in FIG. 8, the clamp 42 has the same number of load transfer elements 46 in the first row 200 as the number of clamp fingers 44. In the second row 202, there is one less load transfer element 46 than the number of clamp fingers 44. Also, for the clamp construction shown in FIG. 8, there is one less element 46 in the second row 202 as the number of elements 46 in the first row 200. Therefore, as is shown in FIG. 8, there are two elements 46 in the first row 200 and only a single element 46 in the second row 202 because the clamp 42 depicted in FIG. 8 has only two clamp fingers 44.

As 42, is depicted in FIG. 8, each element 46 in the first row 200 is positioned behind a clamp finger 44 and is preferably positioned directly behind a clamp finger 44 such that a central longitudinal axis 204 of the clamp finger 44 passes through at least a portion of that element 46 that is behind the finger 44. The clamp 42 shown in FIG. 8 has the central longitudinal axis 204 of each clamp finger 44 passing through a center point 206 of its immediately closest element 46 in the first row 200. Although this generally can be true when each workpiece 48 has exactly the same length from the clamp finger workpiece engaging surface 94 to the fixed jaw 60 of the vise 40 as every other workpiece 48 simultaneously being clamped, the center 206 of an element 46 in the first row 200 may shift away from the axis 204 of its adjacent clamp finger 44 when clamping a pair of workpieces of different lengths or having a tolerance difference between them.

As is also shown in FIG. 8, there preferably is a load transfer element 46 in the second row 202 that has a center point 208 between each pair of adjacent clamp fingers 44 and which engages the load transfer elements 46 in the first row 200 that are in contact with the pair of clamp fingers 44. The center point 208 lies preferably between the central axis 204 of both clamp fingers 44. When a workpiece clamped by one of the clamp fingers 44 is longer than a workpiece clamped by the other of the fingers 44, the load transfer elements will cooperate with each other within the clamp housing 78 such that the center point 208 of the load transfer element 46 of the second row 202 will shift toward the central axis 204 of the clamp finger 44 that is engaging the shortest workpiece.

As is also illustrated by the clamp 42 shown in FIG. 8, the center point 208 of the load transfer element 46 of the second row 202 preferably forms a triangle 210 with the center points 206 of the load transfer elements 46 of the first row 200 that are in contact with that load transfer element 46 of the second row 202. Preferably, the contact point 212 of the load transfer element 46 of the second row 202 with each of the load transfer elements 46 of the first row 200 and the contact point 214 of each load transfer element 46 of the first row 200 with its clamp finger 44 define a four sided polygon 216.

For the clamp construction 42 shown in FIG. 8, the legs of the triangle 210 that extend from the center point 208 of the load transfer element 46 of the second row 202 to the center point 206 of each of the load transfer elements 46 of the first row 200 define an acute angle, β, that preferably can be at least 45°, depending upon the size of the load transfer elements 46, the spacing between clamp fingers 44, as well as the amount of the tolerance difference between multiple workpieces being simultaneously clamped. For the clamping arrangement shown in FIG. 8, with the clamp 42 securely holding two workpieces of exactly the same size and having no tolerance differences between them, β is preferably between about 60° and about 70° and can vary during clamp operation.

Angle, β, will vary depending upon the amount of the tolerance difference between workpieces clamped as well as the spacing between clamp fingers. Additionally, β can vary also vary if the size of the load transfer elements 46 of the first row 200 differs from the size of the load transfer elements 46 of the second row 202.

During clamping, each element 46 in the first row 200 that is behind a clamp finger 44 that is in contact with a workpiece 48 preferably can move in any direction as is needed, as is indicated by a unidirectional directional arrow indicator 201 on load transfer element 46 at position Al shown in FIG. 6. Each element 46 in the second row 202 preferably can only move side to side as is indicated by a lateral directional arrow indicator 203 on load transfer element 46 at position $B_2$ shown in FIG. 6.

Figure 21:
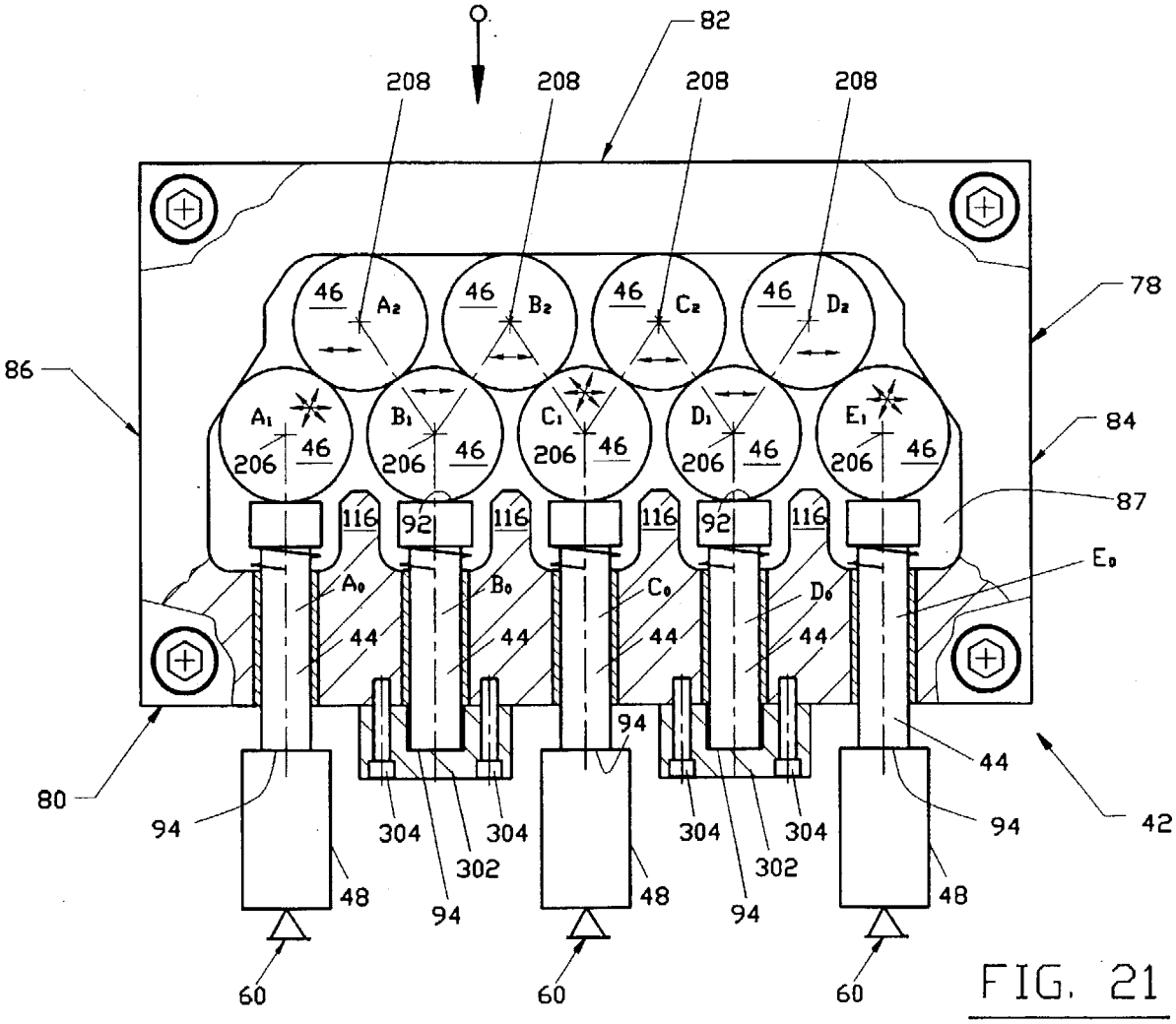
FIG. 21 is a top view of a clamp securely holding three workpieces with a plate constraining outward movement of those clamp fingers not engaging a workpiece.
Figure 33:
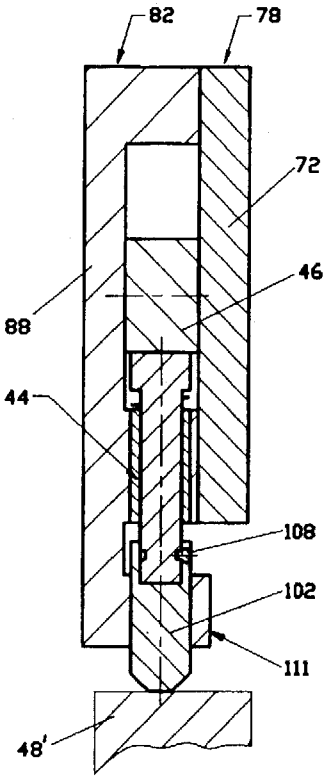
FIG. 33 is a cross sectional view of the clamp taken along line 33—33 of FIG. 32.
Figure 34:
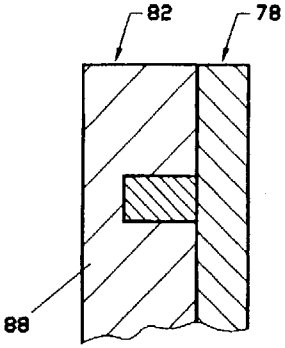
FIG. 34 is a fragmentary cross sectional view of the clamp taken along line 34—34 of FIG. 32 showing details of construction of a load communicating used to space apart adjacent clamp fingers.

For elements 46 in the first row 200 that are behind a clamp finger 44 that is restrained, such as is depicted in FIG. 21, those elements 46 (at positions $B_1$ and $D_1$ in FIG. 21) can move only laterally across the load transfer element engaging surface 92 of each restrained finger 44. For elements 46 in the first row 200 that are not behind any clamp finger 44, such as those elements 46 in positions $B_1$ & $C_1$ depicted in FIG. 33, those elements 46 can only move laterally substantially in the direction indicated by position indicator 203.

It is noted that an element 46 in the first row 200 of a clamp 42 that can theoretically move in any direction may be limited in its direction of actual movement by one or more factors, such as for example, a sidewall of the clamp housing 78, the magnitude or direction of applied clamping force, or the size, workpiece contour, or the tolerance differences between more than one simultaneously clamped workpiece. Other factors may also influence or limit first row element movement.

b. More Than Two Clamp Fingers

Although the clamps 42 shown in FIGS. 1–7, 9 & 10 and 16–24 have more than two clamp fingers 44, they preferably are also constructed in a manner very similar to and preferably virtually identical to the clamp of FIG. 8, having the same number of elements 46 in the first row 200 as the number of clamp fingers 44 and one less element 46 in the second row 202 as the number of clamp fingers 44. These clamps 42 also have one less element 46 in the second row 202 as the number of elements 46 in the first row 200.

FIG. 9 illustrates a clamp 42 of this invention having more than two clamp fingers 44 clamping more than one workpiece at the same time. As is depicted in FIG. 9, the clamp 42 has five clamp fingers 44 for clamping as many as five workpieces or for applying force along five contact points to hold a single workpiece that can have a contoured clamping surface (FIG. 7).

In the first row 200, the clamp 42 has as many load transfer elements 46 as there are clamp fingers 44 with each load transfer element 46 in the first row 200 in contact with a clamp finger 44 when that clamp finger 44 is holding a workpiece. Preferably, each load transfer element 46 of the first row 200 is behind an adjacent clamp finger 44. Preferably, a central axis 204 of each clamp finger 44 cuts across at least a portion of an adjacent load transfer element 46.

When several workpieces of the same length are clamped at the same time, such as is depicted in FIG. 9, load transfer elements 46 of the first row 200 in contact with the clamp fingers 44 that lie inside the outer clamp fingers 44 also contact at least two other load transfer elements 46 of the second row 202. The load transfer elements 46 of the first row 200 that are in contact with the outside clamp fingers 44 contact at least one element 46 of the second row 202.

In the second row 202, the clamp 42 has one less load transfer element 46 than there are clamp fingers 44. While one or more workpieces are clamped, each element 46 of the second row 202 is preferably in contact with one other element 46. While clamped, each element 46 of the second row 202 is preferably in contact with an element 46 of the first row 200.

Although the clamp 42 shown in FIG. 9 has five clamp fingers 44, the clamp 42 can be constructed with a lesser or greater number of clamp fingers 44. For example, a clamp 42 of this invention can be constructed with three, four, seven, eight, nine, ten, fifteen, twenty, or even more clamp fingers 44, if desired. As such, if a clamp 42 is constructed with ten clamp fingers 44, it preferably has ten load transfer elements 46 in its first row 200, and nine load transfer elements 46 in its second row 202. For example, if a clamp 42 is constructed with fifteen clamp fingers 44, it preferably has fifteen elements 46 in its first row 200, and fourteen elements 46 in its second row 202. And for a clamp 42 constructed with twenty clamp fingers 44, the clamp 42 preferably has twenty elements 46 in its first row 200 and nineteen elements 46 in its second row 202.

As such, a clamp 42 of the preferred embodiment shown in FIGS. 1–7, 9 & 10 and 16–24, preferably has as many load transfer elements 46 in the first row 200 as there are clamp fingers 44. Additionally, a clamp 42 of this preferred embodiment preferably has one less load transfer element 46 in the second row 202 than the number of clamp fingers 44 of the clamp 42. Therefore, as is depicted in FIG. 9, there are five clamp fingers 44, five load transfer elements 46 in the first row 200, and four load transfer elements 46 in the second row 202.

The triangle relationship 210 and polygon relationship 216 of the load transfer elements 46 and contact points for the clamp with the single pair of clamp fingers 44 shown in FIG. 8 also holds true for the load transfer elements 46 cooperating with each pair of fingers 44 for clamps having more than two clamp fingers 44, as is depicted by the representative clamp 42 shown in FIG. 9. As such, a clamp 42 of this preferred embodiment has a contact point 214 between each clamp finger 44 and a load transfer element 46 of the first row 200, and a contact point 212 between each load transfer element 46 of the first row 200 and an adjacent load transfer element 46 of the second row 202 with the contact points 212 & 214 between the clamp fingers 44 and load transfer elements 46 constructed and arranged such that the contact points 214 between clamp fingers 44 and adjacent load transfer elements 46 of the first row 200 and contact points 212 of adjacent load transfer elements 46 of the first row 200 and the common load transfer element 46 of the second row 202 form a four sided polygon 216.

As is depicted in FIG. 9, for each pair of clamp fingers 44, the legs of the triangle 210 that extend from the center point 208 of the load transfer element 46 of the second row 202 to the center point 206 of each of the load transfer elements 46 of the first row 200 define an acute angle, $\beta$, that preferably can be at least about 35°, depending upon the size of the load transfer elements 46, the spacing between clamp fingers 44, the amount of the tolerance difference between workpieces being clamped, and perhaps other factors, as well. For the representative preferred clamp embodiment shown in FIG. 9, with the clamp 42 securely holding five workpieces of exactly the same size and having no tolerance differences between them, $\beta$ is between about 60° and about 70° and is about equal for each pair of clamp fingers 44.

Of course, angle, $\beta$, can vary from that discussed above depending upon a number of factors. For example, the amount of the tolerance difference between workpieces clamped as well as the spacing between clamp fingers 44 may also cause $\beta$ to vary. $\beta$ will also vary if the size of the load transfer elements 46 of the first row 200 differs from the size of the load transfer elements 46 of the second row 202.

As is also depicted by the preferred clamp embodiment shown in FIG. 9, another triangle relationship 211 can be defined for the load transfer elements 46 in contact with each clamp finger 44 and which lie inside of the outer clamp fingers 44. For each interior clamp finger 44, such as for fingers 44 located at positions $B_O$, $C_O$, & $D_O$ of the clamp shown in FIG. 9, a triangle 211 can be formed between the center point 206 of the load transfer element 46 in the first row 200 contacting the interior finger 44 and the center points 208 of the two load transfer elements 46 of the second row 202 contacting that first row element, with a preferably acute angle, $\epsilon$, being formed by two legs of the triangle 211.

As an interior clamp finger 44 ($B_O$, $C_O$ & $D_O$) adjacent the triangles 210 & 211 is displaced into the clamp housing 78 and is displaced inwardly relative to the other of the clamp fingers, $\beta$ for that clamp finger preferably increases, at least slightly. When the clamp 42 reaches equilibrium upon clamping, such as the equilibrium shown in FIG. 9, with all of the fingers 44 of the clamp 42 securely holding workpieces of the same size, having no tolerance differences between them, and all of the load transfer elements 46 within the clamp housing being of the same size, $\epsilon$ and $\beta$ are preferably substantially about equal or within a few degrees of each other. Preferably, $\epsilon$ of any triangle 211 of a clamp 42 does not reach 180° during operation of a clamp of this construction to maintain stability of the clamp 42. Preferably, $\epsilon$ of any triangle 211 of a clamp 42 of this preferred construction does not substantially exceed 120° during normal clamp operation.

IV. Two Clamp Construction

Figure 25:
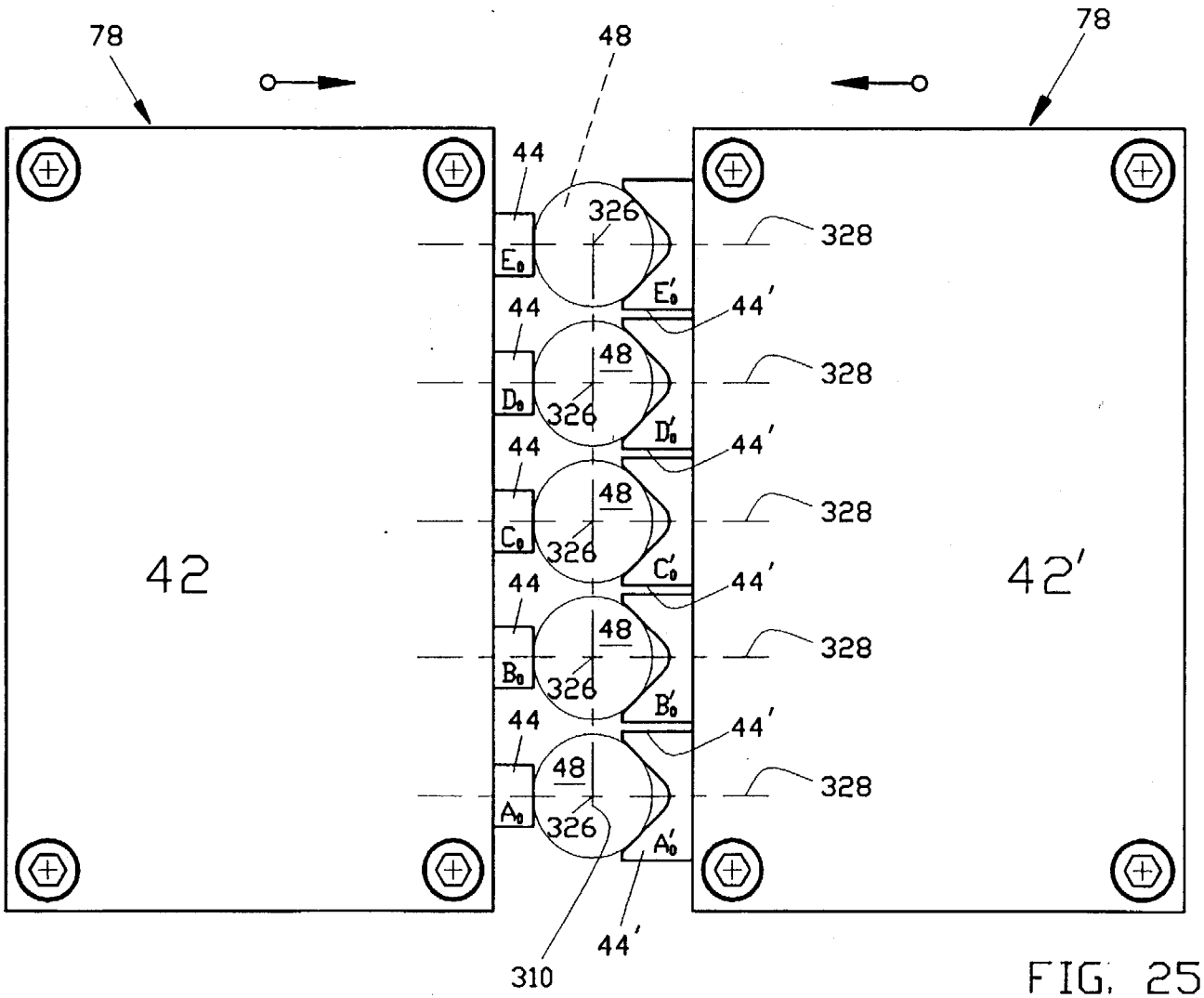
FIG. 25 is a top view of a pair of clamps of this invention depicting a vise having a first clamp carried by one of its jaws and a second clamp carried by the other of its jaws.

FIG. 25 illustrates a pair of clamps 42 & 42' carried by a vise for holding round workpieces 48 between the clamps 42 & 42', while accurately locating each round workpiece 48 about a locator point 326, that preferably can be common to all of the workpieces (such as the center of each workpiece 48), for enabling a machining operation to be accurately located on each workpiece 48. As is shown in FIG. 25, one clamp 42 has five clamp fingers 44 of conventional construction for cooperating with five clamp fingers 44' of a second clamp 42' that are notched for receiving and positioning a round workpiece 48 between each pair of opposing fingers 44 & 44'.

Alternatively, the clamp fingers 44 & 44' of both clamps can both be notched, if desired. During clamping, the load transfer elements within each clamp 42 & 42' cooperate with each other and the clamp fingers 44 & 44' to accommodate tolerance differences between round workpieces 48 while also accurately locating them, preferably about their center point 326.

To accurately locate each round workpiece 48 about a horizontal axis 308 of the workpiece 48, each clamp finger 44' of one of the clamps 42' is notched. Should the workpiece 48 be differently shaped, the end of each clamp finger 44 and/or 44' of one or both of the clamps 42 & 42' can be of a shape other than a notched shape for receiving the workpiece 48 while also locating the workpiece relative to an axis of the workpiece. During clamping, each clamp finger 44 of one clamp 42 cooperates with load transfer elements within that clamp 42 and each clamp finger 44' of the other clamp 42' cooperates with load transfer elements within that clamp 42' to accurately locate each round workpiece 48 about a vertical axis 310 of the workpiece 48 while compensating for tolerance variations, such as out-of-roundness error, in the workpieces 48.

As is shown in FIG. 25, clamp 42 is carried by one of the jaws of the vise and clamp 42' is carried by the other of the jaws of the vise. If desired, both jaws can be movable relative to a base of the vise. Alternatively, the vise can be constructed such that only one of the jaws is movable relative to the other of the jaws or the base of the vise.

V. Modular Clamp Construction

Figure 26B:
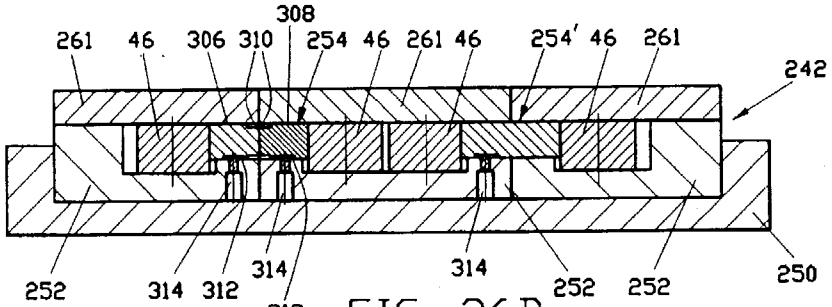
FIG. 26B is a cross sectional view of the clamp assembly taken along line 26B—26B of FIG. 26A depicting load transfer elements of adjacent clamp units in operable communication with load communicating elements for enabling all of the clamp units of the assembly to compensate for tolerance differences between workpieces.
Figure 26A:
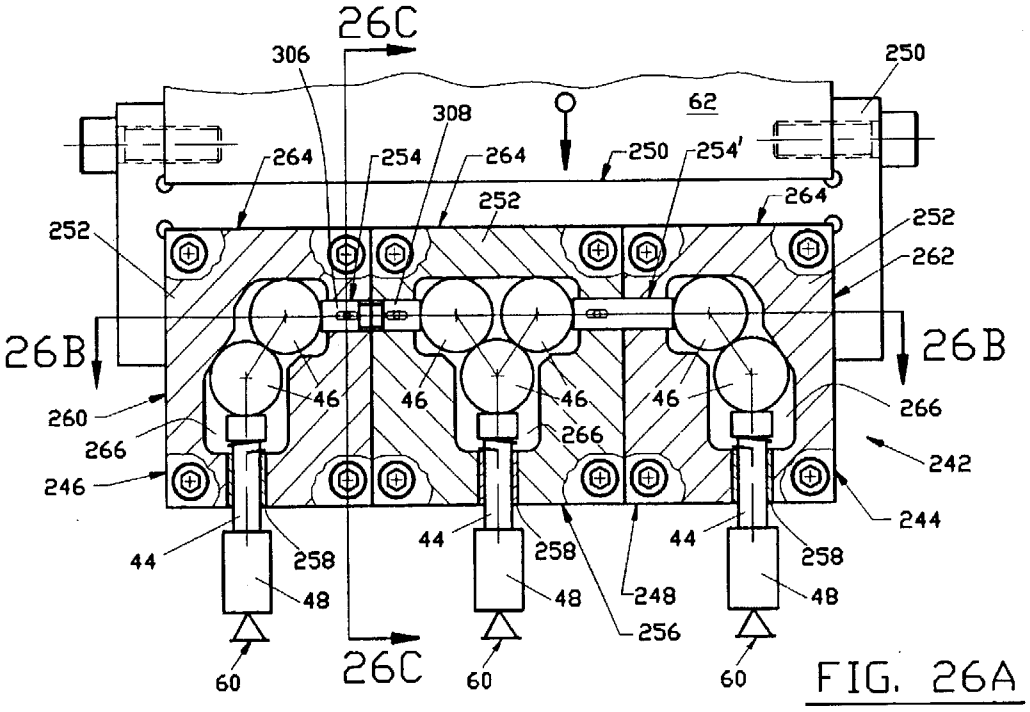
FIG. 26A is a top view of a modular clamp assembly of this invention having a modular inner clamp in operable communication with a pair of modular outer clamp units.

FIGS. 26A–29 illustrate a modular clamp assembly embodiment 242 having a pair of modular outer clamp units 244 & 246, and a modular inner clamp unit 248, with each clamp unit having a single clamp finger 44 extending outwardly therefrom. Advantageously, a clamp 242 of this preferred embodiment can be constructed and arranged so as to have a desired number of clamp fingers 44 that securely hold a desired number of workpieces or which hold a single workpiece with a contoured clamping surface having a certain number of points along the contoured clamping surface which must be securely held or supported during machining. Although the clamp assembly 242 shown in FIG. 26A has a single inner clamp unit 248, the clamp assembly 242 can be constructed with more than one inner clamp unit 248, if it is desired, for example, to produce a clamp assembly 242 having more than three clamp fingers 44. To keep all of the clamp units 244, 246 & 248 together in a single assembly 242, the clamp units 244, 246 & 248 are operably connected together such as by preferably being received in a fixture or a bracket 250, such as is depicted in FIGS. 26A & 26B, that is carried by jaw 62. Alternatively, the clamp units can also be joined together in another manner to form a unitary assembly of clamp unit modules 242.

As is depicted in FIG. 26A, each modular clamp unit has a housing 252, at least two load transfer elements 46 received within the housing 252, and an elongate load communicating element 254 shared between adjacent clamp units, with the load communicating element 254 being in contact with a load transfer element 46 of both adjacent clamp units during clamping. Each clamp housing 252 has a front wall 256 with a bore 258 for receiving a clamp finger 44, a pair of sidewalls 260 & 262, a rear wall 264, a top 261, and a bottom 263. Each of the clamp units also has a cavity 266 within the housing 252 for receiving load transfer elements 46 and a portion of at least one load communicating element 254 therein.

A. Outer Clamp Units

Figure 27:
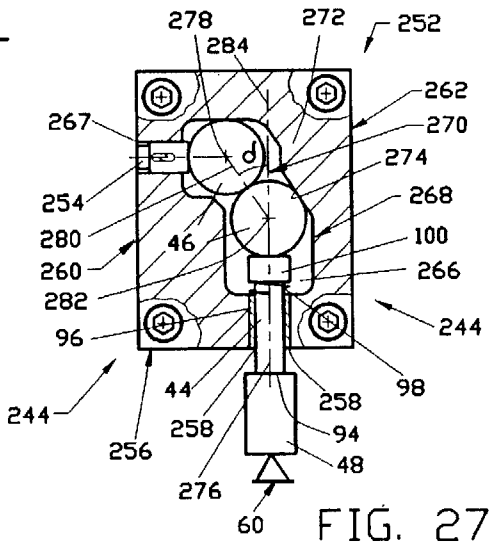
FIG. 27 is a top view of the right hand outer clamp unit with a portion of its housing cutaway to show the construction and arrangement of load transfer elements and a portion of a load communicating element received within the clamp housing.
Figure 28:
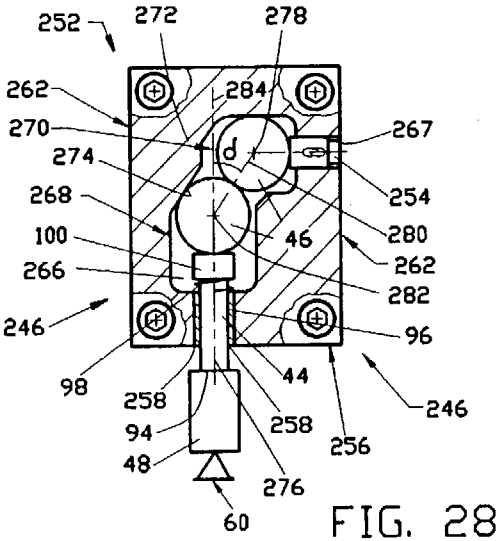
FIG. 28 is a top view of the left hand outer clamp unit with a portion of its housing cutaway to show the construction and arrangement of its load transfer elements and a load communicating element received within the clamp housing.

Each modular clamp assembly 242 has a pair of outer clamp units 244 & 246 which are shown in more detail in FIGS. 27 & 28. To receive a load communicating element, a sidewall of each outer clamp unit 244 & 246 has a bore 267. If desired, a liner (not shown) can also be received in the bore 267 with a load communicating element 254 received through the liner. As is shown in FIG. 27, the bore 267 of outer clamp unit 244 extends completely through the sidewall 260 adjacent an interior clamp unit 248 when assembled to such a clamp unit 248, such as is depicted more clearly in FIG. 26A. As is shown in FIG. 28, the bore 267 of outer clamp unit 246 extends completely through the sidewall 262 adjacent an interior clamp unit 248, such as is depicted more clearly in FIG. 26A.

Referring to FIGS. 27 & 28, the outer clamp units 244 & 246 preferably have a single load transfer element 46 in their first row 268 and a single load transfer element 46 in their second row 270. The clamp housing 252 of each outer unit 244 & 246 preferably has an inwardly extending portion 272 that is part of one of its sidewalls for promoting stability of the clamp unit by preventing the load transfer element 46 in its second row 270 from moving too far behind the clamp finger 44 thereby preventing it from becoming stuck and limiting or stopping the reciprocating movement of the clamp finger 44 such that it cannot suitably compensate for tolerance differences between workpieces or contour differences along a surface of a single workpiece. The inwardly extending portion 272 of the sidewall is opposite the load communicating element 254 for limiting movement of the load transfer element 46 of the second row 270 in a direction away from the load communicating element 254 for facilitating tolerance compensation between clamp units and promoting stability of each of the outer clamp units 244 & 246.

As is shown in FIG. 27, inwardly extending portion 272 extends inwardly from sidewall 262 of right hand outer clamp unit 244 into the housing cavity 266 for promoting stability of the clamp unit 244. As is shown in FIG. 28, inwardly extending portion 272 extends inwardly from sidewall 260 of left hand outer clamp unit 246 into the housing cavity 266 for promoting stability of the clamp unit 246.

A sidewall of both outer clamp units 244 & 246 also preferably has an inwardly inclined guide surface 274 for guiding the load transfer element 46 of the first row 268 during operation of the clamp unit and for promoting stability of the clamp unit by preventing the load transfer element 46 of the first row 268 from being displaced too far into the housing cavity 266 such that it substantially lies in the second row 270 (thereby preventing restriction or loss of the tolerance compensating capability of the outer clamp units 244 & 246). During operation, the guide surface 274 preferably bears against the load transfer element 46 of the first row 268 to guide its movement during forward and rearward movement of the clamp finger 44, thereby also helping to promote stability of the clamp unit.

As is shown in FIG. 28, a guide surface 274 extends inwardly from sidewall 262 of right hand outer clamp unit 244 into the housing cavity 266 for facilitating tolerance compensation and promoting stability of the clamp unit 244. As is shown in FIG. 28, a guide surface 274 extends inwardly from sidewall 260 of clamp unit 246 into the housing cavity 266 for facilitating tolerance compensation and promoting stability of the clamp unit 246.

As is shown in FIGS. 27 & 28, the clamp finger 44 has a load transfer element 46 in the first row 268 that is behind it such that a central longitudinal axis 276 of the finger 44 intersects a portion of that load transfer element 46. Preferably, the load transfer elements 46 of each outer clamp unit are constructed and arranged such that the load transfer element 46 of the second row 270 is offset toward the interior wall of the clamp housing with its center point 278 interiorly of the central longitudinal axis 276 of the clamp finger 44 of the outer clamp unit. The interior wall of the clamp housing of clamp unit 244 or 246 preferably is the wall closest to an adjacent sidewall of an interior clamp unit 248.

During clamping and while a workpiece is clamped by each outer clamp unit, the load transfer element 46 of the first row 268 is in contact with the clamp finger 44 while also being in contact with the load transfer element 46 of the second row 270. During clamping and while a workpiece is clamped by each outer clamp unit, the load transfer element 46 of the second row 270 is preferably also in contact with load communicating element 254.

Preferably, the load transfer elements 46 and load communicating element 254 of each outer clamp unit are constructed and arranged such that a line 280 extending from the center point 278 of the load transfer element 46 of the second row 270 to the center point 282 of the load transfer element 46 of the first row 268 is acutely angled relative to the central longitudinal axis 276 of the clamp finger 44 at all times of clamp operation. Preferably, the line 280 also extends through the point of contact between the two load transfer elements 46. Preferably, the contact line 280 between load transfer elements 46 is acutely angled relative to a reference line or axis 284 extending through the center point 282 of the load transfer element 46 of the first row 268 in a direction substantially parallel to the central longitudinal axis 276 of the clamp finger 44. Preferably, the contact line 280 forms an angle, δ, with the reference line 284 that is at least about 5° at all times of clamp operation for ensuring stability of each outer clamp unit 244 & 246. With the clamp fingers 44 and elements 46 in the positions shown in FIGS. 27 & 28, line 284 is substantially aligned with the central axis 276 of the clamp finger 44 because the axis 276 intersects the center point 282 of the load transfer element 46 of the first row 268.

B. Interior Clamp Unit

Figure 29:
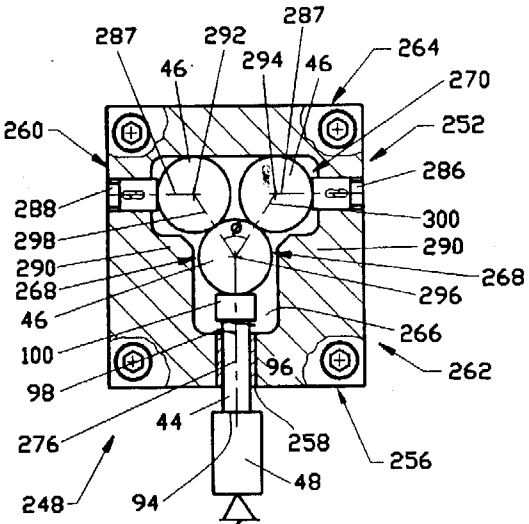
FIG. 29 is a top view of an inner clamp unit with a portion of its housing cutaway to show the construction and arrangement of load transfer elements and load communicating elements received within the clamp housing.

Referring to FIG. 29, each inner clamp unit 248 has a bore 286 in its right hand sidewall 262 and a bore 288 in its left hand sidewall 260, with each of the bores 286 & 288 for receiving a load communicating element 254 from an immediately adjacent clamp unit. The housing cavity 266 of each inner clamp unit 248 preferably is substantially T-shaped, with each housing sidewall 260 & 262 having an inwardly extending portion 290 to help guide the movement of the load transfer elements 46 within the cavity 266 for promoting stability of the clamp unit 248 during operation.

Each inner clamp unit 248 preferably has a single clamp finger 44 extending from the bore 258 in the front wall 256 of the housing. Each inner clamp unit 248 has a single load transfer element 46 in the first row 268 and a pair of load transfer elements 46 in the second row 270. The bores 286 & 288 in the sidewalls of each inner clamp unit 248 preferably axially overlie a load transfer element 46 of the second row 270 such that a load communicating element 254 received in each bore can bear against a load transfer element 46 of the second row 270 during clamping of a workpiece. Preferably, each bore 286 & 288 has a central longitudinal axis 287 that intersects at least a portion of an adjacent load transfer element 46 of the second row 270.

Preferably, the load transfer elements 46 within the interior cavity 266 of each inner clamp unit 248 are constructed and arranged to form and maintain a triangular relationship with each other during use and operation of the clamp unit 248. The load transfer elements 46 are preferably arranged such that the load transfer element 46 of the first row 268 is preferably in contact with the clamp finger 44 and is also in contact with both load transfer elements 46 of the second row 270 while a workpiece is clamped. Each load transfer element 46 of the second row 270 is preferably in contact with the load transfer element 46 of the first row 268 and is also in contact with a load communicating element 254 received in an adjacent bore 286 or 288 while a workpiece is clamped.

Each load transfer element 46 of the second row 270 has a center point that is offset from the central longitudinal axis of the clamp finger 44. As is also depicted in FIG. 29, load transfer element 46 having center point 292 is offset left of the clamp finger axis 276 and load transfer element 46 having center point 294 is offset right of the clamp finger axis 276.

The load transfer element 46 of the first row 268 is positioned behind the clamp finger 44 such that its center point 296 is also preferably located behind the finger 44. Preferably, an acute angle, ϕ, is created by the intersection of a line 298 extending from the center point 292 of load transfer element 46 (second row 270) to the center point 296 of the load transfer element 46 of the first row 268 with a line 300 extending from the center point 294 of load transfer element 46 (second row 270) to the center point 296 of the load transfer element 46 of the first row 268. Preferably, ϕ is at least about 10° during all times of clamp operation. Preferably, ϕ is between about 15° and about 80° during clamp operation, for the clamp construction shown in FIGS. 26–29.

Preferably, the housing cavity 266 is large enough to permit some movement of the load transfer elements 46 relative to (a) each other, (b) load communicating elements 254 and (c) the clamp finger 44. Preferably, the housing cavity 266 is sufficiently large to permit relative movement of the load transfer elements 46 within the cavity 266 to enable a clamping assembly made up of an inner clamp unit 248 of the construction shown in FIG. 29 to compensate for tolerance differences between workpieces while helping to keep the clamp unit 248 and clamp assembly 242 stable during operation.

C. Load Communicating Element

As is depicted in FIGS. 26A–29, displacement of the clamp finger 44 and load transfer elements 46 between each pair of adjacent clamp units is communicated between adjacent clamp units by a load communicating element 254. The load communicating element 254 can be a one piece or two piece elongate bar or rod preferably constructed of a strong and resilient material that is received through the sidewalls of adjacent clamp units and which can move back and forth as is needed by adjacent clamp units so that they can operably communicate (cooperate) with each other to compensate for differences in length or tolerance between workpieces that are being clamped. For clamp units joined together to form a modular clamp assembly 242, the load communicating elements 254 between adjacent clamp units enable all of the clamp units to operably communicate with each other to compensate for tolerance differences between workpieces being clamped by all of the clamp fingers 44. As such, for a modular tolerance compensating clamp assembly 242 of this invention, there is a load communicating element 254 between each pair of adjacent clamp units.

Figure 26C:
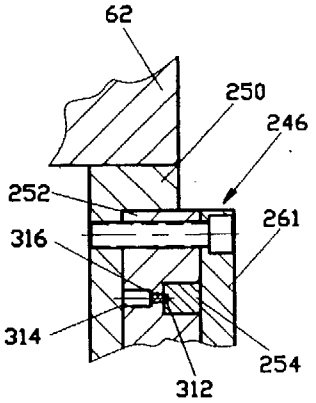
FIG. 26C illustrates a fragmentary cross sectional view of a modular clamp unit taken along line 26C—26C of FIG. 26A depicting details of construction of the load communicating element.

Although, the load communicating element 254 can be of one piece unitary construction, such as is depicted by the load communicating element 254' shown in FIGS. 26A & 26B, it preferably is of two piece construction, such as is depicted by the load communicating element 254 shown in FIGS. 26A–26B. As is shown in FIGS. 26B & 26C, the load communicating element 254 has a first load communicating element portion 306 and a second load communicating element portion 308 that preferably bears against the first element portion 306 during clamp operation. Each load communicating element portion 306 & 308 has a necked down portion 311 adjacent the other load communicating portion 306 & 308, as is depicted in FIG. 26B.

To help guide the movement of each load communicating element portion 306 & 308 and to retain it in its bore, the clamp unit housing has a bore 314 adjacent each portion 306 & 308 for receiving a set screw 316 (FIG. 26C) that is received in a groove 312 in the load communicating element 254. Preferably, each set screw 316 can be constructed with a dog end that is received in the groove 312 of a load communicating element portion, such as in the manner depicted in FIG. 26B.

V. Spaced Apart Finger Clamp Construction

FIGS. 30–34 illustrate two preferred embodiments of another clamp construction 342 & 342' of this invention having an adjacent pair of clamp fingers 44, $A_0$ & $B_0$, spaced apart by a distance M that is greater than a nominal distance, $M_1$, between other clamp fingers 44, such as the fingers 44 located at positions $B_0$ & $C_0$. The distance M for both clamp constructions 342 & 342' shown in FIGS. 30–34 is preferably greater than the diameter of a single load transfer element 46 while still providing tolerance compensating and uneven contour conforming capabilities to each clamp 342 & 342'. In these preferred clamp embodiments 342 & 342', behind each clamp finger 44 there also is a load transfer element 46. Preferably, there is at least one load transfer element 46 in the first row 200 that is in contact with each finger 44 during clamping.

Figure 30:
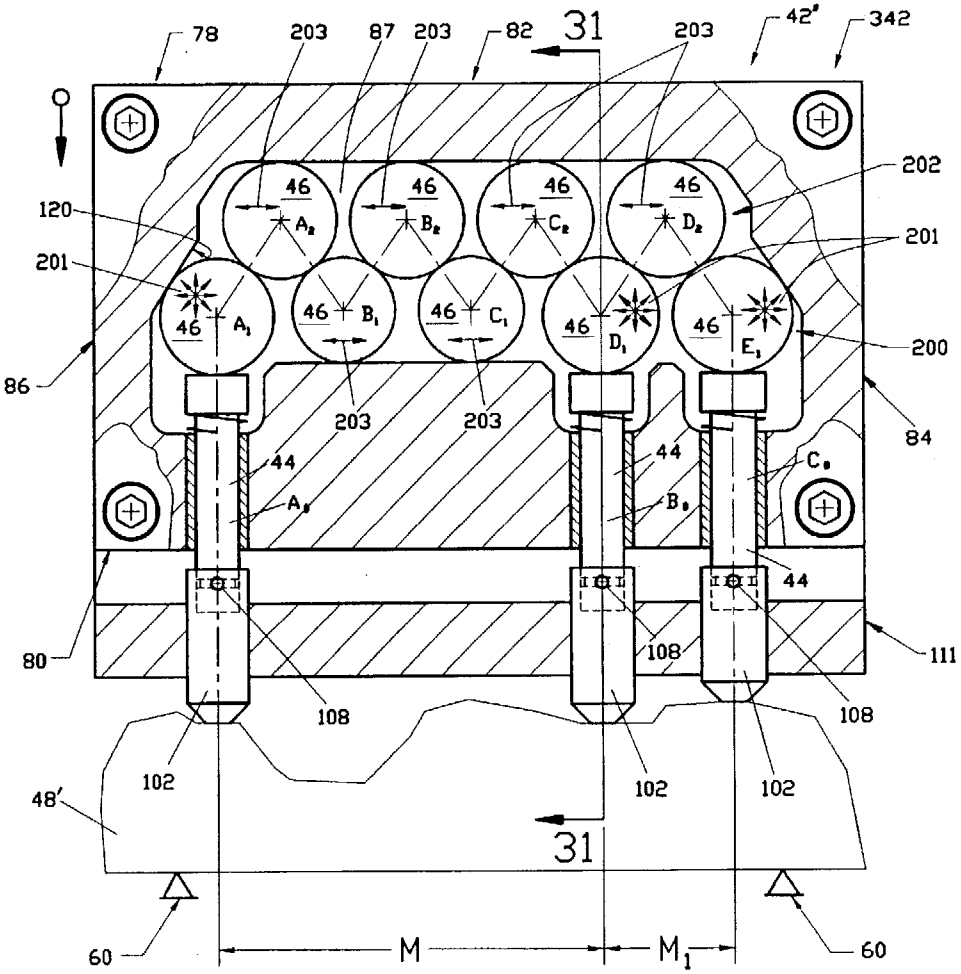
FIG. 30 is a top view of another preferred clamp embodiment having one pair of adjacent clamp fingers spaced further apart than another pair of adjacent clamp fingers.

As is depicted in FIG. 30, the clamp 342 has three clamp fingers 44, with a load transfer element 46 behind each clamp finger 44. Clamp fingers 44 located at positions $A_0$ and $B_0$ are spaced apart from each other by a distance, M, that preferably is more than the diameter of a single load transfer element 46. In some instances, however, if load transfer elements are used between adjacent fingers that are smaller than the load transfer elements behind the fingers, the distance, M, between adjacent spaced apart fingers can be less than the diameter of a larger load transfer element. In FIG. 30, the load transfer elements at positions $B_1$ and $C_1$ are depicted as being smaller than all of the other elements 46 of the clamp 342.

Figure 31:
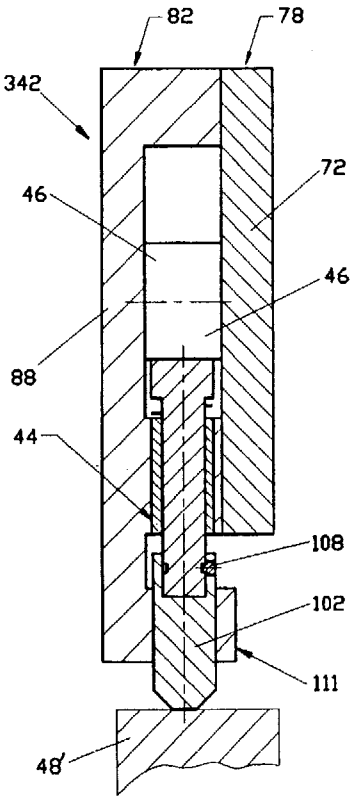
FIG. 31 is a cross sectional view of the clamp taken along line 31—31 of FIG. 30.

For the clamp 342 of the configuration shown in FIGS. 30 & 31, the clamp 342 has one less load transfer element 46 in its second row 202 than the number of load transfer elements 46 in its first row 200. As is shown in FIG. 30, the clamp 342 has five load transfer elements 46 in its first row 200 and four load transfer elements 46 in its second row 202.

During operation of the clamp 342, the additional load transfer elements 46 ($B_1$, $B_2$, $C_1$ & $C_2$) that space fingers $A_0$ & $B_0$ further apart can move laterally within the clamp housing to communicate movement of the other elements 46 during clamping to enable the clamp 342 to compensate for tolerance variations between more than one workpiece simultaneously clamped. Additionally, as is depicted in FIG. 30, the additional load transfer elements 46 ($B_1$, $B_2$, $C_1$, & $C_2$) enables fingers 44 of the clamp 342 to be spaced sufficiently apart to engage an unevenly contoured workpiece 48' at desired clamping points along its exterior or clamping surface.

For the clamp 342' of the configuration shown in FIGS. 32–35, the clamp 342' has the same number of load transfer elements in the first row and second row as the number of clamp fingers 44. To enable clamp fingers 44 in the locations $A_0$ & $B_0$ to be spaced apart a distance, M, there is a load communicating element 254" that enables operable communication of the load transfer elements 46 that are in operable communication with the fingers 44 in the $A_0$ & $B_0$ positions. Preferably, the load communicating element 254" functions as a spacer that can move during clamp operation to enable the fingers 44 in locations $A_0$ & $B_0$ to be spaced apart while still being able to compensate for workpiece tolerance or contour variations.

Figure 32:
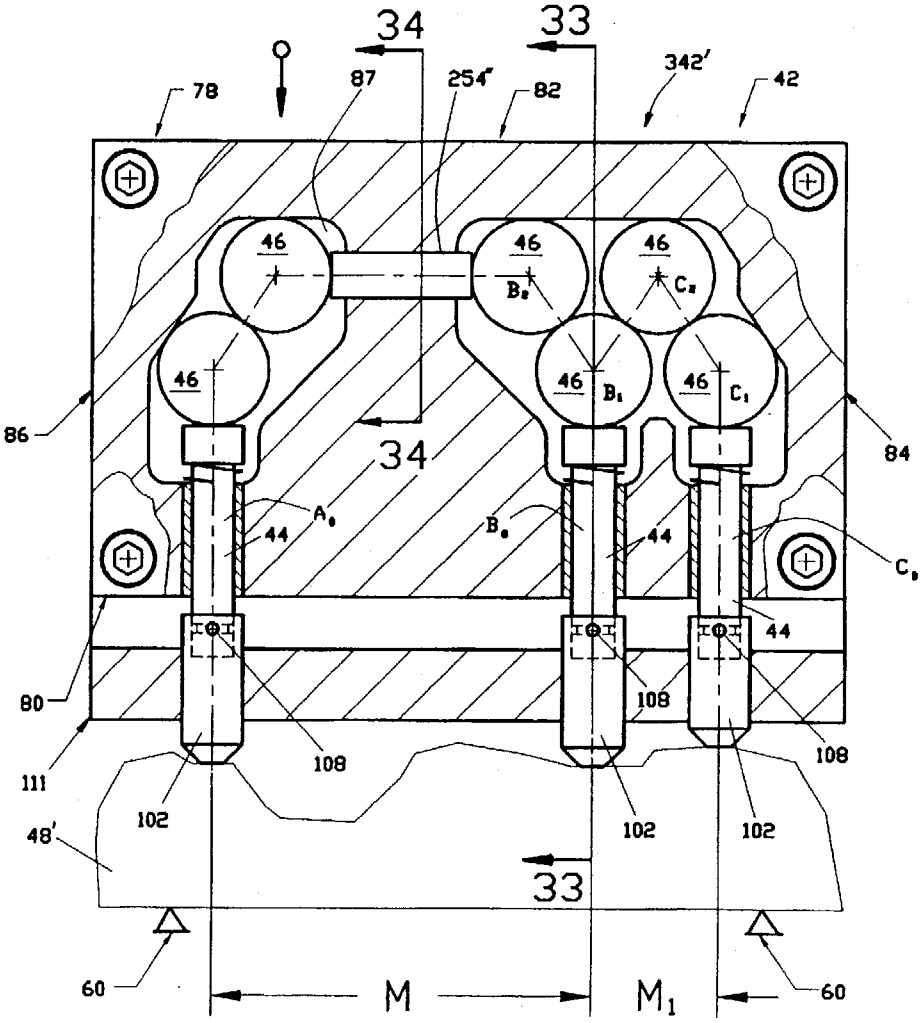
FIG. 32 is a top view of a still further preferred clamp embodiment having one pair of adjacent clamp fingers spaced further apart than another pair of adjacent clamp fingers.

As is shown in FIG. 32, the clamp 342' has three clamp fingers 44, three load transfer elements 46 in the first row 200 and three load transfer elements 46 in the second row 202. To enable fingers 44 at positions $A_0$ and $B_0$ to be spaced apart M, load communicating element 254" preferably bears against load transfer elements 46 of the second row 202 in positions $A_2$ & $B_2$. Preferably, the distance between fingers 44 at positions $A_0$ & $B_0$, M, is greater than the distance, $M_1$, between fingers 44 at positions $B_0$ & $C_0$, because of load communicating element 254" functioning as a spacer to enable fingers 44 at positions $A_0$ & $B_0$ to be spaced further apart.

During operation of the clamp 342', the load communicating element 254" can move laterally relative to the load transfer elements 46 in positions $A_2$ & $B_2$ to communicate movement of the elements 46 during clamping to enable the clamp 342' to compensate for tolerance variations between more than one workpiece simultaneously clamped. Additionally, as is depicted in FIG. 32, the load communicating element 254" enables fingers 44 of the clamp 342' to be spaced sufficiently apart to engage an unevenly contoured workpiece 48' at non-uniformly spaced clamping points along its exterior or clamping surface.

Therefore, clamps 342 & 342' have at least three reciprocable clamp fingers 44 with one pair of adjacent fingers 44 spaced apart further apart than another pair of adjacent fingers 44. As is shown in FIGS. 30 & 32, adjacent fingers 44 located at $A_0$ & $B_0$ are spaced further apart than adjacent fingers 44 located at $B_0$ & $C_0$.

For the clamp 342 & 342' shown in FIGS. 30 & 32, the clamp has a first row 200 of load transfer elements 46 behind the fingers 44 and a second row 202 of load transfer elements 46 behind the first row 200 of elements 46 with an element 46 in the first row 200 directly behind each finger 44 and contacting the finger 44 it is behind during clamping of a workpiece by the finger 44. Preferably, the clamp 342 has at least one more load transfer element 46 in the first row 200 than the number of clamp fingers 44 of the clamp 342 for enabling one adjacent pair of clamp fingers 44 ($A_0$ & $B_0$) to be spaced further apart from each other than another pair of adjacent clamp fingers 44 ($B_0$ & $C_0$).

Preferably, a clamp 342 or 342' of this preferred construction has a first row 200 of load transfer elements 46 adjacent the clamp fingers 44 and a second row 202 of load transfer elements 46 adjacent the first row 200 of load transfer elements 46 with a load transfer element 46 behind each clamp finger 44 and contacting the clamp finger 44 during clamping of a workpiece 48 by that clamp finger 44. Preferably, the clamp can be constructed with an elongate load communicating element 254" in contact with a pair of load transfer elements 46 of one of the element rows to space apart the elements 46 for enabling one adjacent pair of clamp fingers 44 to be spaced further apart from each other than another pair of adjacent clamp fingers 44.

Preferably, the load communicating element 46 is interjacent the adjacent fingers 44 which are further spaced apart than another pair of adjacent fingers 44. Preferably, one end of the load communicating element 254" engages a load transfer element 46 of one of the rows that operably communicates with one of the spaced apart clamp fingers 44 and the other end of the load communicating element engages a load transfer element 46 of one of the rows that operably communicates with the other of the spaced apart clamp fingers 44. Preferably, the load communicating element 254" engages load transfer elements 46 of the second row 202 to space them apart to enable one pair of adjacent clamp fingers 44 to be spaced further apart than another pair of adjacent clamp fingers 44.

VI. Use and Operation

A. Use

In use, as is depicted in FIG. 9, a clamp 42 of this invention can be used to simultaneously clamp several workpieces having slightly different lengths while compensating for tolerance differences between the workpieces. As is shown in FIG. 7, a clamp 42 of this invention can also be used to clamp a single workpiece 48' having a contoured clamping surface. Additionally, a clamp 42 of this invention can be used to clamp a single contoured workpiece that has a portion or all of its contoured clamping surface out of tolerance.

As such, a clamp 42 of this construction is well suited for machining applications that require several workpieces to be simultaneously and securely held during machining. Moreover, because of all of these uses and advantages, a clamp 42 of this invention is particularly well suited for precision machining applications that require the simultaneous clamping of several precisely located workpieces so that they can be precisely and accurately machined.

A clamp 42 of this invention is also well suited for applications requiring a workpiece or part to be held securely against a locator surface while another operation, such as precise measurement of the workpiece or part, is performed. A clamp 42 of this construction can also be used for applications which require force to be relatively evenly applied against a contoured object that may not be able to tolerate application of too great of force in any one location. Advantageously, a clamp 42 of this invention is particularly well suited for applications where the workpiece 48 has only one locator surface because the workpiece need not be located by the clamp 42 because it need only be located relative to the other jaw 60 of a vise 40 when the clamp 42 urges the workpiece 48 against the jaw 60 during clamping.

A clamp 42 of this invention is also well suited for precision machine tool applications that utilize a pallet workpiece delivery system for delivering one or more located and clamped workpieces to one or more machine tools along an assembly line. As such, a clamp 42 of this invention can be used for simultaneously clamping several workpieces carried on a pallet.

A clamp 42 of this invention can be used for applications which require a great deal of clamping force to securely hold one or more workpieces, as well as applications which require less clamping force. Illustrative examples of clamp applications which may require less clamping force are the clamping of sheet metal and circuit boards.

A modular clamp 242 of this invention is well suited for securely holding several workpieces and can be used in custom applications where one type workpiece is being machined during one clamping operation and another different type of workpiece is being machined during the next clamping operation. Additionally, the modular clamp 242 is well adapted to clamping applications where a different number of workpieces are being clamped from one operation to another operation. Advantageously, the modular clamp 242 is flexible as it can be used for applications requiring as little as three clamp fingers 44 and for applications requiring several clamp fingers 44.

B. Operation

In operation, the clamp 42 shown in FIG. 1 is depicted clamping a pair of workpieces 48 against a locator surface 52 of the fixed jaw 60 of the vise 40. As clamp fingers 44 are brought to bear against each workpiece 48, each workpiece 48 is urged against the locator surface 52 of the vise 40 thereby accurately locating each workpiece 48 relative to the vise 40, as well as, preferably a machine tool or another device that is to perform an operation on the workpieces 48.

During clamping, as the clamp fingers 44 are brought to bear against the workpieces 48, clamping force is transmitted from the clamp fingers 44 to the load transfer elements 46 within the clamp housing 78. Since the housing cavity 87 is larger than the load transfer elements 46 within the cavity 87, as clamping pressure continues to be applied by an operator of the vise 40, at least some of the load transfer elements 46 move relative to each other as clamp fingers 44 in contact with a workpiece 48 are displaced inwardly into the housing cavity 87. As the clamp fingers 44 that are in contact with a workpiece 48 are displaced into the housing 78, the clamp fingers 44 not engaging a workpiece 48 can be displaced slightly outwardly from the clamp housing 78 as a result of cooperation between load transfer elements 46 within the housing 78 with the clamp fingers 44.

Figure 19:
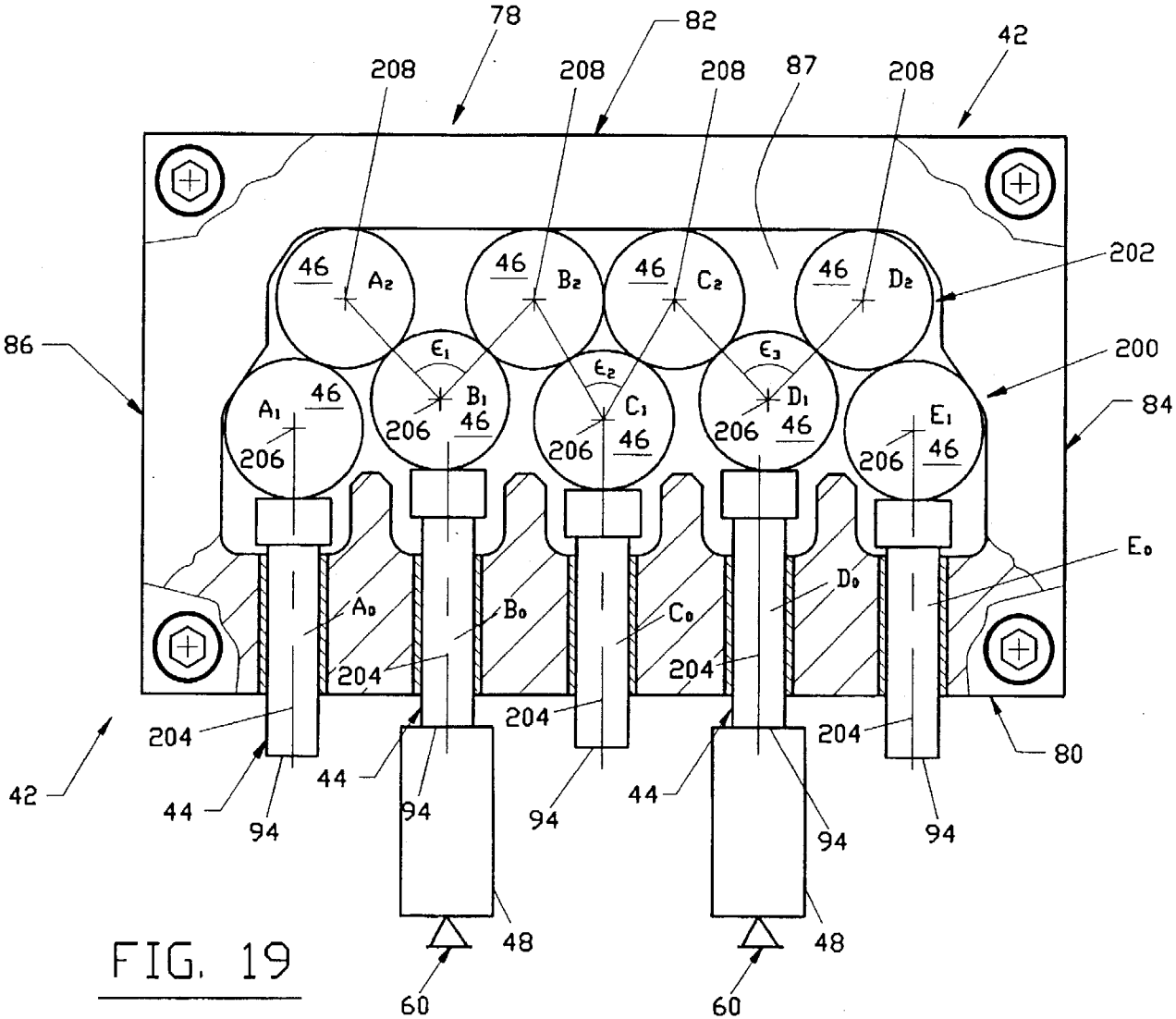
FIG. 19 is a top view of a clamp securely holding a pair of workpieces.
Figure 20:
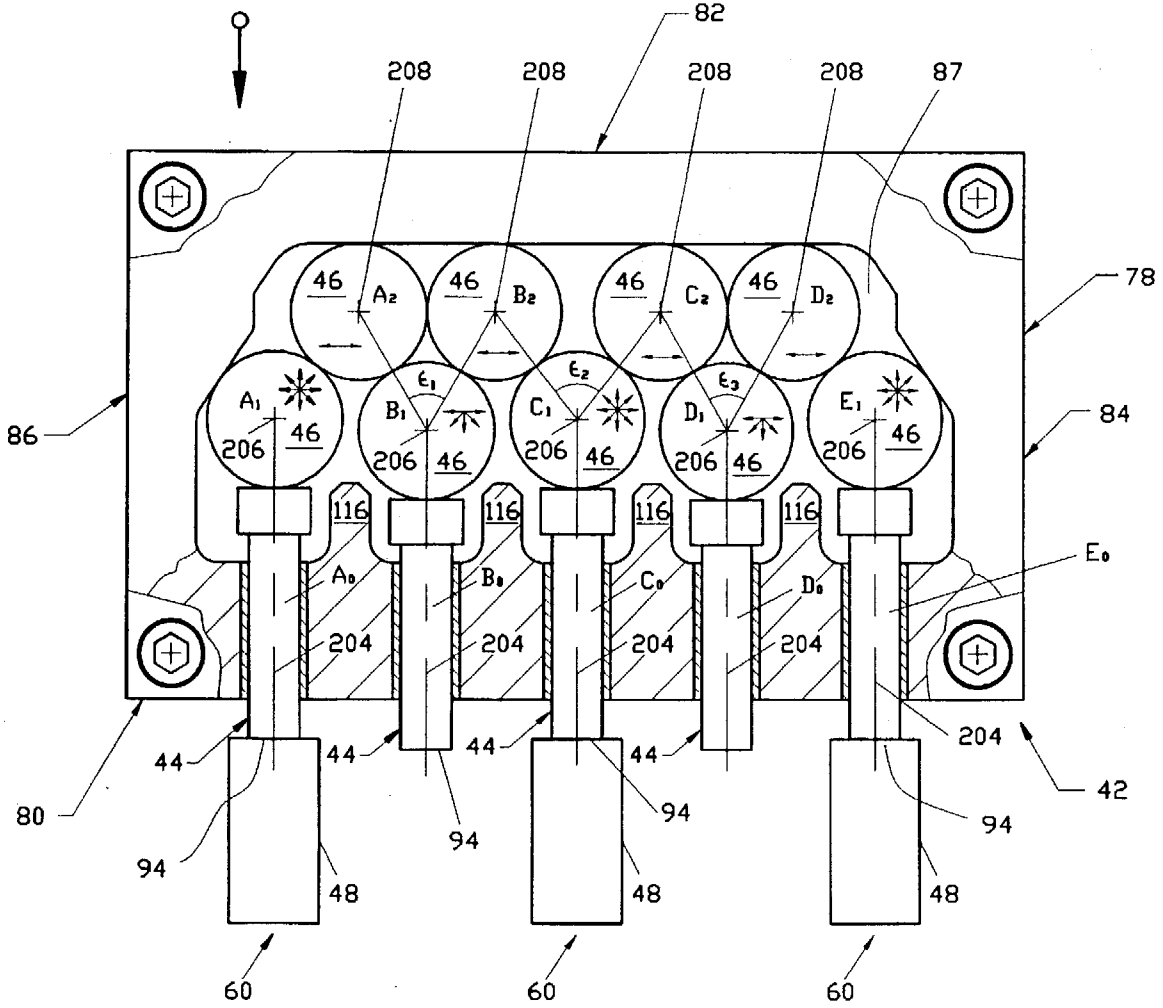
FIG. 20 is a top view of a clamp securely holding three workpieces.
Figure 22:
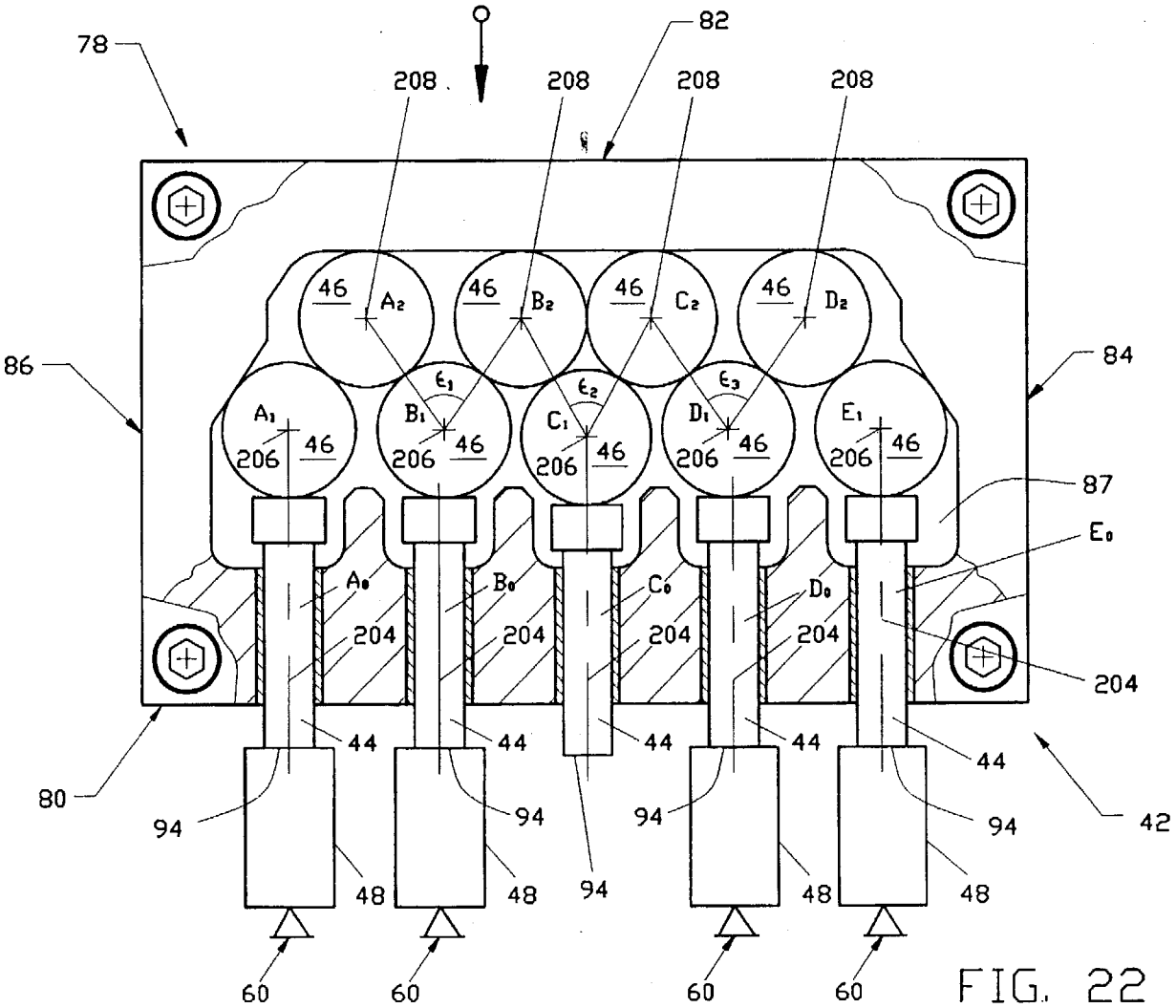
FIG. 22 is a top view of a clamp securely holding four workpieces.

In this manner, a clamp 42 of this construction having five clamp fingers 44 can be used to clamp a single workpiece with all of its fingers, as is depicted in FIGS. 6 & 7A, a single workpiece 48 with one of its fingers, as is shown in FIG. 18, a pair of workpieces 48 with two of its fingers 44, as is illustrated in FIG. 19, three workpieces with three of its fingers 44, as is shown in FIGS. 20 & 21, four workpieces 48 with four of its fingers 44, as is depicted in FIG. 22, and a workpiece securely held by each finger 44, as is shown in FIGS. 9 & 16.

1. Clamp With Two Fingers

As is depicted in FIG. 8, for the case of the clamp 42 having two clamp fingers 44, the clamp 42 is shown clamping a pair of workpieces 48. Both of the workpieces 48 depicted in FIG. 3 have the same length from the end of each clamp finger, $A_0$ & $B_0$, to the locator surface 50 of the fixed jaw 60. During clamping, both clamp fingers, $A_0$ & $B_0$, are displaced into the clamp housing 78 substantially about the same amount because the workpieces 48 are substantially the length.

Should the workpiece 48 in contact with clamp finger $A_0$ be even slightly longer than the workpiece 48 in contact with clamp finger $B_0$, indicating a tolerance difference between the workpieces, the finger $A_0$ in contact with the longest workpiece 48 will be displaced further into the housing than the other finger $B_0$ and load transfer element $A_2$ will be displaced such that its center 208 will move toward the axis 204 of the finger $B_0$ bearing against the shortest workpiece 48. Of course, the direction of movement of element $A_2$ relative to elements $A_1$ & $B_1$ will be reversed if the workpiece in contact with finger $B_0$ is longer than the workpiece in contact with finger $A_0$.

When clamped, any tolerance difference between workpieces will preferably increase, at least slightly, the angle, $\beta$, between load transfer elements $A_1$, $A_2$ & $B_1$. To maintain stability of the clamp 42, the clamp housing 78 and load transfer elements 46 are constructed and arranged such that at no time does the center point 208 of element $A_2$ become aligned with the center point 206 of either element $A_1$ or element $B_1$ in a direction parallel to a central axis 204 of any clamp finger 44 of the clamp 42.

2. Clamp With More Than Two Fingers

As is shown in more detail in FIG. 19, for the case of the clamp 42 having more than two fingers 44 and holding securely two workpieces 48, the positions of each load transfer element 46 relative to each other load transfer element 46 are shown. As the two clamp fingers $B_0$ & $D_0$ are brought to bear against a workpiece 48, they are displaced inwardly into the clamp housing 78 causing load transfer elements 46 to shift around within the housing 78.

As each finger, $B_0$ & $D_0$, is displaced, it displaces load transfer elements 46 in the first row 200 and load transfer elements 46 in the second row 202. Each load transfer element, $B_1$ & $D_1$, of the first row 200 in contact with clamp fingers, $B_0$ & $D_0$, moves relative to its adjacent clamp finger at least slightly outwardly toward a sidewall 84 or 86 of the housing 78. As they move, the center point 206 of each adjacent load transfer element, $B_1$ & $D_1$, moves outwardly of the central longitudinal axis 204 of the finger, $B_0$ & $D_0$, and the angle, $\epsilon_1$ & $\epsilon_3$, between center points 208 of adjacent pairs of contacting load transfer elements, $A_2$ & $B_2$, and, $C_2$ & $D_2$, the center point 206 of load transfer elements, $B_1$ & $D_1$, increases.

As fingers, $B_0$ & $D_0$, are urged inwardly into the clamp housing 78, each contacting load transfer element, $B_1$ & $D_1$, is urged toward the rear wall of the housing, spreading apart, respectively, load transfer elements, $A_2$ & $B_2$, and, $C_2$ & $D_2$, causing $\epsilon_1$ & $\epsilon_3$, to increase. As the elements, $A_2$ & $B_2$, and, $C_2$ & $D_2$, are spread apart from each other, elements, $B_2$ & $C_2$, are urged toward each other, decreasing $\epsilon_2$ and causing $\epsilon_2$ to be less than $\epsilon_1$ & $\epsilon_3$. As the load transfer elements 46 cooperate with each other, they reach a point where no further movement is possible, thereby causing the clamping force to each workpiece 48 being held by the fingers, $B_0$ & $D_0$, to increase. When clamping is completed, the clamping force is substantially equally distributed between workpieces 48 as a result of the relatively symmetric arrangement of the load transfer elements 46 within the clamp housing 78.

For the clamp shown in FIG. 18, a single clamp finger $C_0$ is clamping a single workpiece 48. During clamping, the finger $C_0$ is urged inwardly into the clamp housing 78 displacing load transfer element $C_1$ toward the rear wall 82 and separating slightly elements, $B_2$ & $C_2$, and increasing angle $\epsilon_2$. When the single workpiece 48 is completely clamped, $\epsilon_2$ preferably is greater than both $\epsilon_1$ & $\epsilon_3$ and the center point 206 of elements, $B_1$ & $D_1$, lie outside of the axis 204 of the clamp finger, $B_0$ & $D_0$, in contact with the element.

For the clamp 42 shown in FIG. 20, the clamp 42 is shown holding three workpieces 48. During clamping, fingers $A_0$, $C_0$ & $E_0$ are urged further into the clamp housing 78, displacing elements, $A_1$, $C_1$ & $E_1$, toward the rear wall 82 of the housing 78. As elements, $A_1$, $C_1$, & $E_1$, are displaced, elements $A_2$ & $B_2$ and $C_2$ & $D_2$ are urged toward each other and elements $B_2$ & $C_2$ are urged away from each other, decreasing $\epsilon_1$ & $\epsilon_3$ while increasing $\epsilon_2$. When the workpieces 48 are clamped in the manner depicted in FIG. 20, $\epsilon_2$ preferably is greater than $\epsilon_1$ & $\epsilon_3$.

When less than the full number of fingers 44 of a clamp 42 engage a workpiece 48 or clamping surface of a workpiece 48, such as is depicted in FIG. 20, the dividers 116 of the clamp housing 78 preferably can be constructed and arranged so that outward displacement of each clamp finger, $B_0$ & $D_0$, not engaging a workpiece is limited by its immediately adjacent load transfer element $B_1$ & $D_2$ bearing against one or more adjacent dividers 116 thereby stopping its movement toward the adjacent clamp finger. If desired, the length of each divider 116 or distance between adjacent dividers 116 can be selected so as to suitably limit the forward travel of an adjacent load transfer element 46. Advantageously, as a result of limiting forward displacement of a load transfer element 46 bearing against an unrestrained clamp finger 44, the stability of the entire assembly of load transfer elements is increased and preferably maintained under all clamp conditions.

To further enhance stability of the clamp 42, each finger 44 not in contact with a workpiece can be restrained or locked in place for limiting or preventing excessive clamp finger movement in an outward direction relative to the clamp housing 78. As is depicted in FIG. 21, the outward movement of each clamp finger, $B_0$ & $D_0$, not contacting a workpiece can be limited by a keeper plate 302 securely fastened to the front wall 80 of the clamp housing 78 by a pair of screws 304, such as cap screws. Alternatively, a "dummy" workpiece (not shown) can be positioned to engage those clamp fingers, $B_0$ & $D_0$, which are not engaging a workpiece 48 to be machined, thereby limiting outward clamp finger travel. Alternatively, the top of the clamp housing 78 can have a threaded bore (not shown) overlying each clamp finger 44 for receiving a set screw (not shown) that can directly engage the clamp finger 44 to lock it in place, should it not be used to hold a workpiece, to prevent it from being urged too far out of the housing 78 during clamping.

For the clamp shown in FIG. 22, the clamp 42 is holding securely four workpieces 48. During clamping, fingers $A_0$, $B_0$, $D_0$ & $E_0$ are urged into the housing relative to finger $C_0$, thereby urging elements $B_2$ & $C_2$ toward each other and causing $\epsilon_2$ to be less than $\epsilon_1$ & $\epsilon_3$. When clamped, elements $B_1$ & $D_1$ move relative to their immediately adjacent clamp fingers $B_0$ & $D_0$ such that their center points 206 lie interiorly of the central axis 204 of the fingers $B_0$ & $D_0$ in contact with those elements $B_1$ & $D_1$.

Figure 23:
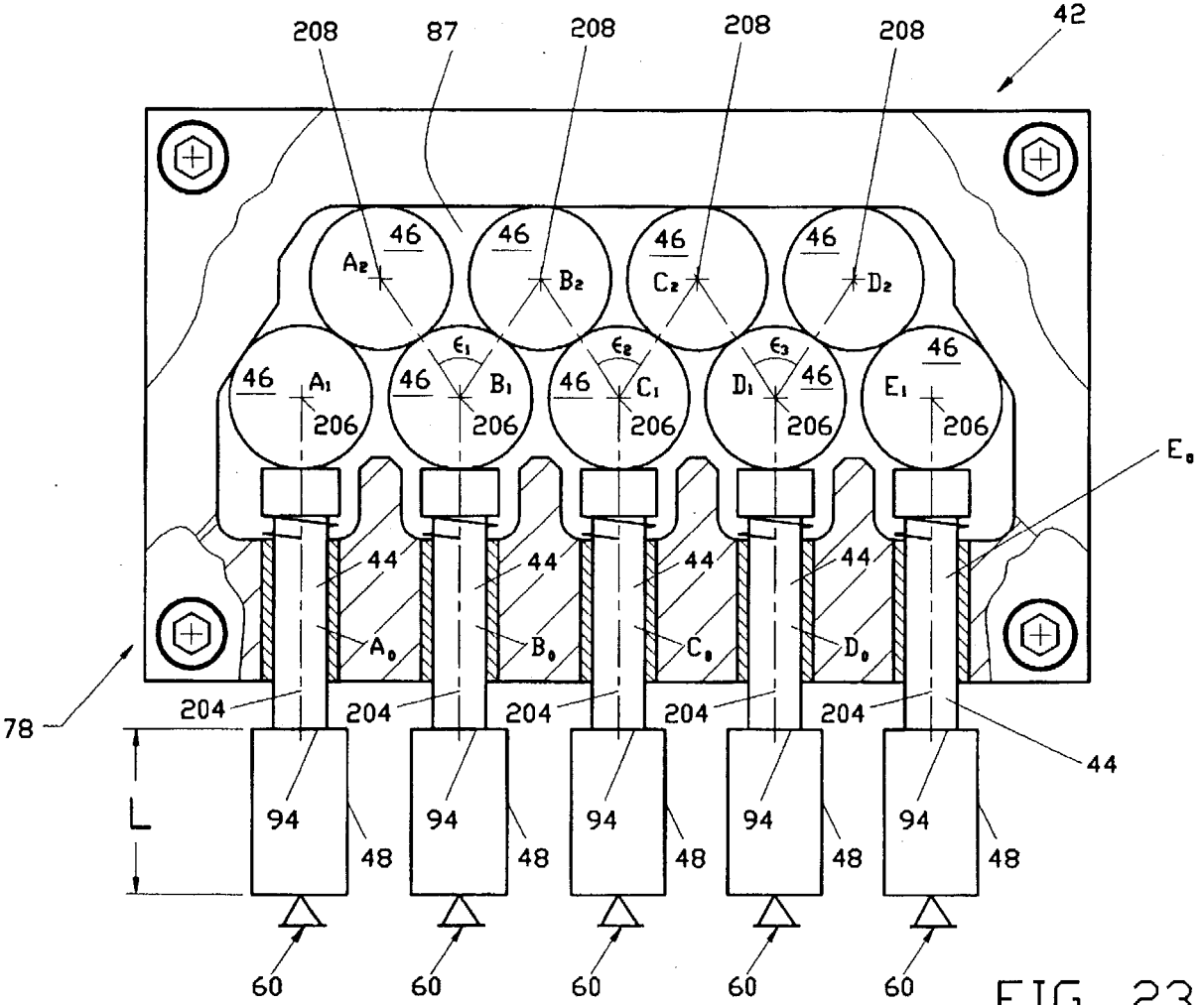
FIG. 23 is a top view of a clamp securely holding five workpieces.

For the clamp shown in FIG. 23, the clamp 42 is securely holding five workpieces 48 which all have substantially the same length, L. During clamping, all of the load transfer elements 46 cooperate with each other to securely hold the workpieces 48 against the locator surface 52 of the fixed jaw 60. When clamped, $\epsilon_1$, $\epsilon_2$ and $\epsilon_3$ are substantially equal.

EXAMPLE

Figure 24:
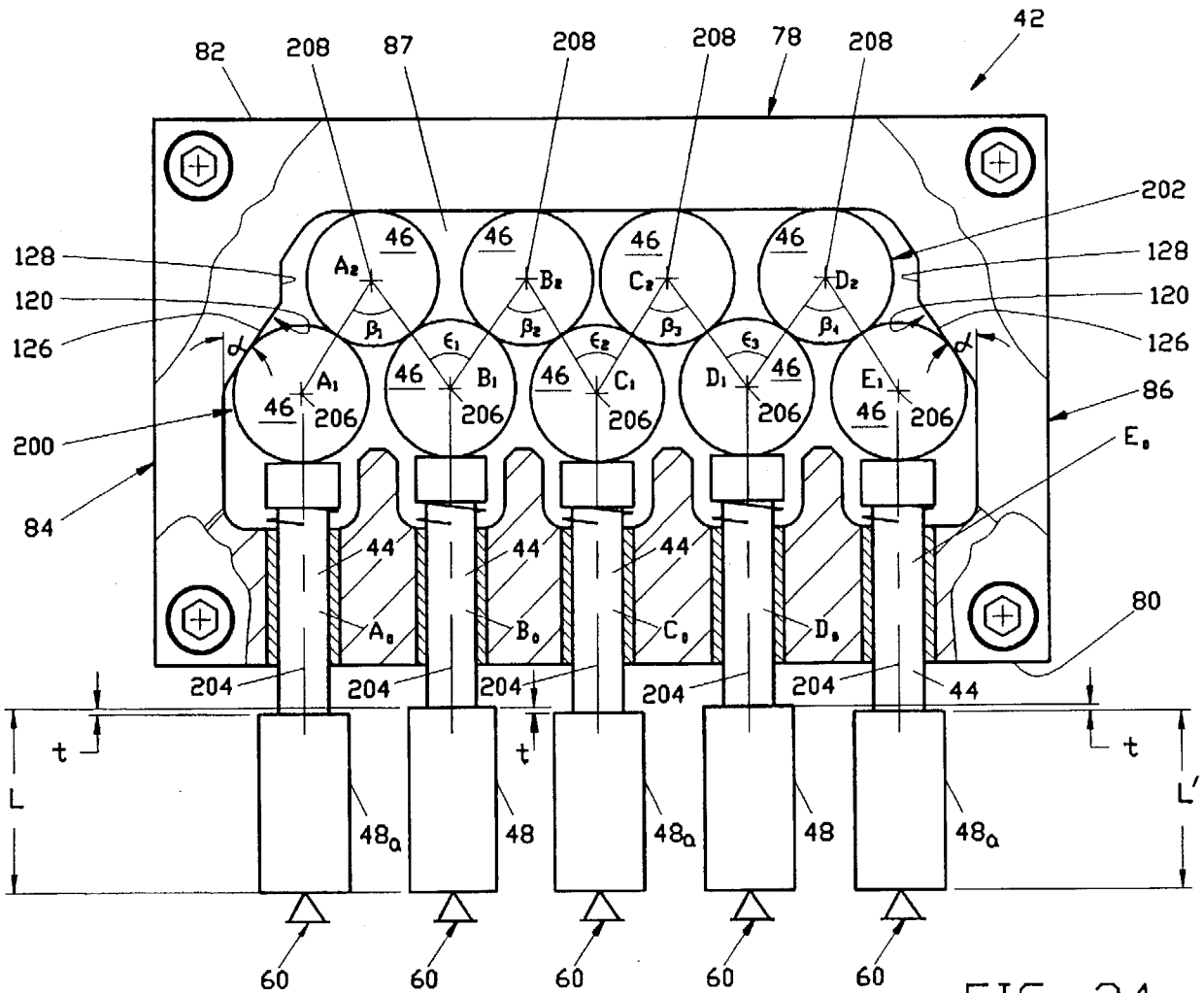
FIG. 24 is a top view of a clamp securely holding five workpieces.

FIG. 24 illustrates a clamp housing 78 having a length from sidewall 84 to sidewall 86 of about 5 inches and a depth from front wall 80 to rear wall 82 of about 4 inches with each sidewall 84 & 86 having a thickness of about 0.449 inches at its thinnest point. The front wall 80 has a thickness of about 0.75 inches and the rear wall 82 has a thickness of about 1.5 inches, although a thinner rear wall could be used. Each bore 90 (FIG. 2) for receiving a clamp finger 44 has a diameter of between about 0.376 and 0.377 inches. Each load transfer element 46 has a diameter of about 0.75 inches and a thickness of between about 0.456 and 0.458 inches, with the interior surfaces of the top and bottom of the clamp housing 78 being spaced apart sufficiently to accommodate all of the elements 46 while allowing them to freely move within the housing cavity 87.

To guide the outer load transfer elements $A_1$ & $E_1$ of the first row 200 and promote stability of the clamp 42, each sidewall 84 & 86 has an inwardly inclined guide wall 120 that has an inclined portion 126 that is inclined at an angle, $\alpha$, of between about 31° and about 35° and preferably is between about 33° and 34°. Preferably, this inwardly extending portion 120 of each sidewall 84 & 86 also helps to maintain clamp stability by restraining outward movement of each outer load transfer element $A_2$ & $D_2$ of the second row 202 of elements 46. Alternatively, a small block of generally rectangular cross section (not shown) having a length of about 0.5 inches, a width of about 0.375 inches and a depth of about 0.375 inches can be substituted for the inclined wall portion 120 to encourage stability of the clamp 42.

The clamp 42 is shown in FIG. 24 clamping five workpieces having tolerance differences between them. Workpieces 48 have a length, L, that is about 1 inch and workpieces 48*a* have a length, L', of about 0.969 inches amounting to a tolerance difference, t, of about 0.031 inches. During clamping, fingers $B_0$ & $D_0$ are urged slightly further inwardly into the clamp housing than fingers $A_0$, $C_0$ & $E_0$, thereby urging elements $B_2$ & $C_2$ toward each other and causing elements $A_1$ & $E_1$ to move relative to fingers $A_0$ & $E_0$ such that the center point 206 of those elements $A_1$ & $E_1$ lie slightly outside the central longitudinal axis 204 of the fingers $A_0$ & $E_0$ they are contacting. Preferably, the center point 206 of elements $A_1$ & $E_1$ lie about 0.007 inches outside of axis 204 when the workpieces 48 & 48*a* are clamped.

When the workpieces are clamped, $\epsilon_2$ is less than $\epsilon_1$ & $\epsilon_3$ as a result of elements $B_2$ & $C_2$ being urged toward each other. When clamped, $\beta_1$ & $\beta_4$ are approximately between about 68° and 69° and are preferably about 68.62°. When clamped, $\beta_2$ & $\beta_3$ are between about 67° to about 68° and are preferably about 67.98°. Preferably, a clamp 42 of this construction, having the clamp fingers 44 and elements 46 constructed and arranged as discussed and shown in FIG. 24 can compensate for tolerance differences (in this case differences in length of the workpieces) between workpieces simultaneously clamped of at least about fifty thousandths of an inch or less.

3. Clamping Unevenly Contoured Workpieces

FIGS. 7A & 7B illustrates a clamp 42 and method for holding a workpiece 48' having an unevenly contoured clamping surface 49. In the clamping of a workpiece 48' having an unevenly contoured surface 49, the workpiece 48' is preferably received by the fixed jaw 60 of a vise, such as the exemplary vise 40 shown in FIG. 1, in preparation for clamping. As is shown in FIG. 7A, the workpiece 48' is placed in operable communication with the jaw 60 such that the unevenly contoured clamping surface 49 of the workpiece 48' faces the clamp fingers 44 of the clamp 42.

Preferably, in addition to holding an unevenly contoured workpiece 48', the clamp 42 preferably is also able to clamp the workpiece 48', even if it is out of tolerance relative to other workpieces 48' of the same configuration clamped by the clamp, such as when workpieces, one after another, are (1) loaded into the vise, (2) clamped, (3) machined, (4) released from the vise, and (5) unloaded from the vise, in an assembly line setting. Therefore, even when clamping a single unevenly contoured workpiece 48', a clamp 42 of this invention is also able to compensate for workpiece toleration variations.

Before clamping a workpiece 48', and preferably before a workpiece 48' is loaded into the vise, extensions 102 of an appropriate length are selected to enable the clamp fingers 44 to engage the contoured workpiece 48' during clamping. After selecting the desired extensions, each selected extension 102 is attached to the appropriate clamp finger 44.

To clamp the unevenly contoured workpiece 48', the clamp 42 is moved toward the workpiece 48' until at least one of its clamp finger extensions 102 engage the unevenly contoured clamping surface 49 of the workpiece 48'. As finger extensions 102 of the clamp 42 begin to engage the contoured workpiece surface 49, the clamp fingers 44 move relative to each other because of the clamping force being applied against the workpiece 48' and because of the relative movement of the clamp 42 toward the workpiece 48'. To cause the fingers 44 and extensions 102 to move relative to each other until they conform to the contoured surface of the workpiece 48' to enable the clamp 42 to hold the workpiece 48' in the vise, the clamp 42 is urged further toward the workpiece 48'.

During clamping, load transfer elements 46 within the clamp housing 78 move relative to each other to permit the clamp fingers 44 to move relative to each other to enable the fingers 44 and extensions 102 to conform to the contour 49 of the workpiece 48' while also allowing the clamp 42 to compensate for workpiece tolerance variations. Preferably, the workpiece 48' is securely held against the fixed jaw 60 of the vise 40 when the load transfer elements 46 and clamp fingers 44 are no longer capable of relative movement. As is shown in FIG. 7A, to facilitate relative movement of the fingers 44 to enable the fingers 44 through their extensions 102 to conform to the contoured surface 49 of the workpiece 48', the load transfer elements 46 are constructed and arranged within the clamp housing 78 such that each clamp finger 44 has only one load transfer element 46 behind the finger 44 and in contact with the finger 44 during clamping.

During clamping, to prevent each extension 102 from pivoting as force is applied through the fingers 44 to the workpiece 48', each extension 102 is preferably supported as it moves and during engagement with the workpiece 48'. As is shown in FIGS. 7A & 7B, the clamp finger extensions 102 are preferably axially supported during clamping by guide assembly 111.

Therefore, FIGS. 7A & 7B preferably illustrate a method of securely holding a workpiece 48' having an unevenly contoured clamping surface 49 utilizing a clamp 42 having at least two reciprocable fingers 44 extending outwardly of the clamp housing 78 and at least two load transfer elements 46 within the housing which are in operable communication with the clamp fingers 44 for permitting relative movement between the fingers 44 during clamping of a workpiece 48'.

In the clamping of an unevenly contoured workpiece 48', the workpiece 48' is received by the vise in cooperation with a jaw of the vise preferably with the unevenly contoured clamping surface oriented so it faces the clamp fingers 44. During clamping, the clamp 42 is moved towards the workpiece 48' until at least one of its fingers 44 engage the unevenly contoured surface 49 of the workpiece 48'. To accomplish clamping against the contoured surface 49 while also compensating for workpiece tolerance variations, fingers 44 of the clamp 42 move relative to other fingers 44 of the clamp 42 to enable all of the fingers 44 to engage the unevenly contoured surface 49 of the workpiece 48' to securely hold the workpiece 48'.

During clamping and after the fingers 44 (or extensions 102) have engaged the workpiece 48', relative movement of the fingers 44 occurs by urging the clamp 42 further against the workpiece 48'. To enable the fingers 44 to move relative to each other, load transfer elements 46 within the clamp 42 move relative to other load transfer elements 46 thereby also enabling the fingers 44 to conform to the uneven contour of the workpiece 48' to engage the workpiece 48' to securely hold the workpiece 48'.

To facilitate clamping of an unevenly contoured workpiece 48', clamp finger extensions 102 are preferably provided for extending the length of each clamp finger 44. To match the contoured clamping surface 49 of the workpiece 48', extensions 102 for each clamp finger 44 are selected and attached to each clamp finger 44. To prevent pivoting of each extension 102 and to provide support for each extension 102 during clamping, each extension 102 is preferably guided along its longitudinal axis, such as by a guide assembly 111. Preferably, workpiece tolerance compensation is performed by the clamp 42 during clamping.

4. Modular Clamp Units

As is shown in FIG. 26A, the modular clamp units 244, 246, & 248 are connected together in an assembly 242 of units that cooperate with each other during clamping to compensate for tolerance variations between workpieces, when one or more workpieces are simultaneously clamped, and can accommodate contour variations in a single workpiece clamped by the assembly 242. Prior to clamping, the appropriate number of clamping units 244, 246 & 248 are selected and constructed and arranged such that there are two exterior clamp units 244 & 246 and a desired number of interior clamp units 248. During clamping, the assembly 242 is brought towards each workpiece to be secured until a clamp finger 44 of each clamp unit is preferably engaged against a workpiece 48, such as is depicted in FIG. 26A.

During clamping, as a clamp finger 44 of a clamp unit is brought to bear against a workpiece 48, the finger 44 is urged inwardly into the housing 252 of the clamp unit. As the finger 44 is urged into the housing 252, it causes one or more load transfer elements 46 within the housing 252 to move, as well as, one or more load communicating elements 254 to be displaced inwardly or outwardly of the housing 252 of that clamp unit. As each load communicating element 254 is displaced by movement of load transfer elements 46 of one clamp unit, it in turn displaces one or more load transfer elements 46 of an adjacent clamp unit, thereby making it possible for the clamp assembly 242 to compensate for tolerance differences between workpieces being clamped or contour variations in a single workpiece being clamped. In this manner, load communicating elements 254 communicate clamp finger displacement to one or more of the clamp units of the assembly 242, also to compensate for tolerance differences between workpieces being clamped or contour variations in a single workpiece being clamped.

It is also to be understood that, although the foregoing description and drawings describe and illustrate in detail working embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims and the applicable prior art.

What is claimed is:

1. A vise for holding one or more workpieces comprising:

(a) a base;

(b) a pair of jaws carried by said base with one of said jaws movable relative to the other of said jaws for holding one or more workpieces between said jaws;

(c) wherein one of said jaws comprises a clamp having a housing, at least two reciprocable clamp fingers extending outwardly from said housing for bearing against a workpiece, a plurality of movable load transfer elements received in said housing with at least some of said load transfer elements arranged in a row of said load transfer elements disposed adjacent to and rearwardly of said clamp fingers; and (d) wherein said row of load transfer elements has as many load transfer elements as the number of said clamp fingers and each said load transfer element of said row is disposed behind one of said clamp fingers.

2. The vise of claim 1 wherein each said clamp finger is in contact with only one load transfer element of said row while that said clamp finger is engaging a workpiece.

3. The vise of claim 2 wherein each said clamp finger has a central longitudinal axis generally parallel to the direction of clamp finger movement whereby each said clamp finger and each of said load transfer elements of said row behind said fingers are constructed and arranged such that each said axis of each said clamp finger passes through at least a portion of one of said load transfer elements of said row.

4. The vise of claim 1 wherein said clamp comprises two rows of said load transfer elements within said housing with said first row disposed behind said fingers and a second row of load transfer elements disposed rearwardly of said first row and which consists of as many load transfer elements in said first row as the number of said clamp fingers and said clamp consists of one less load transfer element in said second row than the number of said clamp fingers.

5. The vise of claim 4 wherein each said clamp finger has a workpiece engaging surface at one end that directly contacts a workpiece during clamping and has a load transfer element engaging surface at its other end that directly contacts one of said load transfer elements of said first row during clamping.

6. The vise of claim 4 wherein said clamp consists of two rows of load transfer elements.

7. The vise of claim 4 further comprising a first said clamp carried by one of said jaws and a second said clamp carried by the other of said jaws.

8. The vise of claim 1 further comprising an extension carried by one of said clamp fingers and having a workpiece engaging surface at one end of said extension.

9. The vise of claim 1 wherein said clamp comprises two rows of said load transfer elements within said housing with said first row disposed behind said fingers and a second row of load transfer elements disposed rearwardly of said first row and wherein said housing has a rear wall and said load transfer elements of said second row are in contact with said rear wall during clamping of a workpiece between said jaws to transmit force from said clamp fingers through at least some of said load transfer elements of said first and second rows to said housing of said clamp.

10. The vise of claim 9 wherein each of said load transfer elements in said housing comprises a circular disk and said disks and said fingers are arranged such that they lie in a common plane.

11. The vise of claim 9 wherein each of said load transfer elements in said housing has a spherical sidewall.

12. The vise of claim 9 wherein each of said load transfer elements in said housing comprises a round ball.

13. The vise of claim 1 comprising a pair of rows of said load transfer elements received inside said housing wherein each said load transfer element of one of said rows has a top, a bottom, and a convex sidewall with an interlock channel adjacent its top and bottom and each said load transfer element of the other of said rows has a top, a bottom, and a concave sidewall with an interlock ridge adjacent its top and bottom whereby each of said load transfer elements of said first row are interlockable with each of said load transfer elements of said second row for increasing stability of said clamp.

14. The vise of claim 1 wherein said housing of said clamp comprises a pair of spaced apart sidewalls, a rear wall and a bottom wall, all of which define a cavity within said housing for receiving said load transfer elements therein, and wherein one of said sidewalls has an inwardly extending sidewall portion for guiding movement of one of said load transfer elements during clamping of a workpiece between said jaws.

15. The vise of claim 14 wherein both of said sidewalls have a said inwardly extending sidewall portion located adjacent said rear wall for enhancing the stability of said load transfer elements in said clamp.

16. The vise of claim 1 wherein said housing of said clamp has a pair of spaced apart sidewalls, a front wall facing the other of said jaws which is spaced apart from a rear wall, and a bottom wall, all of which define a cavity within said housing for receiving said load transfer elements therein, and wherein each said clamp finger has an axis generally parallel to its direction of reciprocable movement and each said sidewall of said housing has a sidewall portion within said cavity that is acutely inclined relative to said axis inwardly into said cavity for providing an acutely angled inwardly inclined guide surface for guiding one of said load transfer elements.

17. The vise of claim 16 wherein each said sidewall has a first sidewall portion adjacent said front wall that is generally parallel to said clamp finger axis and a second sidewall portion between said first sidewall portion and said rear wall that forms said acutely angled inwardly inclined load transfer element guide surface.

18. The vise of claim 17 wherein said guide surface is acutely inwardly angled at least about 5° relative to said clamp finger axis.

19. The vise of claim 18 wherein said guide surface is acutely inwardly angled between about 30° and about 40° relative to said clamp finger axis.

20. The vise of claim 1 wherein said housing of said clamp comprises a pair of spaced apart sidewalls, a front wall facing the other of said jaws and having a plurality of through bores with said front wall spaced apart from a rear wall, and a bottom wall, all of which define a cavity within said housing for receiving said load transfer elements therein, and wherein each said clamp finger is slidably telescopically received in one of said bores and has one end received inside said housing cavity that is larger than said bore for preventing complete withdrawal of said clamp finger from said clamp housing.

21. The vise of claim 1 wherein said clamp comprises:

(a) an inner clamp unit having a housing, a reciprocable clamp finger extending outwardly from said housing, and at least two load transfer elements received in said housing with at least one of said load transfer elements in cooperation with said finger;

(b) an outer clamp unit on one side of said inner clamp unit and having a housing, a reciprocable clamp finger extending outwardly from said housing, and at least two load transfer elements received in said housing with at least one of said load transfer elements in cooperation with said finger; and (c) wherein at least one of said load transfer elements of said inner clamp unit cooperates with at least one of said load transfer elements of said outer clamp unit.

22. The vise of claim 21 further comprising a load communicating element having one end in cooperation with one of said load transfer elements of said inner clamp unit and the other end in cooperation with one of said load transfer element of said outer clamp unit for transmitting displacement of one of said clamp fingers of one of said clamp units relative to the other of said clamp fingers of the other of said clamp units into the one of said clamp units to at least one of said load transfer elements of the other of said clamp units during clamping to compensate for workpiece tolerance differences or contour variations of a workpiece.

23. The vise of claim 22 wherein said load communicating element is elongate and of generally rectangular or cylindrical cross section, said inner clamp unit has a clamp finger, a single load transfer element in a first row behind said clamp finger and in contact with said clamp finger, a pair of load transfer elements in a second row behind said first row, and at least one of said load transfer elements in said second row cooperates with said load communicating element.

24. The vise of claim 22 wherein said outer clamp unit has a clamp finger, a single load transfer element in a first row behind said clamp finger, a single load transfer element in a second row behind said load transfer element of said first row, and said load transfer element in said second row cooperates with said load communicating element.

25. The vise of claim 1 wherein said clamp has at least three reciprocable fingers with one pair of adjacent fingers spaced apart further apart than another pair of adjacent fingers.

26. The vise of claim 25 wherein said clamp has at least three of said clamp fingers such that there are two pairs of adjacent clamp fingers, a second row of said load transfer elements behind said row of fingers adjacent said fingers, a load transfer element behind each said clamp finger and contacting said clamp finger during clamping of a workpiece by that said clamp finger and having an elongate load communicating element in contact with a pair of load transfer elements of one of said rows to space apart said elements for enabling one pair of adjacent clamp fingers to be spaced further apart from each other than the other pair of adjacent clamp fingers.

27. The vise of claim 26 wherein said load communicating element is interjacent said one pair of adjacent fingers which is further spaced apart than another pair of adjacent fingers.

28. The vise of claim 25 wherein said clamp comprises two rows of said load transfer elements with a first said row disposed adjacent to and rearwardly of said fingers and a second said row disposed behind said first row with said first row having more load transfer elements than the number of said fingers and said second row having one less of said load transfer elements than the number of said load transfer elements in said first row.

29. The vise of claim 1 further comprising a plurality of workpieces and wherein each said finger bears against only a single said workpiece during clamping.

30. The vise of claim 1 wherein during clamping all of said fingers substantially simultaneously bear against a single workpiece to urge said workpiece against the other of said jaws.

31. The vise of claim 1 wherein:

1) said clamp has a plurality of said fingers and consists of two rows of said load transfer elements;

2) each said load transfer element comprises a generally circular disk;

3) said housing has a cavity for receiving said load transfer elements therein with said cavity defined by a front wall having a plurality of spaced apart bores with one of said fingers received in each said bore, a rear wall spaced from said front wall, a bottom wall upon which each said load transfer element slidably moves, and a pair of spaced apart sidewalls; and 4) each said sidewall has a portion adjacent said rear wall that extends further inwardly into said cavity than another portion of said wall adjacent said front wall for guiding movement of one of said load transfer elements of said first row.

32. The vise of claim 31 wherein said portion of each said sidewall adjacent said rear wall is inclined inwardly into said cavity forming an inwardly inclined guide surface that guides movement of one of said load transfer elements of said first row that is immediately adjacent said guide surface.

33. A vise for holding one or more workpieces comprising:

(a) a base;

(b) a pair of jaws carried by said base with at least one of said jaws movable relative to the other of said jaws for holding one or more workpieces between said jaws;

(c) wherein one of said jaws comprises a clamp having a housing, at least two load transfer elements received in said housing, at least two reciprocable clamp fingers extending outwardly from said housing; and (d) a removable extension carried by one of said fingers having a workpiece engaging surface at a free end of said extension for bearing against a workpiece or a portion of said workpiece to urge said workpiece toward the other of said jaws.

34. The vise of claim 33 comprising a single workpiece having a three dimensionally contoured exterior received between said jaws, a plurality of said fingers, a plurality of said extensions, and wherein:

1) said housing has a rear wall, a front wall with a plurality of spaced apart bores with each said bore for reciprocably telescopically receiving one of said fingers and spacing apart said finger from other said fingers, a pair of spaced apart sidewalls wherein said front wall, rear wall, and sidewalls define a cavity for receiving said load transfer elements;

2) said clamp has at least four and no more than ten of said fingers, with all of said fingers lying in a common plane, each said finger telescopically received in one of said bores in said housing front wall; and 3) each said finger carries one of said extensions with one of said extensions longer than another of said extensions with the lengths of said extensions selected such that said workpiece engaging surface of each said extension bears against a portion of said three dimensionally contoured exterior of said workpiece.

35. The vise of claim 34 wherein all of said load transfer elements lie in a common plane and consisting of two rows of said load transfer elements in said cavity with 1) one of said rows adjacent to and immediately behind said fingers and consisting of the same number of said load transfer elements in said first row as the number of said fingers and 2) the other of said rows behind the one of said rows and consisting of one less of said load transfer elements in the other of said rows than the number of said fingers.

36. A vise for holding one or more workpieces comprising:

(a) a base;

(b) a pair of spaced apart jaws carried by said base with at least one of said jaws movable relative to and toward the other of said jaws for holding one or more workpieces between said jaws;

(c) a clamp carried by one of said jaws and having a housing, a plurality of reciprocable clamp fingers extending outwardly from said housing for engaging a workpiece disposed between said clamp and the other of said jaws, and a plurality of load transfer elements received in said housing 1) each of which are movable within said housing relative to said housing and 2) at least some of which cooperate with said fingers;

(d) wherein said load transfer elements are arranged within said housing in a first row of said load transfer elements disposed rearwardly of said clamp fingers and a second row of said load transfer elements disposed further rearwardly of said clamp fingers; and (e) wherein said first row of said load transfer elements has the same number of said load transfer elements as the number of said fingers and said second row of said load transfer elements has one less of said load transfer elements than the number of said fingers.

37. The vise of claim 36 further comprising a cavity in said housing wherein said load transfer elements are received therein and generally lie in a common plane, said cavity defined by a top wall, a bottom wall, a rear wall, a pair of spaced apart sidewalls and a front wall, and wherein said fingers are spaced apart from each other.

38. The vise of claim 37 wherein each of said load transfer elements comprise a generally circular disk having a substantially flat surface for slidably moving along one of said bottom and top walls.

39. The vise of claim 36 further comprising a cavity in said housing wherein said load transfer elements are received therein, said cavity defined by a bottom wall along which said load transfer elements move, a rear wall, and a pair of spaced apart sidewalls with each said sidewall having an inclined guide surface portion that extends inwardly from said sidewall into said cavity adjacent said rear wall with each said guide surface for guiding movement of one of said load transfer elements.

40. A vise for holding one or more workpieces comprising:

(a) a base;

(b) a pair of opposed and spaced apart jaws carried by said base with at least one of said jaws movable relative to and toward the other of said jaws for holding one or more workpieces between said jaws;

(c) wherein one of said jaws comprises a clamp having a housing comprising a rear wall, a bottom wall and a pair of spaced apart sidewalls defining a cavity, a plurality of reciprocable clamp fingers extending outwardly from said housing toward the other of said jaws for engaging a workpiece disposed between said jaws, and a plurality of movable load transfer elements received in said housing cavity; and (d) wherein each said sidewall has a first sidewall portion and a second sidewall portion with said second sidewall portion distal from said fingers and extending further inwardly into said cavity than said first sidewall portion of said sidewall which is adjacent said fingers with said second sidewall portion extending inwardly into said cavity for guiding movement of one of said load transfer elements during clamping.

41. The vise of claim 40 wherein each of said clamp fingers have an axis generally parallel to the direction of reciprocable movement of that said clamp finger and said sidewall portion adjacent said fingers is generally parallel to said axis and said inwardly extending sidewall portion is substantially straight but acutely inclined at an angle inwardly into said cavity forming a ramp-shaped guide surface in cooperation with at least one of said load transfer elements for guiding movement of said at least one of said load transfer elements.

42. The vise of claim 41 wherein said clamp housing further comprises a front wall having a plurality of spaced apart through bores with each said through bore slidably telescopically receiving one of said reciprocable clamp fingers thereby spacing apart said fingers.

43. The vise of claim 42 wherein said load transfer elements are arranged within said cavity into two rows with one of said rows of said load transfer elements disposed behind said reciprocable fingers and the other of said rows of said load transfer elements having a portion of each said load transfer element disposed rearwardly of the one of said rows and wherein each said acutely angled inclined guide surface guides movement of one of said load transfer elements of the one of said rows.

44. The vise of claim 43 wherein said guide surface is acutely inwardly inclined into said cavity at an angle of at least 5° relative to said reciprocable clamp finger axis.

45. The vise of claim 44 wherein said guide surface is acutely inwardly inclined between 30° and 40° relative to said clamp finger axis.

46. The vise of claim 45 wherein said fingers and said load transfer elements lie substantially in a common plane.

47. A vise for holding one or more workpieces comprising:

(a) a base;

(b) a pair of jaws carried by said base;

(c) wherein one of said jaws comprises a clamp having a housing with a cavity therein and a front wall facing the other of said jaws and having a plurality of spaced apart bores, a plurality of elongate and reciprocable clamp fingers with one of said fingers slidably telescopically received in each said bore and having a portion extending outwardly from said housing, and a plurality of movable load transfer elements; and (d) wherein each of said clamp fingers has one end received inside said housing cavity with a portion of said finger received in said cavity that is larger than said bore for preventing complete withdrawal of said clamp finger from said clamp housing.

48. The vise of claim 47 wherein said housing comprises a rear wall spaced from said front wall and a pair of spaced apart sidewalls with all of said walls defining said cavity and wherein each said sidewall further comprises an inwardly inclined portion that extends inwardly into said cavity adjacent said rear wall forming an inclined guide surface that cooperates with at least one of said load transfer elements to guide movement of said at least one of said load transfer elements.

49. The vise of claim 47 wherein 1) each said load transfer element is a truncated generally cylindrical disk and has a center point, 2) all of said load transfer elements and said fingers lie in a common plane, and 3) within said cavity said load transfer elements are arranged in two rows with one of said rows disposed adjacent said front wall and the other of said rows disposed further rearwardly of said row adjacent said front wall with said center point of each said load transfer element of said further rearwardly disposed row disposed rearwardly of and between said center points of the two immediately adjacent load transfer elements of said row adjacent said front wall.

50. The vise of claim 47 wherein said load transfer elements lie in the same plane and consist of two rows of said load transfer element with one of said rows disposed adjacent said front wall and the other of said rows disposed adjacent said rear wall with said row of said load transfer elements adjacent said rear wall consisting of one less of said load transfer elements as the number of said load transfer elements in said row of said load transfer elements adjacent said front wall.

51. A vise for holding one or more workpieces comprising:

(a) a base;

(b) a pair of jaws carried by said base with at least one of said jaws movable relative to the other of said jaws for holding one or more workpieces between said jaws; and (c) wherein one of said jaws comprises a clamp having a housing with a cavity inside and a front wall generally facing the other of said jaws having a plurality of spaced apart bores, a plurality of reciprocable clamp fingers with each of said fingers slidably telescopically received in one of said bores, a plurality of movable load transfer elements received in said housing cavity, and a fixed divider in said cavity disposed between each adjacent pair of said fingers and adjacent said front wall for helping to separate said load transfer elements that are adjacent said front wall.

52. The vise of claim 51 wherein each said divider is integral with said front wall and extends from said front wall inwardly into said cavity.

53. The vise of claim 52 wherein said clamp housing further comprises a pair of spaced apart sidewalls and a rear wall spaced from said front wall defining said cavity and each said sidewall further comprises a guide surface portion adjacent said rear wall that is inwardly inclined into said cavity for cooperating with one or more of said load transfer elements to help urge said load transfer elements toward each other during clamping.

54. The vise of claim 53 consisting of two rows of said load transfer elements in said cavity with one of said rows disposed behind said fingers and the other of said rows disposed adjacent said rear wall of said clamp housing.

55. The vise of claim 51 wherein each said load transfer element has a center point and comprising two rows of said load transfer elements received inside said cavity with one of said rows adjacent said front wall and the other of said rows disposed rearwardly of the one of said rows with the other of said rows having one less load transfer element than the number of load transfer elements in the one of said rows and wherein each center point of each said load transfer element of the one of said rows is located rearwardly of and between the center points of two adjacent load transfer elements of the one of said rows.

56. A vise for holding one or more workpieces comprising:

(a) a base;

(b) a pair of opposed spaced apart jaws carried by said base;

(c) a clamp carried by one of said jaws and having a housing comprising a rear wall, a front wall spaced from said rear wall, a bottom wall, and a pair of spaced apart sidewalls defining a cavity, a plurality of spaced apart reciprocable clamp fingers extending outwardly from said housing, and a plurality of disk-shaped load transfer elements received in said housing cavity for slidable movement on said bottom wall and consisting of 1) a first row of said load transfer elements in cooperation with said fingers and 2) a second row of said load transfer elements in cooperation with said load transfer elements of said first row;

(d) wherein each said sidewall has an inclined portion adjacent said rear wall that extends inwardly into said cavity forming a guide surface for guiding movement of one of said load transfer elements during clamping; and (e) wherein said second row has one less of said load transfer elements than the number of said load transfer elements in said first row.

57. The vise of claim 56 further comprising a plurality of dividers in said cavity with one of said dividers located between each pair of adjacent fingers.

58. The vise of claim 56 wherein each said finger has a longitudinal axis generally parallel to the direction of its reciprocable movement and each said guide surface is acutely inwardly inclined into said cavity at an angle of between 30° and 40° relative to said axis.

59. The vise of claim 56 wherein each said load transfer element has a diameter of at least about 0.75 inches and a thickness of at least about 0.456 inches.

60. The vise of claim 56 wherein said load transfer elements of said second row bear against said rear wall during clamping, and each said inclined guide surface cooperates with one of said load transfer elements of said first row to guide movement of said one of said load transfer elements of said first row at an angle generally parallel to said inclined guide surface urging it generally toward the other said load transfer elements of said first row during clamping.

61. A vise for holding one or more workpieces comprising:

(a) a base;

(b) a pair of jaws carried by said base with at least one of said jaws movable relative to the other of said jaws for holding one or more workpieces between said jaws;

(c) a clamp carried by one of said jaws comprising a pair of side-by-side clamp units each having a housing, a reciprocable clamp finger extending outwardly from said housing for bearing against and urging a workpiece disposed between said jaws toward the other of said jaws, and at least two load transfer elements received in said housing capable of moving within said housing relative to said housing and relative to each other with one of said load transfer elements located behind said finger; and (d) wherein one of said load transfer elements of one of said clamp units is in cooperation with one of said load transfer elements of the other of said clamp units for transmitting movement of said finger of one of said clamp units relative to said finger of the other of said clamp units to one of said load transfer elements of the other of said clamp units.

62. The vise of claim 61 further comprising a reciprocable load communicating element in cooperation with one of said load transfer elements of one of said clamp units and in cooperation with one of said load transfer elements of the other of said clamp units for transmitting movement of said finger of one of said clamp units relative to said finger of the other of said clamp units to one of said load transfer elements of the other of said clamp units.

63. The vise of claim 62 further comprising a plurality of side-by-side said clamp units and each adjacent pair of said clamp units having one of said load communicating elements in cooperation with one of said load transfer element of said adjacent pair of clamp units wherein each said load communicating element is reciprocable in a direction generally perpendicular to the direction of reciprocable movement of each said finger.

64. A vise for holding one or more workpieces comprising:

(a) a base;

(b) a pair of opposed and spaced apart jaws carried by said base; and (c) a clamp carried by one of said jaws and having a housing with a cavity therein, a plurality of spaced apart reciprocable clamp fingers extending outwardly from said housing, and a plurality of load transfer elements received in said housing cavity consisting of two rows of said load transfer elements with one of said rows of said load transfer elements in cooperation with said fingers and the other of said rows of said load transfer elements in cooperation with said load transfer elements of the one said row.

65. A vise for holding one or more workpieces comprising:

(a) a base;

(b) a pair of opposed and spaced apart jaws carried by said base with at least one of said jaws movable relative to and toward the other of said jaws;

(c) a clamp carried by one of said jaws and having a housing comprising a rear wall, a bottom wall and a pair of spaced apart sidewalls defining a cavity;

(d) means for holding a workpiece located between said jaws against the other of said jaws extending outwardly from said housing toward the other of said jaws, said workpiece holding means movable relative to said housing;

(e) a plurality of movable load transfer elements received in said clamp housing cavity with at least some of said load transfer elements in cooperation with said workpiece holding means; and (f) wherein at least one of said sidewalls has a portion that juts inwardly from said sidewall into said cavity and which is constructed and arranged to alter the direction of movement of one of said load transfer elements during clamping of a workpiece.

66. A vise for holding one or more workpieces comprising:

(a) a base;

(b) a pair of opposed and spaced apart jaws carried by said base with at least one of said jaws movable relative to and toward the other of said jaws;

(c) a clamp carried by one of said jaws and having a housing comprising a rear wall and a pair of spaced apart sidewalls defining a cavity;

(d) a plurality of movable load transfer elements received in said clamp housing cavity; and (e) a plurality of spaced apart reciprocable fingers extending outwardly from said housing comprising two pairs of adjacent fingers with one pair of said adjacent fingers having a space between said adjacent fingers that is greater than the space between the other pair of said adjacent fingers.

* * * * *